US011705094B2

(12) United States Patent
Bedson et al.

(10) Patent No.: US 11,705,094 B2
(45) **Date of Patent: *Jul. 18, 2023**

(54) DRUMHEAD TUNING RIM SYSTEM AND METHOD OF USE

(71) Applicant: Bedson Drum Co., Bellevue, WA (US)

(72) Inventors: Bryan Thomas Bedson, Wenatchee, WA (US); Robin Richard Slaton, Fort Collins, CO (US)

(73) Assignee: Bedson Drum Co., Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/717,963

(22) Filed: Apr. 11, 2022

(65) Prior Publication Data

US 2022/0238086 A1 Jul. 28, 2022

Related U.S. Application Data

(63) Continuation of application No. 17/062,820, filed on Oct. 5, 2020, which is a continuation of application No. 16/716,300, filed on Dec. 16, 2019, now Pat. No. 10,796,674.

(60) Provisional application No. 62/780,871, filed on Dec. 17, 2018.

(51) Int. Cl.
*G10D 13/02* (2020.01)
*G10D 13/16* (2020.01)

(52) U.S. Cl.
CPC ..... *G10D 13/02* (2013.01); *G10D 13/16* (2020.02)

(58) Field of Classification Search
CPC ..... G10D 13/02; G10D 13/16; G10D 3/00
See application file for complete search history.

(56) References Cited

U.S. PATENT DOCUMENTS 8,642,867 B1 * 2/2014 Bedson ..... G10D 13/16 84/413
9,006,548 B2 * 4/2015 Bedson ..... G10D 13/02 84/413
9,767,773 B2 * 9/2017 Bedson ..... G10D 13/16

* cited by examiner

*Primary Examiner* — Kimberly R Lockett
(74) *Attorney, Agent, or Firm* — Master Key IP, LLP; Jeromye V. Sartain

(57) ABSTRACT

A drumhead tuning rim system and method for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

20 Claims, 18 Drawing Sheets

DRUMHEAD TUNING RIM SYSTEM AND METHOD OF USE

RELATED APPLICATIONS

This is a continuation application and so claims the benefit pursuant to 35 U.S.C. § 120 of a prior filed and currently pending U.S. application having Ser. No. 17/062,820 and filing date of Oct. 5, 2020, and entitled "Drumhead Tuning Rim System and Method of Use," which application is also a continuation and so claims the benefit pursuant to 35 U.S.C. § 120 of a prior U.S. application having Ser. No. 16/716,300 and filing date of Dec. 16, 2019, and entitled "Drumhead Tuning Rim System and Method of Use," which is now U.S. Pat. No. 10,796,674 issued on Oct. 6, 2020, which claims priority pursuant to 35 U.S.C. § 119(e) to and is entitled to the filing date of a prior U.S. provisional application having Ser. No. 62/780,871 and filing date of Dec. 17, 2018, and entitled "Quick-Change Drum Rim," the contents of all of which are incorporated in their entireties herein by reference.

INCORPORATION BY REFERENCE

Applicant hereby incorporates herein by reference any and all patents and published patent applications cited or referred to in this application.

BACKGROUND OF THE INVENTION

Field of the Invention

Aspects of this invention relate generally to musical drums, and more particularly to devices for holding and tuning a drumhead on a drum shell and systems incorporating such devices.

Description of Related Art

As is known in the art, musical instruments generally referred to as "drums" are typically comprised of a drum shell and one or more drumheads. The drum shell is usually a hollow annular body of wood or other material having a certain diameter and length or depth. A drumhead is essentially a membrane, traditionally of animal skin and now more often of synthetic fiber such as polyester, Mylar, Kevlar or other suitable material, that is stretched over one or both open ends of the drum shell so as to vibrate and produce a tone when struck by the hand, a drum stick, or other object. Each drumhead is typically formed with a relatively rigid hoop about its perimeter, which is configured to seat on or about an open end of the drum shell. The drumhead may thus be held in place and in tension on the drum shell by affixing it thereto, either with bolts through metal "claws" attached directly to the hoop of the drumhead or with bolts through holes in a flanged rim that fits over the drumhead hoop and effectively pinches or traps the drumhead hoop between the rim and the drum shell. The bolts, called tension rods, are screwed, as with a drum key, into threaded lugs attached to the drum shell in order to secure and tune the drumhead. Depending on the size and style of the drum, ranging from large bass drums to small toms and the classic snare drum, the drum shell and corresponding rim(s) may be configured with six, eight, or twelve tension rod and lug sets or pairs.

One challenge with the prior art system of securing and tuning a drumhead through the conventional tension rod and lug hardware that has been employed for decades is that producing uniform tension all the way around the drumhead hoop or rim as by individually adjusting each tension rod, and thus evenly tuning the drumhead across its entire surface, is difficult and time-consuming.

Irrespective of the tuning of a drumhead once it is secured on the drum shell via the rim, another challenge presented by the decades-old prior art system of conventional tension rod and lug hardware for securing a drumhead is that the tension rods must be completely unthreaded and removed from the lugs all the way around the drum in order to fully disengage the rim from the shell and thus be able to remove and replace the drumhead. This obviously is a relatively time-consuming and inconvenient endeavor, particularly when replacing multiple heads and/or for larger drums having more rod-lug pairs, and when a single-point tensioning system is involved such removal and replacement of the rim and drumhead is further complicated.

What is needed and has heretofore been unavailable is a more convenient and effective drumhead tuning rim system and method in connection with both tuning and removing or replacing the drumhead. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are directed to a drumhead tuning rim system for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

A primary objective inherent in the above-described system and method of use is to provide advantages not taught by the prior art.

Another objective is to provide such a system and method that enables uniform tuning of a drumhead through interaction with an apparatus controller rather than the multiple tension rods in prior art drumhead hardware configurations.

A still further objective is to provide such a system and method that enables removal or installation of a drumhead through interaction with an apparatus controller and associated loosening or tightening of a single cable rather than threadably disengaging or engaging the multiple tension rods in prior art drumhead hardware configurations.

A still further objective is to provide such a system and method that enables electronic tuning of an otherwise conventional drum or drum kit.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above-described drawing figures illustrate aspects of the invention in at least one of its exemplary embodiments, which are further defined in detail in the following description.

Figure 1:
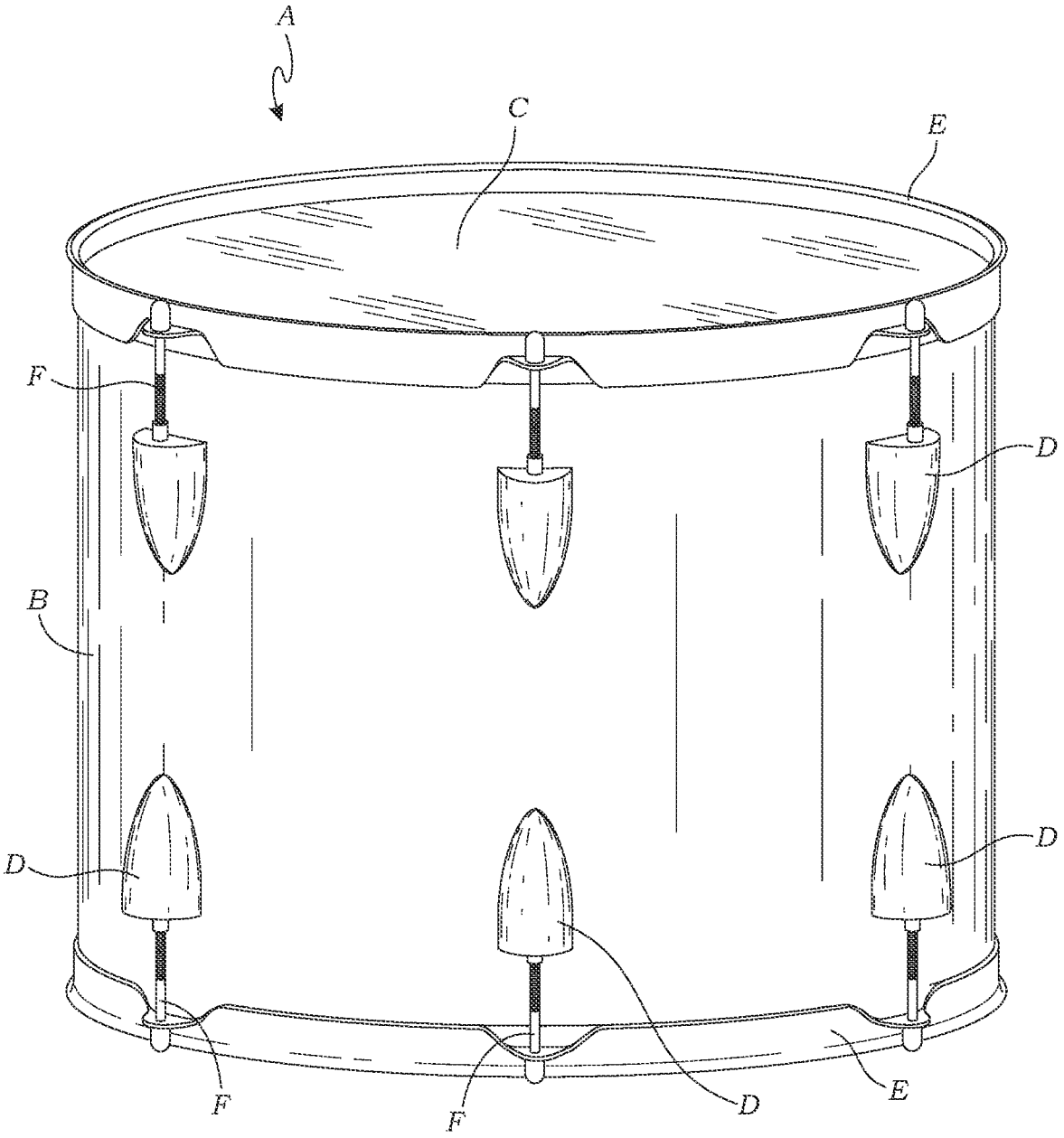
Prior Art Fig. 1
FIG. 1 is a perspective view of an exemplary prior art drum with drumhead mounting hardware.

By way of further background, and with initial reference to FIG. 1 depicting a typical tom-tom drum as is known and used in the art, the drum A is comprised of a drum shell B and one or more drumheads C stretched over one or both open ends of the drum shell B. The drum shell B is configured with lugs D spaced about its circumference, one row of lugs D for each of the top and bottom rims E. Each such rim E is configured to seat about a hoop or edge (not shown) of the drumhead C and so trap or retain the drumhead C about an open end of the drum shell B. The rim E is formed with a flange having through-holes into which are inserted bolts or tension rods F for threadable engagement with the respective lugs D. As such, the drumhead C is tuned in the prior art drum A by selectively tightening or loosening the tension rods F, whether by hand or using a drum key or other tool (not shown), so as to put the desired amount of tension or stretch on the portion of the drumhead C corresponding to the respective tension rod-lug pair. Depending on the size and style of the drum, there may be from six to twelve or more such pairs of tension rods and lugs that would need to be individually adjusted in an effort to create uniform tension over the entire drumhead and thus tune the drum—in the exemplary prior art drum A there are twelve pairs of tension rods F and lugs D, six on the top and six on the bottom, though only three of the pairs on each of the top and bottom, or six pairs total, are visible in the perspective view of FIG. 1. It will be appreciated by those skilled in the art that the typical prior art system for securing and tuning a drumhead through a number of such conventional tension rod and lug hardware pairs is relatively difficult to use and time-consuming even for experienced drummers. Therefore, it is desirable that a more simplistic approach to securing and tuning a drumhead be provided.

Figure 2:
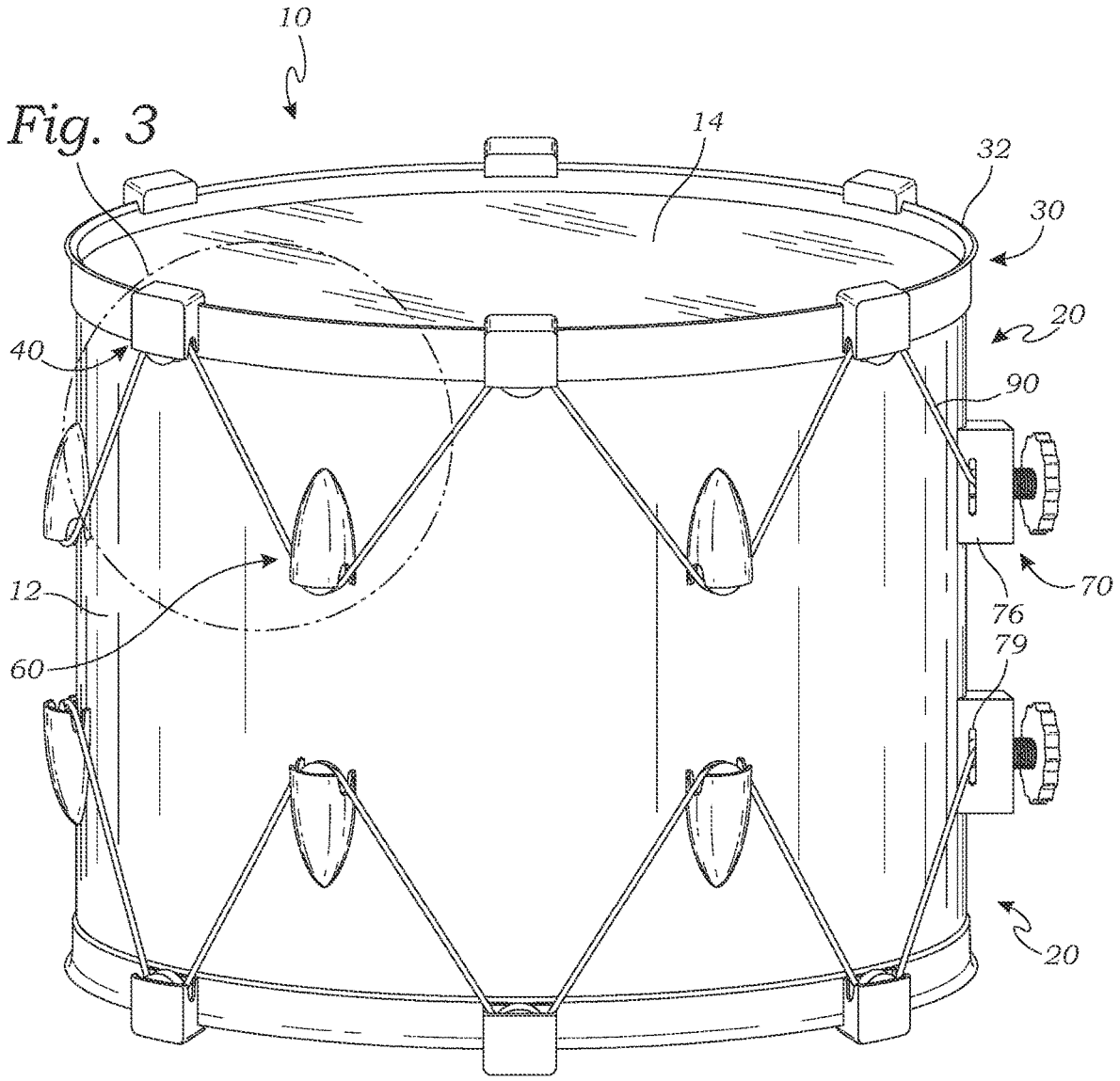
FIG. 2 is a perspective view of an exemplary embodiment of the invention.

Turning now to FIG. 2, there is shown a perspective view of an exemplary embodiment of a drumhead tuning rim apparatus 20 according to aspects of the present invention as employed in connection with a drum 10 having a drum shell 12 and at least one drumhead 14. The apparatus 20 comprises, in one embodiment, a rim 30 configured with spaced-apart grooved bearing wheel housing assemblies 40 about its perimeter and corresponding, spaced-apart grooved bearing wheel lug assemblies 60 installed about the perimeter of the drum shell 12, with a single cable 90 running alternately between the housing assemblies 40 and lug assemblies 60 and terminating at its opposite ends in a cable tension dial assembly 70 also mounted on the drum shell 12 so as to allow, based on the operative cooperation of such components of the apparatus 20, securing and tuning of the drumhead 14 on the drum shell 12 as described further below. As shown in FIG. 2, where the drum 10 has a drumhead 14 positioned on both ends of its hollow drum shell 12, two essentially identical drumhead tuning rim apparatuses 20 may be employed in a similar fashion as herein described, one such apparatus 20 associated with each drumhead 14; it will be appreciated that where a drum is configured as having only one drumhead with the other end of the drum open, only one such drumhead tuning rim apparatus according to aspects of the present invention would thus be employed. Moreover, as will be appreciated from the below discussion of the alternative embodiment of FIGS. 8 and 9, in some arrangements a single drumhead tuning rim apparatus may be employed according to aspects of the invention in tuning two opposed drumheads, whether independently or simultaneously. For simplicity throughout the instant Specification, wherever two are shown in the figures, one drumhead tuning rim apparatus 20 is described in terms of its construction and use, the second again being analogous structure and essentially a mirror image of the first. However, in particular applications it may be desirable to configure the tuning rim apparatuses differently from one another in one or more respects even on the same drum, such as when a different effect or functionality of one drumhead versus another is desired or where the drum and particularly the drum shell and thus the sizes and shapes of the respective drumheads are not identical or symmetrical. Those skilled in the art will appreciate that while a particular configuration of the drumhead tuning rim apparatus 20 is shown and described, the invention is not so limited, but instead may take other forms and involve other components and materials now known or later developed without departing from the spirit and scope of the invention. Furthermore, it is noted that while further aspects of the present invention relate to a system for the electronic or electro-mechanical tuning of a drum employing a drumhead tuning rim apparatus 20 according to aspects of the present invention, it will be appreciated that such a "system" is more broadly to be understood as any arrangement of components according to aspects of the present invention, whether manually operated, electronically or electro-mechanically operated, or otherwise, such that any and all embodiments presented herein are or define a system according to aspects of the present invention.

With continued reference to FIG. 2, a number of grooved bearing wheel housing assemblies 40, six in the exemplary embodiment, are attached or mounted on the rim 30 of the drum 10 at evenly spaced intervals, replacing the traditional tension rod holes formed on the typical hoop rim E (FIG. 1). At substantially equal spacing about the perimeter of the drum shell 12 there are positioned corresponding grooved bearing wheel lug assemblies 60.

It is noted that while in the exemplary embodiment there are six grooved bearing wheel housing assemblies 40, there would only be five corresponding grooved bearing wheel lug assemblies 60, as the sixth position about the perimeter of the drum shell 12 between one pair of housing assemblies 40 would instead be taken by the cable tension dial assembly 70, more about which is said below in connection with FIGS. 6 and 7. In the exemplary embodiment, each such lug assembly 60 is located circumferentially substantially midway between the closest two housing assemblies 40, though as will be appreciated from alternative embodiments herein, such is not necessary. Moreover, the lengthwise offset distance down the drum shell 12 from the rim 30 at which the lug assemblies 60 are located is substantially equal to the circumferential distance from a particular lug assembly 60 to each adjacent housing assembly 40, whereby the angle that the cable 90 bends as it goes through each housing or lug assembly 40, 60 is approximately ninety degrees (90°), though it will be appreciated that this angle can vary depending on a number of factors, such as the desired configuration of the rim 30 and spacing of the housing assemblies 40 thereabout, the type and length of the drum shell 12 and the resulting position thereon of the lug assemblies 60, and the intended drumhead 14 and the amount of tension that is to be put on it, such that it is to be expressly understood that the invention is not limited to the particular positions and spacing of the housing and lug assemblies 40, 60, which are merely illustrative of aspects of the present invention. Relatedly, though the housing assemblies 40 are shown as being at substantially the same locations as would be the tension rods F in a conventional drum A as shown in FIG. 1, or the lug assemblies 60 at substantially the same locations as would be the lugs D, it will be appreciated that such locations of the housing or lug assemblies 40, 60 may vary from those shown without departing from the spirit and scope of the invention. It is noted that while the present invention is shown and described in connection with installation on a drum 10, the components of the drumhead tuning rim apparatus 20 may be sold separately from any drum, such as for an aftermarket installation, in which case it is preferable that the lug assemblies 60 and the cable tension dial assembly 70 be configured to be installed in holes already formed in the drum shell B, or in the locations where the lugs D were originally installed, though again this is not necessary. In any case, it will be appreciated that the components of the drumhead tuning rim apparatus 20, including the rim 30 with housing assemblies 40 thereabout, the lug assemblies 60, the cable tension dial assembly 70, the tensioning cable 90, and assorted bolts and nuts or other fasteners and the like, may be sold as a kit, whereby any prior art drum A can be converted from a conventional tension rod and lug rim securing and tuning system to a "dial-tune" system according to aspects of the present invention. Therefore, while the present invention is shown and described in the context of installation on a drum 10, it is to be understood that the drumhead tuning rim apparatus 20 may exist apart from any such drum, particularly for the purpose of distribution and sales. Relatedly, the housing assemblies 40 of whatever configuration may not only be integrally formed with the rim 30 as by machining, forming, casting, etc. or otherwise permanently mounted thereon as by welding, bonding, etc. but may also be removably engageable with the rim, whether the rim is a prior art rim E as shown in FIG. 1, with the housing assemblies 40 installed or engaged with the traditional tension rod holes formed on the typical hoop rim E, for example, or some other rim formed according to aspects of the present invention, such that the housing assemblies 40 may be formed and sold separately for either aftermarket retrofit applications or simply replacement as desired within installations according to aspects of the invention. Such removable housing assemblies 40 may be attached to the rim 30 using any appropriate technique or device now known or later developed, including but not limited to bolt, pin, hook, clip, slot engagement, press-fit, etc., or may be effectively mounted on or operably engaged with the shell, including but not limited to on the lug assemblies 60 specifically, and so removably engage the rim 30, such as shown and described in connection with the alternative exemplary embodiment of FIGS. 16-21 described further below. More generally, it will again be appreciated by those skilled in the art that any and all such bearing wheel or low friction housing and lug assemblies 40/140, 60/160 as configured and employed in connection with any exemplary embodiments shown and described herein or as otherwise consistent with aspects of the present invention may take any appropriate form and be installed or positioned in any appropriate location on or about the drum 10 without departing from the spirit and scope of the invention, with the "housing" and "lug" terminology being adopted nomenclature simply for purpose of reference only, such terms along with "bearing wheel" and "low friction" being illustrative and non-limiting and expressly having nothing to do with traditional lugs D and tension rods F (FIG. 1) other than possibly in some exemplary embodiments being located on the shell 12 or rim 30, 31 where such traditional hardware may have originally been installed or could have been.

Figure 3:
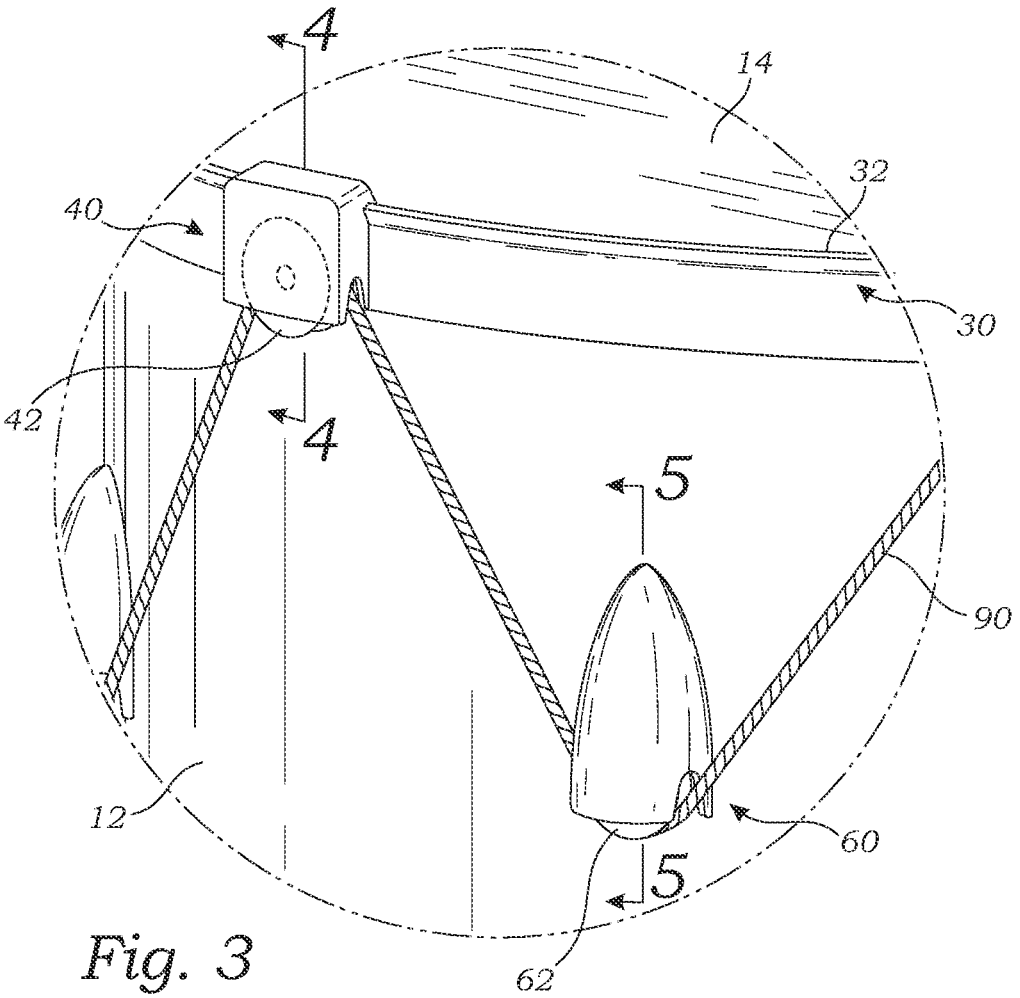
FIG. 3 is an enlarged partial perspective view thereof taken from circle "FIG. 3" of FIG. 2.

Referring next to FIG. 3, there is shown an enlarged partial perspective view of a portion of the drumhead tuning rim apparatus 20 including one each of a grooved bearing wheel housing assembly 40 and an adjacent grooved bearing wheel lug assembly 60 with the tensioning cable 90 passing therebetween on its way around the entire perimeter of the drum shell 12 alternating between such housing and lug assemblies 40, 60 as best shown in FIG. 2. Each housing and lug assembly 40, 60 is thus configured with a grooved bearing wheel 42, 62, respectively, about which the cable 90 runs in a relatively low friction manner as it passes through each component in forming the drumhead tuning rim apparatus 20. In this regard, it will be appreciated that in alternate embodiments the apparatus 20 may not have any wheels 42, 62, but may instead provide other low friction or sliding surfaces on which the cable 90 may run, such as appropriately sized and oriented grooved or notched sliding surfaces. Such sliding-type bearing surfaces may be made of nylon, for example, or any other such low friction material now known or later developed. The cable 90 similarly may be made of a variety of materials now known or later developed, including but not limited to steel, Kevlar® aramid fiber manufactured by DuPont, Spectra® braided high molecular weight polyethylene ("HMPE") fiber manufactured by Honeywell (e.g., "Spectra Xtreme Braid"), Dyneema® ultra-high molecular weight polyethylene ("UHMWPE") fiber manufactured by DSM Dyneema, high molecular weight polyethylene ("HMPE"), nylon, fluorocarbon, polyester, and any blends of any such fibers and materials, with or without nylon or other such coatings or polyester or other such covers; in any case, preferably, the fiber employed in the cable 90 is rated to at least 300 pounds tensile strength with a stretch or elongation of less than five percent (5%) at fifty percent (50%) of max loading, though such is not required in all applications or embodiments. The cable 90 is thus a relatively strong, low-stretch, abrasion-resistant material that may be cycled through loading and unloading and hold particular loadings or tensions accurately as effectively having little to no creep over time; the cable 90 may also be pre-stretched or placed under tension for an extended period of time prior to use so as to further enhance its performance or reduce or eliminate elongation or creep. Once more, a variety of such cable materials now known or later developed may be employed in a drumhead tuning rim apparatus 20 according to aspects of the present invention without departing from its spirit and scope. By way of illustration and not limitation, the finished cable 90 may have a nominal diameter in the range of 1/32 in. (0.8 mm) to 3/16 in. (5 mm), relatively thin cable being desirable for bending and wrapping around the take-up shaft 80 of the cable tension dial assembly 70 (FIGS. 6A and 6B) and for passing smoothly over the bearing wheel/low friction housing and/or lug assemblies 40, 60; for example, a Dyneema® or Kevlar® cable 90 may be employed having a nominal diameter of on the order of 1/16" (1.8 mm), or in the range of about 1.3 to 2.3 mm, though again it will be appreciated that a variety of types of cable, whether now known or later developed, and in a range of sizes may be employed in an apparatus 20 according to aspects of the present invention without departing from its spirit and scope. The length of the cable 90 may vary widely depending on a number of factors, such as the nominal drum size or diameter, the number and arrangement of any housing and lug assemblies 40, 60, and the configuration and placement of the cable tension dial assembly 70. By way of illustration and not limitation, the cable 90 may be approximately 75 in. (1,900 mm) long for a drumhead tuning rim apparatus 20 configured for mounting and tuning a drumhead on a nominal 14-inch, 10-lug snare drum. In a bit more detail regarding the exemplary wheeled bearing approach, and with reference now to FIG. 4, an enlarged cross-sectional view of the grooved bearing wheel housing assembly 40, the housing grooved bearing wheel 42 is formed having a housing central axle 44 that seats in opposite housing channels 48 formed in the housing body 46, such that the housing grooved bearing wheel 42 is rotatably installed within the housing body 46. At the top of the housing body 46 there is further formed a somewhat downwardly-projecting angled flange 50 defining a somewhat downwardly-opening notch 52 within which a corresponding somewhat upwardly extending circumferential upper rim flange 32 of the rim 30 seats in securing the grooved bearing wheel housing assembly 40 on the rim 30. It will be appreciated that while such an interference or tongue-and-groove type installation of the grooved bearing wheel housing assembly 40 on the rim 30 is shown and described, virtually any assembly technique for securing the housing assemblies 40 about the rim 30, whether permanent or selectively removable or now known or later developed, may again be employed in the present invention without departing from its spirit and scope, including but not limited to set screws, bolts, cross-pins, rivets, adhesives, snaps, slotted engagement, spring clips, spot or tack welding, or crimping. It will be further appreciated that the housing body 46 may take any shape or form as desirable in operably containing the housing grooved bearing wheel 42, while in the exemplary embodiment such housing body 46 is configured to be relatively low profile and essentially just large enough to house the housing grooved bearing wheel 42 substantially hidden from view, with notches or the like formed in the side walls of the housing body 46 as needed for free movement of the tension cable 90 about the housing grooved bearing wheel 42; accordingly, any such housing structure capable of functioning as herein described may be employed in the present invention without departing from its spirit and scope. Furthermore, in alternate embodiments, there may be no such housing body 46 at all, but instead such structure, and the housing grooved bearing wheel 42 or other such low friction contact surface for the cable 90, particularly, may be integral with the rim 30 itself; for example, in the case of a bearing wheel, it may simply be rotatably mounted on the rim 30 as by having an axle protruding outwardly therefrom, such that it will be appreciated that the configuration of the housing assembly 40 shown and described herein is merely illustrative of aspects of the invention and non-limiting. Again, in other contexts there may be no wheels at all, but instead low friction surfaces for the cable to ride on attached to or otherwise incorporated into the rim.

Figure 5:
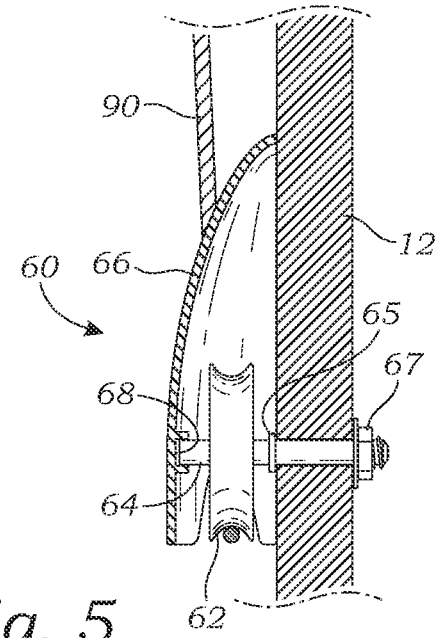
FIG. 5 is an enlarged cross-sectional view taken along line 5-5 of FIG. 3.

Referring to FIG. 5, another enlarged cross-sectional view, the complimentary grooved bearing wheel lug assembly 60 is shown as being configured similarly to the grooved bearing wheel housing assembly 40, with a lug body 66 in which is formed, here, one lug channel 68 wherein one end of a lug central axle 64 of the lug grooved bearing wheel 62 is seated. Rather than being supported at the axle 64's opposite end by another channel formed in the lug body 66, the back of the lug body 66 toward the drum shell 12 is open, and the axle 64 extends inwardly through the lug grooved bearing wheel 62 and a corresponding cross-hole formed in the drum shell 12 to thereby fasten the grooved bearing wheel lug assembly 60 onto the drum shell 12. Specifically, in the exemplary embodiment, the lug central axle 64 is formed opposite its free end that seats in the lug channel 68 with an axle flange 65 configured to abut the drum shell 12 and so space the lug grooved bearing wheel 62 away from the drum shell 12 for free rotation within the lug body 66 about the lug axle 64. The opposite end of the lug axle 64 is then threaded for receipt of a nut 67, with or without a washer, in the conventional fashion, whereby the axle 64 is secured to the drum shell 12 by clamping the shell 12 between the axle flange 65 and a nut 67. Once more, while a particular means for securing the grooved bearing wheel lug assembly 60 onto the drum shell 12 is shown and described, it will be appreciated that any installation method and related hardware, whether permanent or selectively removable or now known or later developed, may be employed without departing from the spirit and scope of the invention. Specifically, the end of the axle 64 may be secured within the channel 68 such that the lug body 66 is thereby also secured to the drum shell 12 by way of the axle 64; or the lug body 66 may be separately installed on the drum shell 12 employing any appropriate means now known or later developed. Moreover, while the lug body 66 is shown as having a somewhat teardrop shape for aesthetic purposes, it is to be appreciated that any styling will do as long as it does not compromise function. Relatedly, the lug body 66 in the exemplary embodiment is configured such that the lug grooved bearing wheel 62 is substantially hidden by the lug body 66, with slots or notches formed in the lug body 66 as needed for passage of the cable 90 even with the lug grooved bearing wheel 62 tucked up under the lug body 66 as shown. Again, those skilled in the art will appreciate that such aesthetic considerations and related form and function of the components may vary from that shown without departing from the spirit and scope of the invention. For example, there need not be a lug body 66 necessarily at all, wherein the lug grooved bearing wheel 62 or other such low friction sliding surface for the cable 90 may be installed directly on or somehow incorporated into the drum shell 12 itself, as noted above for the optional housing body 46.

Figure 6A:
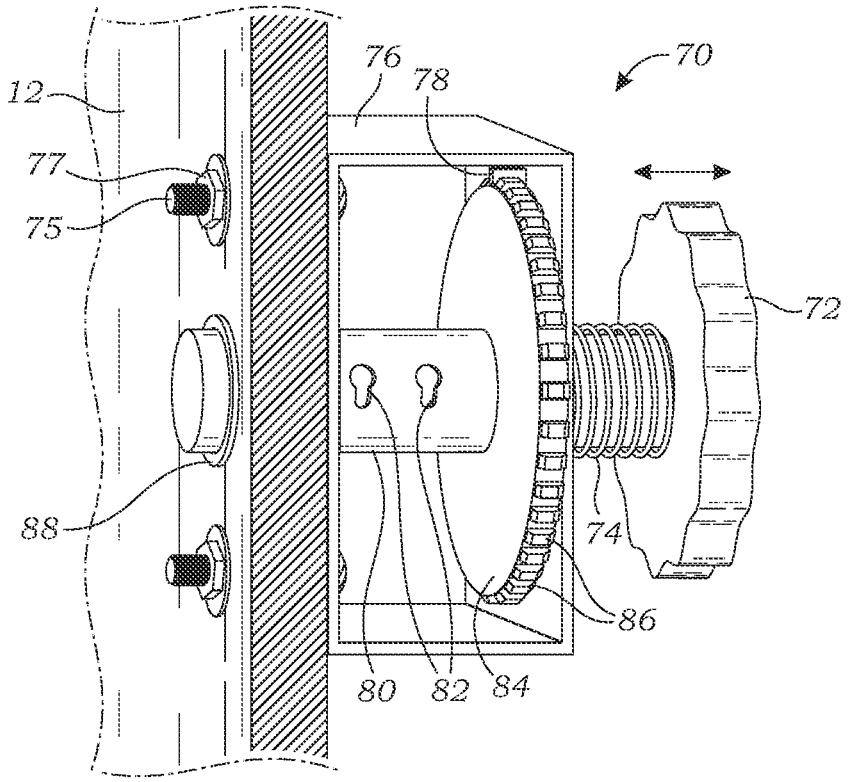
FIGS. 6A and 6B are enlarged partial perspective views thereof in two operative states.
Figure 6B:
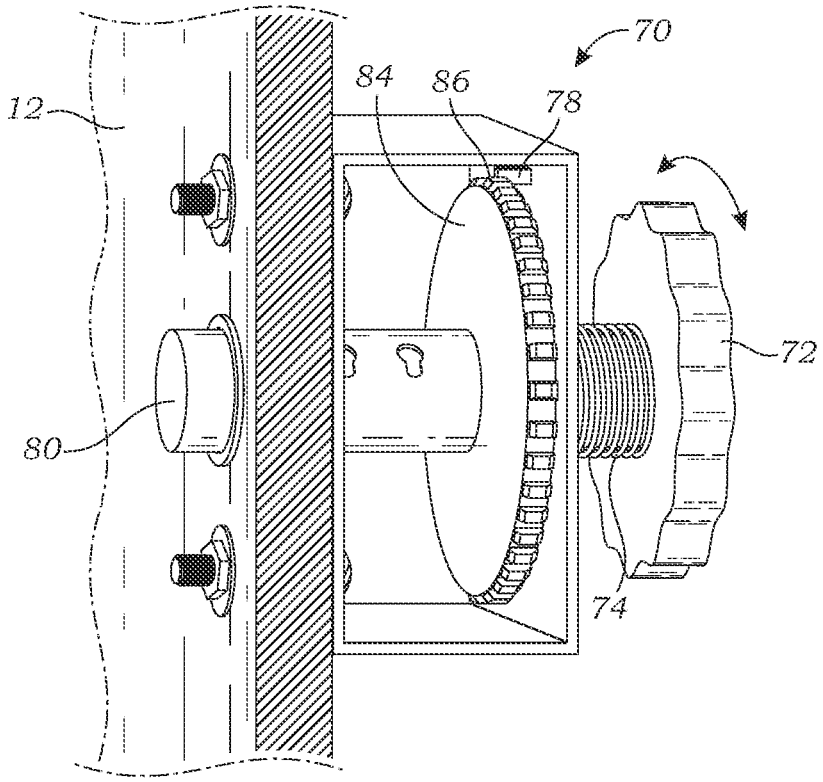

Turning now to FIGS. 6A and 6B, there are shown enlarged partial perspective views of the cable tension dial assembly 70 of the drumhead tuning rim apparatus 20 in two operative states. For simplicity and ease of viewing the inner components of the cable tension dial assembly 70, the side portion or side wall of the cable tension dial body 76 is removed and the tension cable 90 (FIG. 2) is not shown. Generally, the cable tension dial assembly 70 comprises a knob or dial 72 installed on a geared shaft 80 operable within the cable tension dial body 76 for selective rotation as by turning the dial 72 so as to increase or decrease the tension in the cable 90 (FIG. 2). In a bit more detail, the dial body 76 is configured as a substantially box-like enclosure that may be installed on the drum shell 12 in any appropriate manner, though as shown this is accomplished through a pair of small bolts 75 and associated nuts 77, with or without washers. It will be appreciated by those skilled in the art that virtually any assembly technique for securing the one or more cable tension dial assemblies 70 on the drum shell 12, whether permanent or selectively removable or now known or later developed, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the shaft 80 with gear 84, while in the exemplary embodiment such dial body 76 is configured to be relatively low profile and essentially just large enough to house an operably sized shaft 80 and gear 84. As best seen in FIG. 2, the dial body 76 in the exemplary embodiment forms a substantially complete enclosure about the moving parts shown in FIGS. 6A and 6B of the cable tension dial assembly 70, with small slots or openings 79 formed in the dial body 76 at appropriate locations for the passage therethrough of the tension cable 90. Small rollers or other such reduced friction surface may be employed in or about the openings 79 as needed in allowing for the relatively free or guided movement of the cable 90 therethrough during use of the drumhead tuning rim apparatus 20 as described further below. Accordingly, any such housing structure capable of functioning as herein described may be employed in the present invention in connection with the cable tension dial assembly 70 without departing from its spirit and scope.

Figure 8:
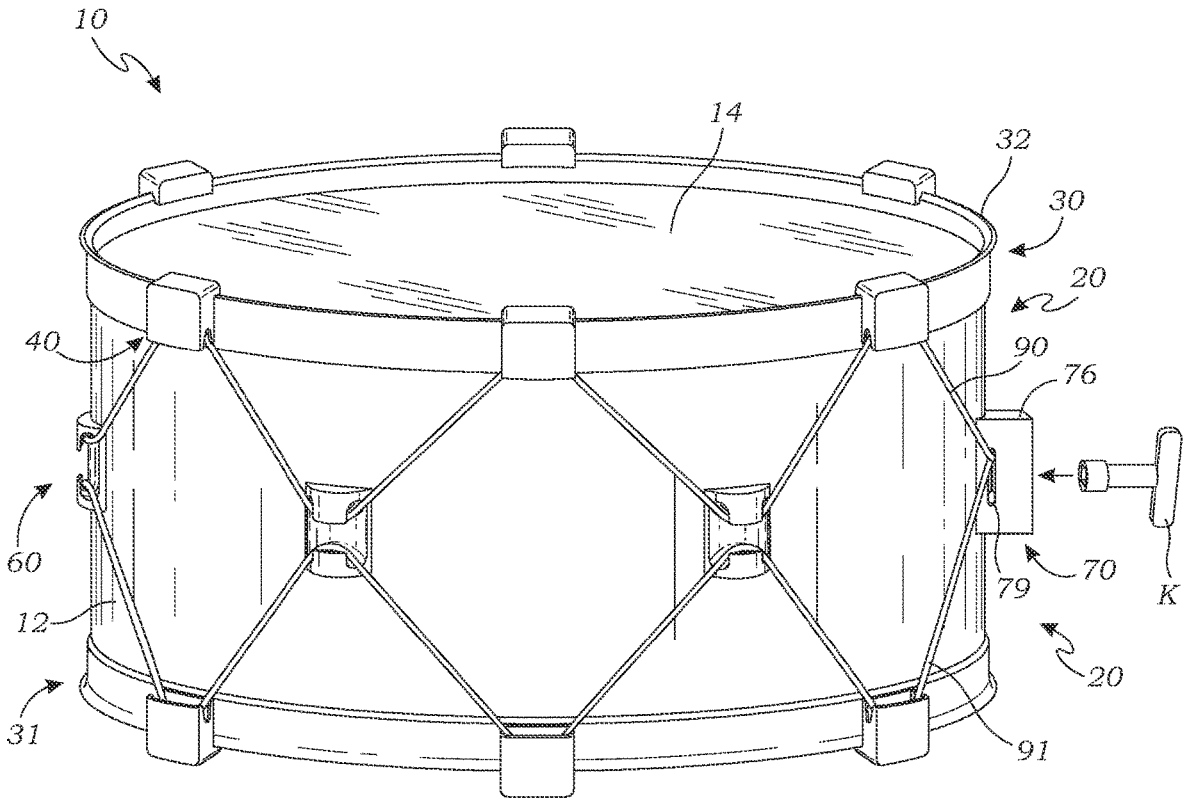
FIG. 8 is a perspective view of an alternative exemplary embodiment of the invention.
Figure 9:
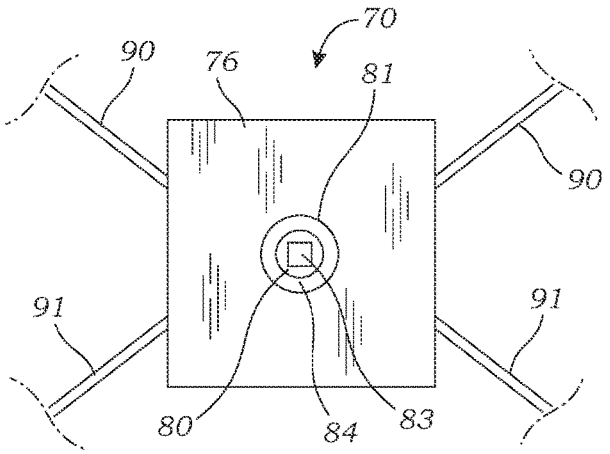
FIG. 9 is an enlarged partial side view thereof.

With continued reference to FIGS. 6A and 6B, positioned substantially centrally within the cable tension dial body 76 is the shaft 80, passing through one or more substantially axially aligned openings (not shown) in the dial body 76 and, in the exemplary embodiment, the drum shell 12. It will be appreciated that in alternate embodiments wherein the dial body 76 is sufficiently spaced from the drum shell 12 or the shaft 80 is otherwise operably supported on both ends spaced from the drum shell 12, an opening for the shaft 80 in the drum shell 12 itself would not be necessary. However, in the exemplary embodiment, in the interest of further supporting the shaft 80 and flushing to the extent possible the cable tension dial assembly 70 on the drum shell 12, the shaft 80 is shown as at least partially passing through the drum shell 12 as through a hole therein (not shown), in which case, though the dial body 76 is shown as having a rear wall immediately adjacent the drum shell 12, it will be appreciated that such wall may be eliminated in whole or in part, particularly where alternate assembly techniques for securing the cable tension dial assemblies 70 on the drum shell 12 are employed. To facilitate relatively frictionless axial and rotational movement of the shaft 80 through such drum shell hole or any opening in the dial body 76, a bushing 88 or the like may be positioned therein. Along the shaft 80 within the dial body 76 there is installed a gear 84 having multiple teeth 86. And between the gear 84 and the drum shell 12 there are formed in or along the shaft 80 one or more shaft holes 82 configured for receipt therein of the free ends of the tension cable 90 as it starts and ends within the cable tension dial assembly 70. In this way, it will generally be appreciated by those skilled in the art that with the ends of the cable 90 attached or secured to the shaft 80 in any appropriate manner now known or later developed and the rest of the cable 90 passing alternately through the housing and lug assemblies 40, 60 of the drumhead tuning rim apparatus 20, as above-described in connection with FIGS. 2-5, rotation of the shaft 80 will effectively increase or decrease the tension in the cable 90 and thus raise or lower the overall pitch of the drumhead 14 (FIG. 2) as explained further below. In the exemplary embodiment, the gear 84 is relatively fine-toothed for relatively small incremental ratcheting of the tension in the cable 90, though it will be appreciated that any configuration of the gear 84 and its teeth 86 or other such mechanical means for incrementally rotating the shaft 80 and thus increasing or decreasing the tension in the cable 90 may be employed without departing from the spirit and scope of the invention. At least one pin 78 is formed on the inside of the dial body 76 so as to selectively engage the teeth 86 of the gear 84. Thus, it will be appreciated that when the gear teeth 86 are in contact with the pin 78, the gear 84 and thus the shaft 80 is unable to rotate, thereby "locking" the cable tension as shown in the first operational state of FIG. 6A. While if the shaft 80 is pushed inwardly or in axially toward the drum shell 12, the teeth 86 of the gear 84 would thus be disengaged from the pin 78, thereby allowing the shaft 80 to freely rotate and the tension in the cable 90 to be adjusted as shown in the second operational state of FIG. 6B. Pushing or pulling on or rotating the shaft 80 is facilitated by the dial 72 installed on the free or proximal end of the shaft 80 outside of the dial body 76. In the exemplary embodiment, the dial 72 is formed having an overall size and shape and with grooves, bumps, ribs, knurls or other such surface features to enhance grasping or manipulating the dial 72 in a manner known in the art. It will be appreciated that any appropriate form of the dial 72 accounting for ergonomic, manufacturing and assembly, or other such considerations may be employed in the present invention without departing from its spirit and scope. Furthermore, the dial 72 may be integrally or permanently installed on the shaft 80 or may be temporarily or removably engaged therewith so that the dial 72 can be removed when no tuning is needed to prevent inadvertent adjustment and to again further flush the cable tension dial assembly 70 on the drum shell 12. In a further alternate embodiment, as shown in FIGS. 8 and 9, and additionally in FIGS. 10-15, rather than a dial 72, a traditional drum key K may be employed through engagement with a dial lug 83 formed on the end of the take-up shaft 80 or an associated drive shaft 89, more about which is said below. In this context it will be appreciated that such a drum key K or the dial 72 of the present embodiment effectively serve as an "apparatus controller" enabling adjustment of the drumhead 14 through interaction with the cable tension dial assembly 70. About the shaft 80 between the dial 72 and the dial body 76 there is positioned a compression spring 74 configured to bias the shaft 80 outwardly such that the gear 84 abuts the inside surface of the dial body 76 and the gear teeth 86 are thereby engaged with the pin 78, once again "locking" the dial assembly 70 and so "setting" the cable tension and thus the particular tuning of the drumhead 14 (FIG. 2). Those skilled in the art will appreciate that alternative configurations of the cable tension dial assembly 70 and its components are possible without departing from the spirit and scope of the present invention. For example, it is possible that the gear 84 could be located at the other end of the shaft 80, whether still within the dial body 76 and potentially resulting in the shaft 80 being pulled rather than pushed to disengage the gear teeth 86 from a pin or the like, or even positioning the gear 84 on the far end of the shaft 80 inside the drum shell 12 and otherwise operating much as described above, thereby potentially further flushing the dial assembly 70 with the drum 10 (FIG. 2) or reducing its overall size, particularly on the outside of the drum as a protrusion. Moreover, the pin 78 may be spring-loaded rather than fixed in order to lock the gear 84 from turning. In this way, when turning the dial 72 and thus the shaft 80 to tighten the cable 90 (FIG. 2), it is not necessary to push in or pull out on the dial 72 in order to free the gear 84; instead, simply rotating the dial 72, in the exemplary embodiment clockwise, would tighten the cable "click by click," locking into place at a particular tension with each "click," and then to loosen the cable, one would simply push in on the dial 72 as described above to release. It will be further appreciated that any and all such components of the drumhead tuning rim apparatus 20 may be formed of any suitable material, such as metal or plastic, through any suitable fabrication process, such as molding, casting, machining, stamping, or forming, whether now known or later developed, as will be further appreciated from other disclosures herein related to various exemplary embodiments.

Further non-limiting variations in how the cable tension dial assembly 70 is configured and operates include dual ratcheting wherein the dial gear 84 ratchets in either direction, the use of other locking mechanisms now known or later developed to maintain tension, a quick release button, lever, or function to let out the cable 90 quickly for tuning, instead of or in addition to the exemplary push-pull activation and release of the dial 72, and relatedly, a cable 90 that can be disconnected from the take up spool or shaft 80 or one that is permanently attached to the spool or a function to release and attach at least one end of the cable 90, in any case to selectively allow for quick removal and replacement of the drumhead 14 and rapid tuning. It is also possible in particular contexts that there would be a cable tension dial assembly 70 on more than one side of the drum shell 12 even for the same drumhead 14, whereby the assembly could be more easily accessed from multiple directions depending on such factors as the drum kit configuration and even the user's preference in terms of being right-handed or left-handed. Again, it will be appreciated that numerous other variations of the cable tension dial assembly 70 and the overall drumhead tuning rim apparatus 20 beyond those shown and described are possible without departing from the spirit and scope of the present invention.

As a still further example, though not shown, it will be appreciated that structure and assemblies as herein described as together generally comprising a drumhead tuning rim apparatus according to aspects of the present invention may be arranged and mounted in a variety of other ways, even including the incorporation or installation of much of the hardware on the inside of the drum shell rather than on the outside as shown, specifically including the option of running the cable(s) through the inside of the drum. One method by which this could be accomplished would be through the use of frictionless eye-holes in the drum shell through which the cable runs from the outside of the shell into the inside where the lug bearing wheels or surfaces would be positioned, the cable still in this embodiment passing through the shell so as to operably engage rim bearing wheels or surfaces still located on the outside or perimeter of the rim. The take-up reel or cable tension dial assembly for the cable itself could be located inside the drum as well, with only the dial portion on the outside. And as above-described, the dial itself could be removable or even be replaced with a traditional drum key, such that all that would be visible on the outside of the drum in the way of hardware would be one or more holes or openings in the drum shell corresponding to the end of the assembly tuning shaft for access by the dial or key, and in the exemplary embodiment just a portion of the cables running out of the shell up and around the rim bearing wheels or surfaces. Moreover, it is possible that the rim bearing wheels or surfaces could themselves be positioned inside of the drum shell such that no portion of even any cable is on the outside of the drum, as for example by modifying the rim to extend downwardly and radially inwardly through openings in the shell or to extend upwardly and radially inwardly and forming small holes in the drum head, in either case thereby moving the rim bearing wheels or surfaces interiorly such that any cable is substantially contained within the shell. It will again be appreciated that any such modifications to or variations of such a drumhead tuning rim apparatus according to aspects of the present invention are possible, such that any specific hardware configurations shown and described herein are to be understood as merely illustrative of features and aspects of the invention and non-limiting, as will be further appreciated based on the related exemplary disclosures in commonly-owned U.S. Pat. No. 9,767,773, incorporated herein by reference. In any case, it will be appreciated that to the extent some or all of the hardware components are housed inside the drum, the less the outer appearance of the drum is altered and the less likely any such hardware could be inadvertently damaged during storage, transport, or use. Moreover, by having relatively more of the hardware contained within the inside of the drum, the less likely it would be that any modifications to traditional drum stands and the like would be needed or preferred, particularly for bass drums that are typically placed on their side during use, in which case in embodiments wherein the hardware and cable(s) are on the outside of the drum, a modified stand or other support might be needed, though not necessarily depending on a number of factors.

Figure 4:
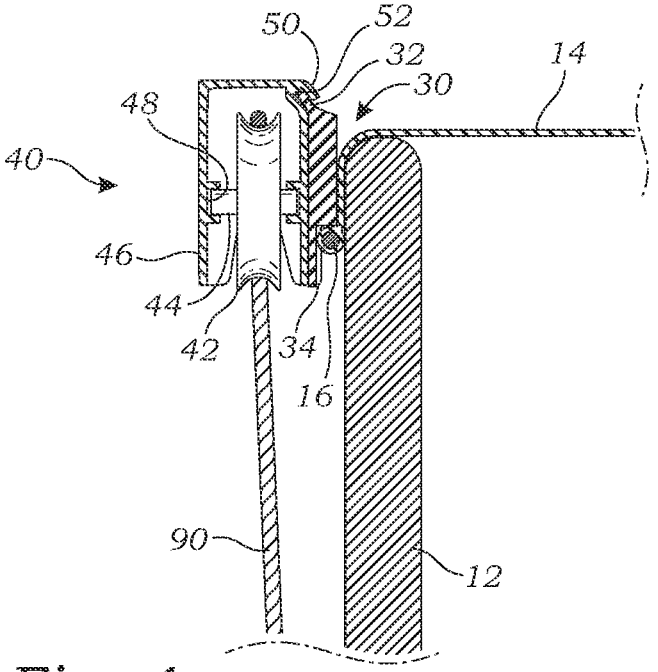
FIG. 4 is an enlarged cross-sectional view taken along line 4-4 of FIG. 3.
Figure 7:
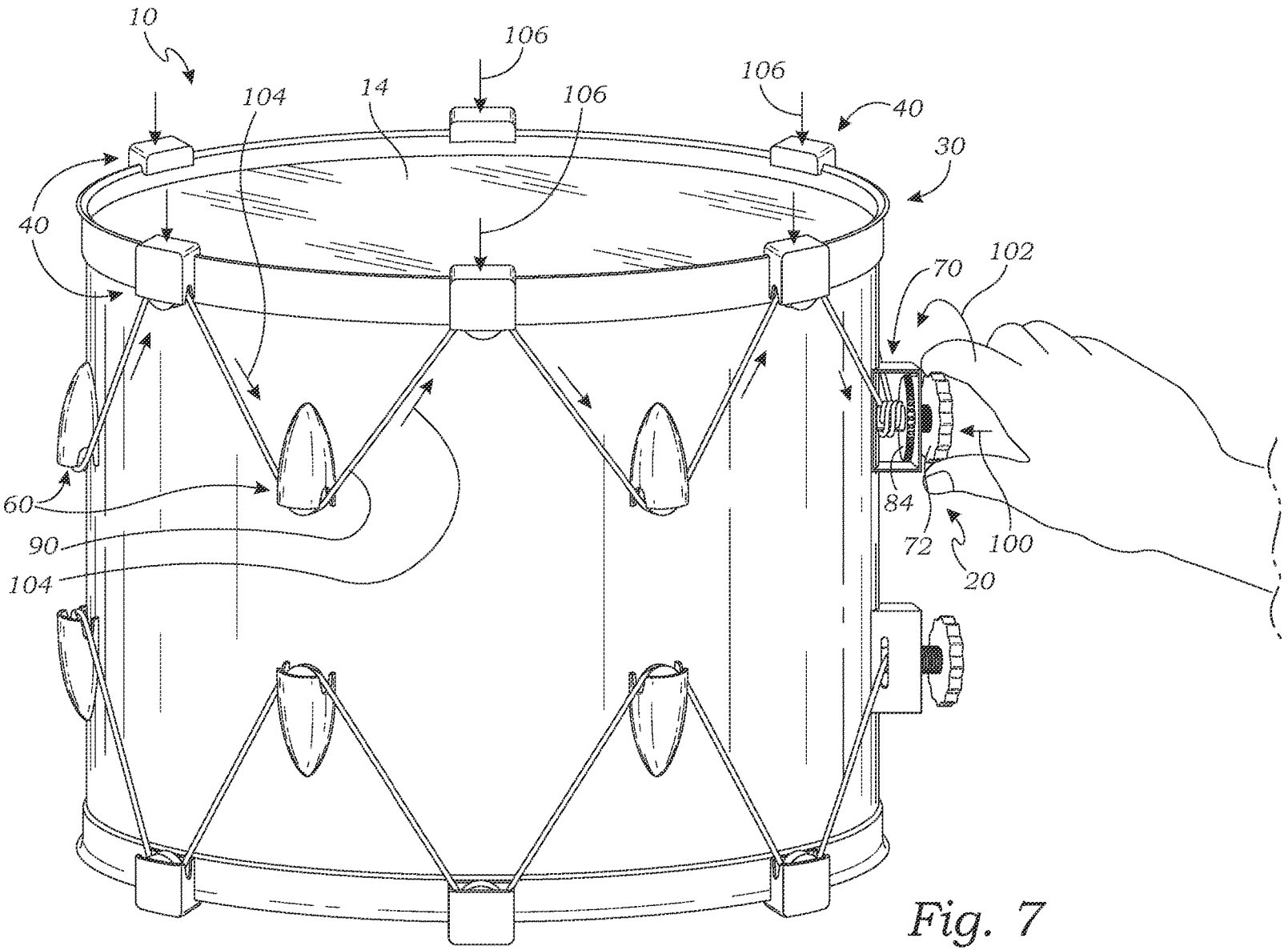
FIG. 7 is a perspective view of the exemplary embodiment of FIG. 2 in use.

Referring now to FIG. 7, in use of the drumhead tuning rim apparatus 20 of the present invention as shown and described in connection with the exemplary embodiment of FIGS. 2-6, installation begins with passing the thin gauge steel or other cable 90 through each of the grooved bearing wheel housing assemblies 40 on the rim 30, leaving the two ends of the cable 90 facing each other between any two of the grooved bearing wheel housing assemblies 40. To mount the drumhead 14, it is simply placed on top of the drum shell 12 in the conventional manner, and then the rim 30 with steel cable 90 in place passing through the grooved bearing wheel housing assemblies 40 is positioned over the drumhead 14 so that the free ends of the cable 90 are substantially adjacent the corresponding cable tension dial assembly 70 and there is substantially equal spacing between the grooved bearing wheel housing assemblies 40 and the grooved bearing wheel lug assemblies 60. It is particularly noted with reference to FIG. 4 that the rim 30 is formed in the conventional manner with a downwardly-opening recess 34 within which is seated the hoop 16 typically formed about the perimeter edge of the drumhead 14 for trapping the drumhead 14's perimeter between the rim 30 and drum shell 12, thus allowing the drumhead 14 to be secured and pulled taught as the rim 30 is tightened down, by individual tension rods F and threaded lugs D in the prior art approach (FIG. 1) or by the operation of the single dial 72 as in the present invention. Once the rim 30 is properly positioned over the drumhead 14 on the drum shell 12, the still loose cable 90 between each grooved bearing wheel housing assembly 40 may be pulled down and looped under the respective grooved bearing wheel lug assembly 60 mounted around the drum shell 12, being careful that the cable 90 is properly seated on each grooved bearing wheel 42, 62 (FIGS. 3-5). In this manner the cable 90 passes alternately from housing 40 to lug 60 to housing 40 around the drum 10. Next, in the case of a first time installation, the free ends of the cable 90 are attached to the shaft 80 of the cable tension dial assembly 70, such as by fitting a metal notch or crimped connector (not shown) on each end of the cable 90 into the fitted or keyed slot or hole 82 in the shaft 80 (FIG. 6). Once the cable 90 is thus secured to the shaft 80 of the cable tension dial assembly 70, simply pressing in on the dial 72 as indicated by arrow 100 disengages the gear 84 as above-described; turning the dial 72 as indicated by arrow 102 then winds the cable 90 about the shaft 80 until the slack is taken out of the cable 90 at all points. Further turning with the dial 72 still pushed in then tightens the cable 90 and thereby increases tension in the cable 90 as indicated by arrows 104, which results in substantially equal downward force at each of the grooved bearing wheel housing assemblies 40 as indicated by arrows 106, and thus across the entire rim 30, resulting in substantially uniform tautness or tuning of the drumhead 14. Once the drum 10 is tuned as desired, pulling out on or simply releasing the dial 72 again locks the gear 84 in place and thereby holds the desired tension on the cable 90. The drum 10 now has the drumhead 14 installed and tuned. It will be appreciated that once any drum 10 is so configured with a drumhead tuning rim apparatus 20 according to aspects of the present invention, replacing a drumhead 14 does not require complete disassembly or removal of the cable 90 from the cable tension dial assembly 70 such that the above steps must be repeated from the beginning. Rather, by simply loosening the cable 90 enough, or putting sufficient slack in the cable 90 as by pushing in the dial 72 and turning it opposite the direction it was tightened so as to "unwind" the cable 90 from the shaft 80, the cable 90 can be removed from underneath the grooved bearing wheel lug assemblies 60, and the rim 30 can simply be lifted off the drum shell 12 and the current drumhead 14 slipped out and a new one slipped in. The rim 30 can then once more be seated on the drumhead 14, again being careful to position the rim 30 such that the housing assemblies 40 are substantially equally spaced from the respective lug assemblies 60, the cable 90 looped beneath the grooved bearing wheel lug assemblies 60, and the dial 72 simply turned to retighten the cable 90 and tune the drum 10 as desired. It will be appreciated by those skilled in the art that similar or related methodologies would be employed according to aspects of the present invention depending on the hardware configuration of the apparatus 20 in use, such that the above-described steps in use are to be understood as merely illustrative and non-limiting.

There are obvious advantages of the drumhead tuning rim apparatus 20 of the present invention over the traditional lug D and tension rod F arrangement. First is the ease with which the drum 10 can be tuned and re-tuned. A person need not be a professional drummer or stage hand to relatively easily and effectively tune the drum 10 to the sound desired. According to aspects of the exemplary embodiment of the invention, simply pressing in the dial 72, turning to tune, and pulling out or releasing the dial 72 to lock it in place is essentially all that is required. One dial and no individual lugs to be tightened means that tuning takes a matter of seconds as opposed to the old method of tuning the drum to itself one tension rod F at a time before raising or lowering the over-all pitch, which itself still required adjusting each of six to twelve tension rods F by the same amount to keep the drum in tune with itself across the head C while adjusting the pitch. Not only is this prior art approach time consuming, but it is very difficult to be precise and it is a daunting task to many drummers. With the present invention, the drum 10 will consistently be substantially in tune with itself, with the pitch of the drum raised or lowered to achieve the desired sound simply with the turn of a single dial 72. Another advantage of the present invention is the relative speed and ease of changing out an old or torn drumhead 14. Rather than removing each individual tension rod F before being able to remove the rim E and thus the drumhead C, with the present invention it is as simple as pressing in on the dial 72 and letting the cable 90 go slack and then slipping the cable 90 from under each bearing lug 60, whereby the rim 30 and drumhead 14 are ready to come off. Installation of the new drumhead 14 is essentially just as easy by following these same steps in reverse. Once more, other such advantages and benefits in use may be realized depending on the context.

Turning now to the alternative embodiment of FIGS. 8 and 9, there is shown a drum 10, here in the form of a snare drum or the like having a relatively shorter drum shell 12, with an alternative drumhead tuning rim apparatus 20 according to aspects of the present invention installed thereon. As can be seen, in this arrangement, single substantially central grooved cable lug assemblies 60 are installed spaced about the drum shell 12, each such assembly 60 having opposed downwardly and upwardly opening grooves or notches in which the respective upper and lower cables 90, 91 run. It will be appreciated that a similar central lug assembly 60 more analogous to the first exemplary embodiment of FIGS. 2-7 could be employed, only here having two bearing wheels rather than cable grooves, whether the wheels are offset as the grooves or "stacked" one over the other so as to share a common shaft or axle, as will be further appreciated with reference to the alternative embodiments of FIGS. 10-15 discussed below. Similarly, there may be low friction sliding surfaces such as pins or molded surfaces within the rim housing assemblies 40 on either or both of the respective upper and lower rims 30, 31 rather than bearing wheels, which are not shown in the alternative embodiment of FIG. 8, though again those skilled in the art will appreciate that grooved bearing wheel housing assemblies 40 as in the embodiment of FIGS. 2-7 may again be employed in the present alternative embodiment. Moreover, it will be appreciated that any combination of such bearing features or surfaces is possible in various contexts, such as bearing wheels employed in the rim housing assemblies 40 and low friction sliding surfaces as shown in FIG. 8 for the lug assemblies 60 or vice versa, or there may even be occasion for mixed uses of such devices within a single apparatus installation, such as using, alternately or otherwise, bearing wheels and bearing surfaces, in either or both the rim housing assemblies 40 and/or the cable lug assemblies 60 or any other substantially functionally equivalent structure now known or later developed. While such an alternative apparatus 20 according to aspects of the present invention is shown and described in connection with a relatively shorter snare drum, it will be appreciated that a similar approach can be employed with drums of virtually any size and shape, including toms as shown in FIGS. 2 and 7, with only the cable 90, 91 potentially changing its angle as it winds its way through the alternating housing and lug assemblies 40, 60, though even the cable angle may be maintained as desired by simply adjusting the spacing between respective housing and lug assemblies 40, 60.

With continued reference to FIG. 8, not only are there shown in the alternative embodiment a single row of shared lug assemblies 60, there is also a single cable tension dial assembly 70 mounted on the drum shell 12 as well, though it will be appreciated that in certain contexts there still could be multiple dial assemblies 70, such as one for each cable, 90, 91 and head 14, even if the cables 90, 91 still share common lug assemblies 60 as shown, or vice versa with a single dial assembly 70 but two rows of lug assemblies 60. In any event, as shown in FIG. 8, a single cable tension dial assembly 70 is mounted on the drum shell 12 so as to have slots 79 formed in the housing body 76 through which cables 90, 91 corresponding to the upper and lower drumheads 14 both run. Internally within the dial assembly 70 a shaft and gear arrangement as above-described in connection with FIGS. 2-7 or any other such mechanical arrangement, now known or later developed, consistent with aspects of the present invention may be operably configured, with the cables 90, 91 both wrapping the dial shaft in the same direction so that turning one direction (e.g., clockwise) simultaneously tightens both heads and turning the other direction (e.g., counterclockwise) simultaneously loosens both. Alternatively, the dial assembly 70 may be mechanically arranged such that gearing is selectively engaged based on the use of a switch so that the manipulable dial or key is able to control either the top head or the bottom head independently, in which case it would be necessary that each cable be on a separate shaft or spool, which shaft is again independently and selectively controlled based on the gearing as controlled by the switch. Another possibility would be a middle option that raises and lowers the tension on the opposing heads simultaneously in order to maintain equal variation between head tension while raising and lowering the overall pitch of the drum.

Fundamentally, those skilled in the art will appreciate that a variety of mechanical arrangements beyond those disclosed may be employed according to aspects of the present invention without departing from its spirit and scope. Referring still to FIG. 8 and with further reference to FIG. 9, there is shown a drum key K selectively engageable and operable with the cable tension dial assembly 70, rather than a permanent or removable dial 72 as in the embodiment of FIGS. 2-7. Particularly, in this alternative embodiment, a traditional drum key K engages a square dial lug 83 formed on the distal or free end of the dial shaft 80 that is accessible through the opening 81 formed in the dial body 76. The key and lug engagement may be as with standard drum kits, enabling use of a typical drum key K to tune even a drum configured with a new and novel drum tuning rim apparatus 20 according to aspects of the present invention, here still from a single central dial assembly 70, whether for both heads simultaneously or each independently, rather than multiple lugs being individually adjusted to tune a single head as in prior art arrangements. It will be appreciated that other geometrical engagements beyond the exemplary square geometry are possible. As best seen in the enlarged side view inset of FIG. 9 looking into the cable tension dial assembly 70, through the opening 81 there is seen and accessed the internal dial shaft 80 having the outwardly protruding square dial lug 83 with a portion of the gear 84 visible as well, with the square lug 83 again being engageable by the key K, it having an appropriately sized and configured female receptacle feature to engage the square lug 83 in a manner known in the art. Once more, those skilled in the art will appreciate that a variety of other geometrical and mechanical arrangements of the cable tension dial assembly 70 and the overall drumhead tuning rim apparatus 10 are possible without departing from the spirit and scope of the invention.

Figure 10:
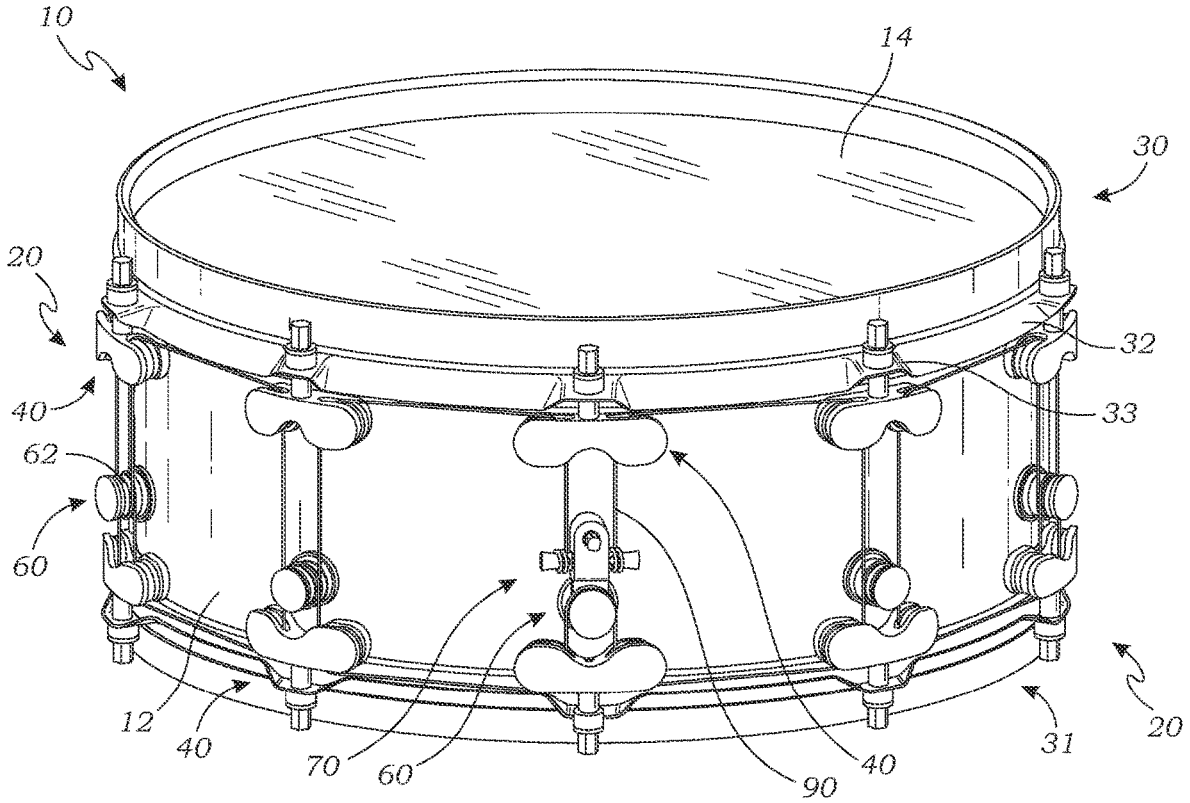
FIG. 10 is a perspective view of a further alternative exemplary embodiment of the invention.
Figure 11:
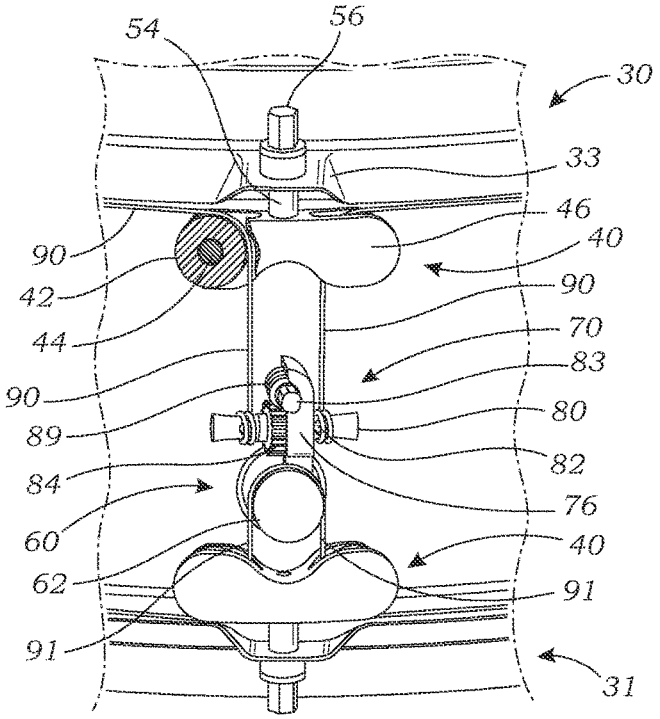
FIG. 11 is an enlarged partial perspective view thereof, partially cut-away.
Figure 12:
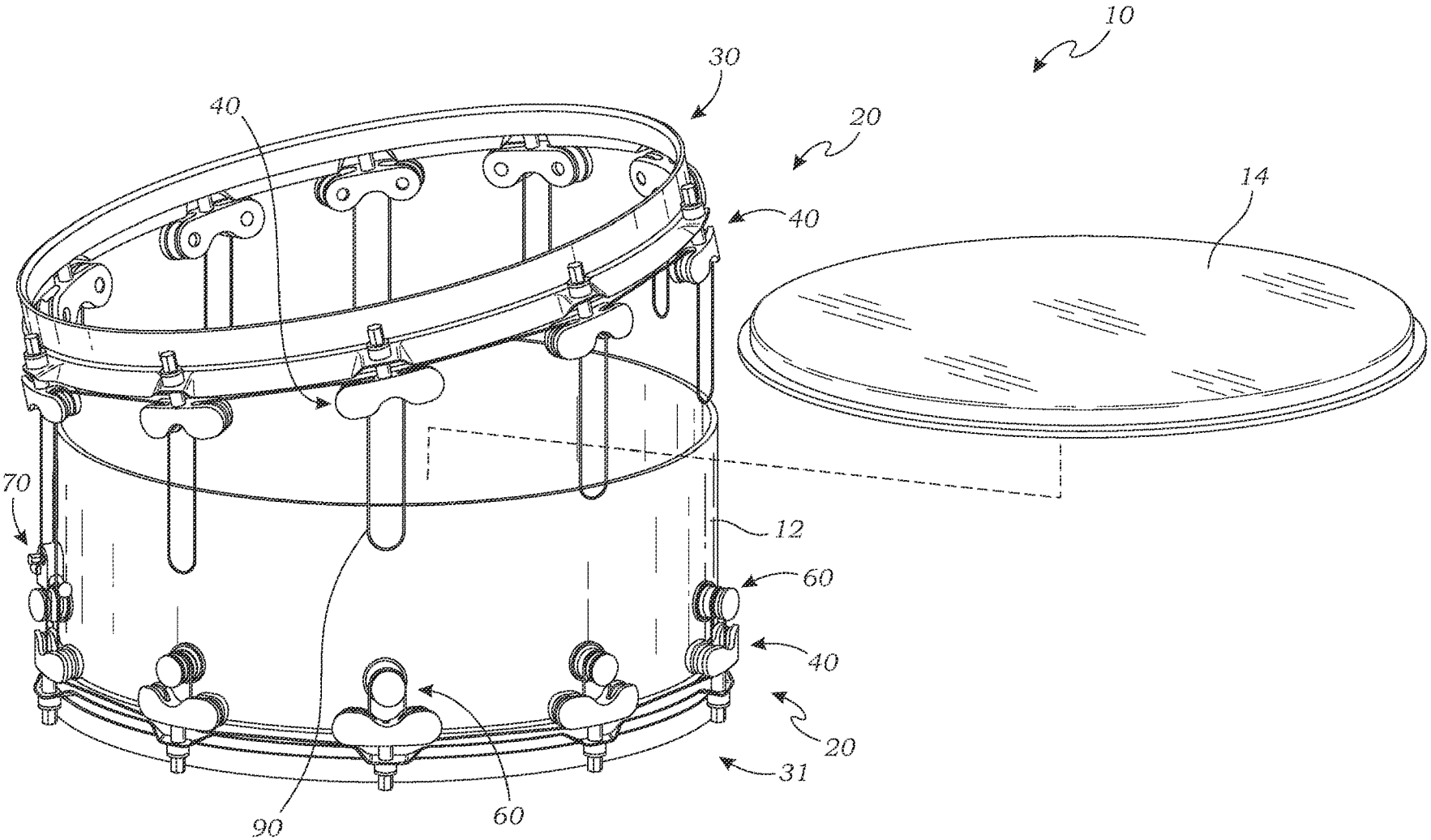
FIG. 12 is a reduced-scale exploded perspective view thereof.

Turning next to FIGS. 10-12, there are shown various perspective views of a further alternative exemplary embodiment of a drumhead tuning rim apparatus 20 according to aspects of the present invention as installed on or in connection with a drum 10 so as to selectively enable replacement and/or tuning of a drumhead 14. Such apparatus 20 again generally comprises a rim 30 configured with spaced-apart low friction housing assemblies 40 about its perimeter and corresponding, spaced-apart low friction lug assemblies 60 installed about the perimeter of the drum shell 12, with a single cable 90 running alternately between the housing assemblies 40 and lug assemblies 60 and terminating at its opposite ends in a cable tension dial assembly 70 so as to allow, based on the operative cooperation of such components of the apparatus 20, securing and tuning of the drumhead 14 on the drum shell 12 as described herein. Once more, while there is shown a drum 10 in the form of a snare drum or the like having a relatively shorter drum shell 12, it will be appreciated that any drum configurations now known or later developed may be employed. As a further threshold matter, it will be appreciated that while each low friction housing assembly 40 is shown as being installed in or engaged with the traditional tension rod holes (not shown) formed in the outwardly extending tabs 33 of the rim 30, such rim 30 thus being substantially formed as the typical hoop rim E shown in FIG. 1, for example, such housing assemblies 40 may also be integrally formed with or incorporated in the rim 30 as by machining, forming, casting, etc. or otherwise permanently mounted thereon as by welding, bonding, etc. as herein described in connection with other embodiments. Once more, according to aspects of the present invention, any such hardware as the low friction housing assemblies 40, the low friction lug assemblies 60, and the cable tension dial assembly 70 may be formed so as to be removably engageable with the drum 10 or any components thereof such as the shell 12 or rim 30 so as to be replaceable or provided for aftermarket installation or may be permanently or integrally formed with or mounted on such drum 10 or drum components, in which case the rim 30, for example, may be a purpose-built component incorporating features or aspects of the present invention.

Referring to the assembled perspective view of FIG. 10 and the enlarged partial perspective view of FIG. 11, it can first be seen that in the alternative exemplary embodiment, the illustrated low friction housing assembly 40 is again configured to be mounted on a tab 33 of the rim 30 as by installing a housing bolt 54 through the hole (not shown) in the rim tab 33 and securing it with a housing bolt lug 56, thereby suspending the housing body 46 beneath the rim flange 32. Each low friction housing assembly 40 is here configured with a pair of opposite grooved bearing wheels 42 rotatably mounted on axles 44 installed within the housing body 46, though it will be appreciated that for simplicity in FIG. 11 only one such wheel 42 is visible as by a cut-away section. Once more, those skilled in the art will appreciate that there may be low friction sliding surfaces such as pins or molded surfaces within the rim housing assemblies 40 rather than bearing wheels 42, though again those skilled in the art will appreciate that grooved bearing wheel housing assemblies 40 as in the embodiments of FIGS. 2-9 or other such low friction surfaces may again be employed in the present alternative embodiment. By way of illustration and not limitation, a single rather than double rim bearing surface may be provided with the legs of the cable 90 from the adjacent tensioner 70 crossing in offset channels or grooves so as to then pass around the perimeter of the rim 30 in both directions, and so on at each lug-tensioner point. Alternatively, an arrangement similar to that shown in FIGS. 10-12 may be provided, only with two adjacent but independent bearing assemblies 40 at each respective lug point. Again, a variety of combinations of such components in forming an exemplary drumhead tuning rim apparatus 20 according to aspects of the present invention is possible without departing from its spirit and scope. Where a two-wheeled or two-low-friction-surface 42 arrangement is employed in each housing assembly 40 installed about the rim 30, it will be appreciated that such may be of any size, shape or mechanical configuration now known or later developed suitable to the passage thereover or therethrough of one or more tensioning cables 90, 91.

With continued reference particularly to the enlarged partial perspective view of the exemplary apparatus 20 as shown in FIG. 11, it will be appreciated that here the cable tension dial assembly 70 is shown as effectively being incorporated in or installed cooperatively with a low friction lug assembly 60, together installed on the shell 12 of the drum 10, again whether in holes already formed in the drum shell 12, or as in the prior art drum shell B in the locations where the lugs D were originally installed (FIG. 1), or in newly formed holes, or via some other mounting means now known or later developed. It will be appreciated that regardless of the size or style of drum, from the illustrated snare-style drum to relatively larger toms such as illustrated in the exemplary embodiment of FIGS. 2-7 to any other drum now known or later developed, such cable tension dial assembly 70 as illustrated in FIGS. 10-12 may be installed independent of any lug assembly 60, for example, directly to the shell 12. Each such low friction lug assembly 60 generally comprises a grooved low friction lug bearing wheel or surface 62 about which each cable 90, 91 runs. More particularly, here, multiple channels or grooves are formed in the lug surface 62, one to accommodate the upper cable 90 and one to accommodate the lower cable 91, more about which is said below. Any such lug assembly 60 and related lug surfaces 62, whether rotatable as a wheel or bearing or configured as some other low friction surface for passage thereover or thereabout of the cable 90, 91, may be mounted on the drum shell 12 at any appropriate location and by any appropriate means now known or later developed. It will be appreciated that a similar central lug assembly 60 more analogous to the first exemplary embodiment of FIGS. 2-7 could be employed, only here having two bearing wheels rather than cable grooves, whether the wheels are offset as the grooves or "stacked" one over the other so as to share a common shaft or axle, or instead more analogous to the grooved cable lug assemblies 60 having opposed downwardly and upwardly opening grooves or notches in which the respective upper and lower cables 90, 91 run, as shown in the alternative exemplary embodiment of FIGS. 8 and 9. Moreover, it will be appreciated that any combination of such bearing features or surfaces is possible in various contexts, such as bearing wheels employed in the rim housing assemblies 40 and low friction sliding surfaces as shown in FIG. 8 and here in FIGS. 10-12 for the lug assemblies 60 or vice versa, or there may even be occasion for mixed uses of such devices within a single apparatus installation, such as using, alternately or otherwise, bearing wheels and bearing surfaces, in either or both the rim housing assemblies 40 and/or the cable lug assemblies 60 or any other substantially functionally equivalent structure now known or later developed. And again, while such an alternative apparatus 20 according to aspects of the present invention is shown and described in connection with a relatively shorter snare drum 10 or the like, it will be appreciated that a similar approach can be employed with drums of virtually any size and shape, including toms as shown in FIGS. 2 and 7, with only the cables 90, 91 potentially changing angle depending on the spacing between respective housing and lug assemblies 40, 60. Relatedly, while in this alternative exemplary embodiment the housing assemblies 40 and respective lug assemblies 60 are shown as being substantially aligned or offset vertically, such need not be the case, but instead the housing and lug assemblies 40, 60 may be staggered or otherwise offset horizontally, in whole or in part, as in other exemplary embodiments shown and described herein. There of course may be greater or fewer of any such components or assemblies, and any such resulting drumhead tuning rim apparatus 20 may be arranged or configured in a variety of other ways without departing from the spirit and scope of the invention. In any such arrangement, it will be appreciated that each lug assembly 60 would still be installed spaced about the drum shell 12 substantially between respective housing assemblies 40 so as to allow for the respective cable 90, 91 to loop intermittently therebetween.

As further best seen in the enlarged perspective view of FIG. 11, the cable tension dial assembly 70 incorporated at a particular lug position or installed in conjunction with a particular lug assembly 60 may generally comprise in the exemplary embodiment a dial body 76 mounted on or integral with the lug assembly 60, the body 76 housing in operable relationship a take-up shaft 80 and a drive shaft 89 engaged via gearing. Generally, then, in the alternative embodiment, the cable tension dial assembly 70 comprises a substantially horizontal drive shaft 89 oriented so as to extend substantially radially outwardly relative to the drum shell 12 and configured as a worm gear or the like for engagement with a gear 84 formed on the take-up shaft 80, which is also oriented substantially horizontally but substantially perpendicular to the drive shaft 89. It is the drive shaft 89 with which the key K (FIG. 8), dial, or other such device interacts to selectively control the dial assembly 70 and thus the tension on the cable 90. Accordingly, in the exemplary embodiment, the drive shaft 89 is shown as having a dial lug 83 formed on the free end thereof, or the end extending out of the dial body 76. Opposite ends of the drive shaft 89 and the take-up shaft 80 may be rotationally supported by the dial body 76 or may be completely supported internally. Regardless, as also shown, the free ends of the take-up shaft 80 may extend beyond the dial body 76 as well, on opposite sides thereof, with holes 82 formed in such opposite free ends configured for receipt therein of the free ends of the tensioning cable 90 as it starts and ends at the cable tension dial assembly 70. In this way, it will generally be appreciated by those skilled in the art that with the ends of the cable 90 attached or secured to the shaft 80 in any appropriate manner now known or later developed and the rest of the cable 90 passing alternately through the housing and lug assemblies 40, 60 of the drumhead tuning rim apparatus 20, as above-described in connection with FIGS. 2-9, rotation of the shaft 80 will effectively increase or decrease the tension in the cable 90 and thus raise or lower the overall pitch of the drumhead 14 as explained herein. Specifically, in the exemplary embodiment of FIGS. 10-12, and with reference to the upper drumhead 14 and related upper rim 30 and assembly 20, it will be appreciated that one end of the cable 90 is wrapped on one free end of the take-up shaft 80, for example, here, the left end as the tensioner 70 is viewed in FIGS. 10 and 11, the cable 90 then passes up and through the adjacent housing assembly 40, and particularly around the bearing wheel or surface 42 on the left, runs substantially along the underside of the rim flange 32 to the next housing assembly 40 to the left, thus passing around the bearing wheel or surface 42 on the right and then down to the next lug assembly 60 and around and back up and around the bearing wheel or surface 42 on the left side of the same housing assembly 40, and so on until the cable comes "full circle" back to the housing assembly 40 adjacent to the lug with cable tension dial assembly 70, around the bearing wheel or surface 42 on the right of such housing 40, at which point the opposite free end of the cable 90 then passes out of the housing 40 and back down to the tensioner 70 so as to be wrapped on the other free end of the take-up shaft 80, here the right end as the tensioner 70 is viewed. Accordingly, in this further exemplary arrangement, the tension cable 90 again passes intermittently around the perimeter of the drum 10 as by here going to and from or in and out of a rim housing assembly 40 for each corresponding lug assembly 60. Those skilled in the art will appreciate that such arrangement, like the other embodiments shown and described herein, results in substantially equivalent vertical forces on each point around the rim 30 so as to substantially uniformly tighten and tune the corresponding drumhead 14. Once more, it will be appreciated that a variety of other such arrangements are possible according to aspects of the present invention without departing from its spirit and scope, such that the present embodiment is to be understood as illustrative and non-limiting. Particularly, other configurations and installations of the cable tension dial assembly 70 are possible. Relatedly, it will be appreciated once more by those skilled in the art that virtually any assembly technique for securing the one or more cable tension dial assemblies 70 on the drum shell 12, whether permanent or selectively removable or now known or later developed, and whether directly or as installed or mounted in conjunction with a lug assembly 60, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the take-up shaft 80 with gear 84 and the worm gear-style drive shaft 89, while in the exemplary embodiment such dial body 76 is configured to be relatively low profile and essentially just large enough to house an operably sized drive shaft 89 and take-up shaft 80 and gear 84. It will be further appreciated, though not shown, that a similar cable tension dial assembly 70, or any other such tensioner according to aspects of the present invention, may further be positioned on the drum 10 so as to operably control tension in the lower cable 91.

Briefly referring to FIG. 12, for simplicity the drum 10 is shown from a vantage point rotated approximately ninety degrees from that of FIGS. 10 and 11, putting the tensioner 70 for the upper rim 30 substantially at the left side of the drum shell 12 as viewed versus centrally as in the previous figures. It will be appreciated that by employing a drumhead tuning rim apparatus 20 according to aspects of the present invention as shown, the cable tension dial assembly 70 associated with, for example, the upper rim 30 may be operated so as to loosen the cable 90 sufficiently such that the looped regions hanging down from each housing assembly 40 may be disengaged from the respective lug assembly 60 around the shell 12. Accordingly, even with the free ends of the cable 90 still engaged with the tensioner 70 as above-described, the rim 30 may be tilted upwardly and somewhat out of the way as illustrated, whereby the drumhead 14 may be inserted or removed from between the rim 30 and the shell 12, thus facilitating simplified drumhead 14 replacement and tuning. Again, the same procedure may be repeated for the lower rim 31 and associated drumhead as needed.

Figure 13:
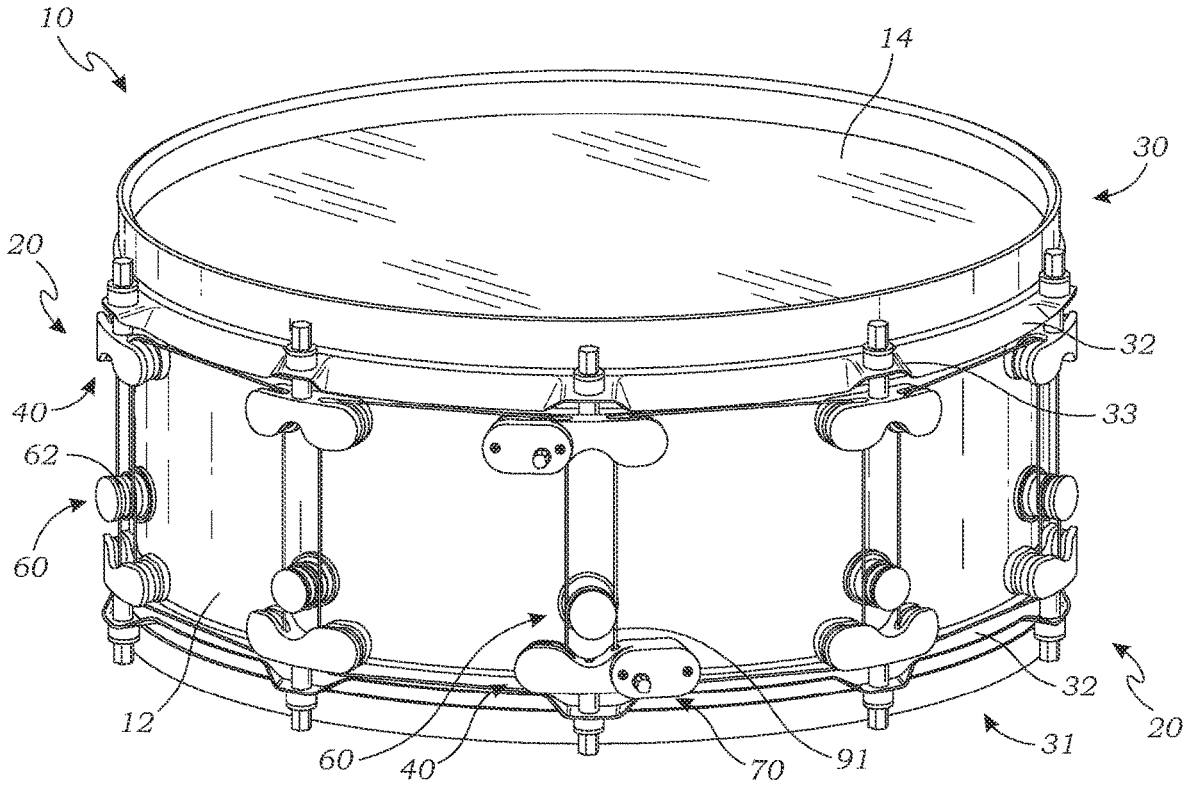
FIG. 13 is a perspective view of a still further alternative exemplary embodiment of the invention.
Figure 14:
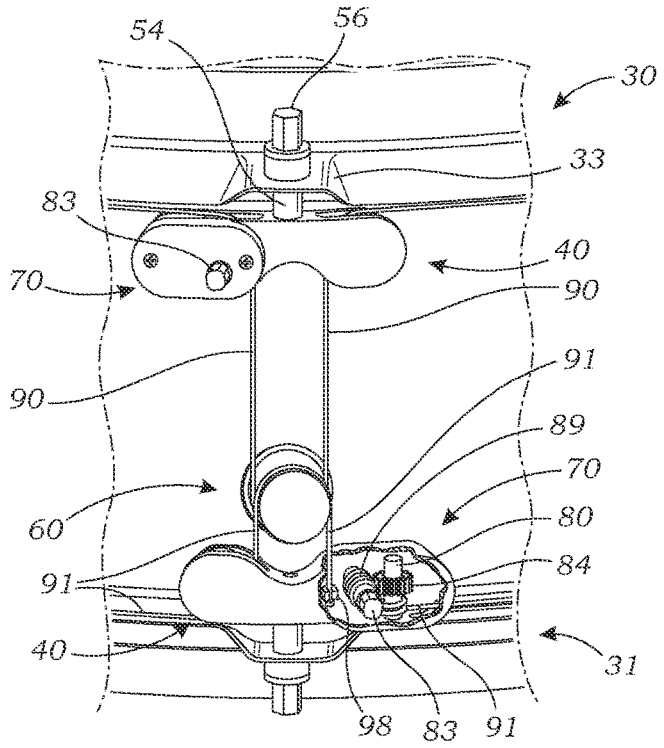
FIG. 14 is an enlarged partial perspective view thereof, partially cut-away.
Figure 15:
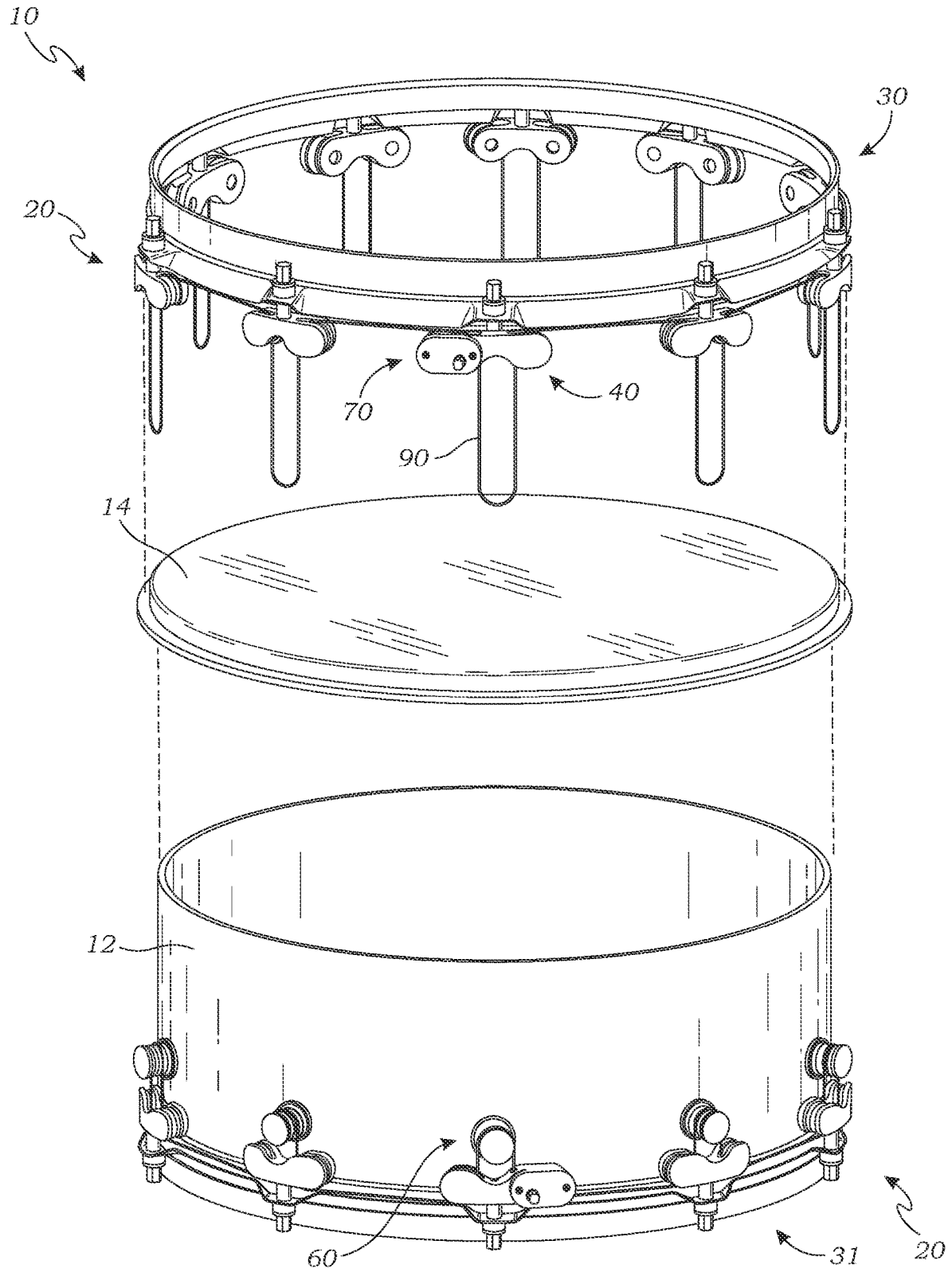
FIG. 15 is a reduced-scale exploded perspective view thereof.

Turning to FIGS. 13-15, there are shown perspective views of a still further alternative exemplary embodiment of a drumhead tuning rim apparatus 20 according to aspects of the present invention as installed on or in connection with a drum 10 so as to selectively enable replacement and/or tuning of a drumhead 14. Such apparatus 20 again generally comprises a rim 30 configured with spaced-apart low friction housing assemblies 40 about its perimeter and corresponding, spaced-apart low friction lug assemblies 60 installed about the perimeter of the drum shell 12, with a single cable 90 running alternately between the housing assemblies 40 and lug assemblies 60 and terminating at its opposite ends in a cable tension dial assembly 70 so as to allow, based on the operative cooperation of such components of the apparatus 20, securing and tuning of the drumhead 14 on the drum shell 12 as described herein. Notably, here, the tensioner 70 is installed on or incorporated within a housing assembly 40 rather than a lug assembly 60 as in FIGS. 10-12. As with the prior exemplary embodiment of FIGS. 10-12, the invention is not so limited to the relatively short drum shell 12, and while each low friction housing assembly 40 is again shown as being installed in or engaged with the traditional tension rod holes (not shown) formed in the outwardly extending tabs 33 of the rim 30, such housing assemblies 40 may also be integrally formed with or incorporated in the rim 30 as herein described, with any such hardware as the low friction housing assemblies 40, the low friction lug assemblies 60, and the cable tension dial assembly 70 again being formed so as to be removably engageable with the drum 10 or any components thereof such as the shell 12 or rim 30 so as to be replaceable or provided for aftermarket installation or may be permanently or integrally formed with or mounted on such drum 10 or drum components, in which case the rim 30, for example, may be a purpose-built component incorporating features or aspects of the present invention.

Referring to the assembled perspective view of FIG. 13 and the enlarged partial perspective view of FIG. 14, it can first be seen that in the further alternative exemplary embodiment, the illustrated low friction housing assembly 40 is again configured to be mounted on a tab 33 of the rim 30 as by installing a housing bolt 54 through the hole (not shown) in the rim tab 33 and securing it with a housing bolt lug 56, thereby suspending the housing body 46 beneath the rim flange 32. Each low friction housing assembly 40 is here configured with a pair of opposite grooved bearing wheels 42 as in the exemplary embodiment of FIGS. 10-12, though those skilled in the art will appreciate that any such low friction surfaces now known or later developed may be substituted, both for the rim housing assemblies 40 and the lug assemblies 60. Again, a variety of combinations of such components in forming an exemplary drumhead tuning rim apparatus 20 according to aspects of the present invention is possible without departing from its spirit and scope. With continued reference particularly to the enlarged partial perspective view of the exemplary apparatus 20 as shown in FIG. 14, it will again be appreciated that here the cable tension dial assembly 70 is shown as effectively being incorporated in or installed cooperatively with a low friction housing assembly 40, together installed on the rim 30, 31 of the drum 10, more about which is said below. As in the previous embodiment of FIGS. 10-12, each low friction lug assembly 60 generally comprises a grooved low friction lug bearing wheel or surface 62 about which each cable 90, 91 runs, with a channel or groove formed in the lug surface 62 for each of the upper and lower cables 90, 91. Again, any such lug assembly 60 and related lug surfaces 62, whether rotatable as a wheel or bearing or configured as some other low friction surface for passage thereover or thereabout of the cable 90, 91, may be mounted on the drum shell 12 at any appropriate location and by any appropriate means now known or later developed according to aspects of the present invention. Moreover, it will be appreciated that any combination of such bearing features or surfaces is possible in various contexts, including but not limited to those illustrated herein. Again, while in this alternative exemplary embodiment the housing assemblies 40 and respective lug assemblies 60 are shown as being substantially aligned or offset vertically, such need not be the case, but instead the housing and lug assemblies 40, 60 may be staggered or otherwise offset horizontally, in whole or in part, as in other exemplary embodiments shown and described herein. There of course may be greater or fewer of any such components or assemblies, and any such resulting drumhead tuning rim apparatus 20 may be arranged or configured in a variety of other ways without departing from the spirit and scope of the invention. In any such arrangement, it will be appreciated that each lug assembly 60 would still be installed spaced about the drum shell 12 substantially between respective housing assemblies 40 so as to allow for the respective cable 90, 91 to loop intermittently therebetween.

As further best seen in the enlarged perspective view of FIG. 14, the cable tension dial assembly 70 incorporated at a particular rim tension rod or bearing position or installed in conjunction with a particular housing assembly 40 may generally again comprise in the exemplary embodiment a dial body 76 mounted on or integral with the housing assembly 40, the body 76 housing in operable relationship a take-up shaft 80 and a drive shaft 89 engaged via gearing, here the tensioner 70 shown partially cut-away being the one associated with the lower rim 31 and cable 91. Generally, in this further alternative embodiment, the cable tension dial assembly 70 comprises a substantially horizontal drive shaft 89 oriented so as to extend substantially radially outwardly relative to the drum shell 12 and configured as a worm gear or the like for engagement with a gear 84 formed on the take-up shaft 80, which is here oriented substantially vertically and perpendicular to the drive shaft 89. It is the drive shaft 89 with which the key K (FIG. 8), dial, or other such device interacts to selectively control the dial assembly 70 and thus the tension on the cable 91. Accordingly, in the exemplary embodiment, the drive shaft 89 is shown as having a dial lug 83 formed on the free end thereof, or the end extending out of the dial body 76. Opposite ends of the drive shaft 89 and the take-up shaft 80 may be rotationally supported by the dial body 76 or may be completely supported internally. Here, as shown in cut-away in FIG. 14, one end of the lower tension cable 91 is received or wound about one end of the take-up shaft 80 while the opposite end of the cable 91 after passing around the drum 10 is anchored within a fastener 98 shown as formed within the dial body 76 adjacent to the shafts 80, 89. In this way, it will generally be appreciated by those skilled in the art that with one end of the cable 91 attached or secured to the shaft 80 in any appropriate manner now known or later developed and the rest of the cable 90 passing alternately through the housing and lug assemblies 40, 60 of the drumhead tuning rim apparatus 20, as above-described in connection with FIGS. 2-12, rotation of the shaft 80 will effectively increase or decrease the tension in the cable 91 and thus raise or lower the overall pitch of the drumhead 14 as explained herein. Specifically, in the exemplary embodiment of FIGS. 13-15, and with reference again to the lower rim 31 and associated assembly 20, it will be appreciated that one end of the cable 91 is wrapped on one free end of the take-up shaft 80, for example, here, the lower end as the tensioner 70 is viewed in FIGS. 13 and 14, the cable 91 then passes out and to the right substantially along the lower rim flange 32 to the next housing assembly 40 and then up to the next lug assembly 60 and around and back down and around the second bearing wheel or surface of the same housing assembly 40, and so on until the cable comes "full circle" back to the housing assembly 40 with the cable tension dial assembly 70, where again the opposite free end of the cable 91 is anchored or secured within the fastener 98. It will be appreciated that any means now known or later developed for temporarily or permanently securing such tension cable 90, 91 within a respective tensioner 70 is possible according to aspects of the present invention. Accordingly, in this further exemplary arrangement, the tension cables 90, 91 again pass intermittently around the perimeter of the drum 10 as by here going to and from or in and out of a rim housing assembly 40 for each corresponding lug assembly 60. Those skilled in the art will appreciate that such arrangement, like the other embodiments shown and described herein, again results in substantially equivalent vertical forces on each point around the rim 30, 31 so as to substantially uniformly tighten and tune the corresponding drumhead 14. Once more, it will be appreciated that a variety of other such arrangements are possible according to aspects of the present invention without departing from its spirit and scope, such that the present embodiment is to be understood as illustrative and non-limiting. Particularly, other configurations and installations of the cable tension dial assembly 70 are possible. Relatedly, it will be appreciated once more by those skilled in the art that virtually any assembly technique for securing the one or more cable tension dial assemblies 70 on the rim 30, whether permanent or selectively removable or now known or later developed, and whether directly or as installed or mounted in conjunction with a housing assembly 40, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the take-up shaft 80 with gear 84 and the worm gear-style drive shaft 89, while in the exemplary embodiment such dial body 76 is configured to be relatively low profile and essentially just large enough to house an operably sized drive shaft 89 and take-up shaft 80 and gear 84 as well as the tension cable anchor point or fastener 98. It will be further appreciated, as shown, that a similar cable tension dial assembly 70, or any other such tensioner according to aspects of the present invention, is positioned on the drum 10 so as to operably control tension in the upper cable 90. In fact, here, by way of illustration and not limitation, the respective upper and lower tensioners 70 are installed at substantially the same location about the perimeter of the drum 10, or in association with the same lug point or lug assembly 60, though again those skilled in the art will appreciate that such is not required, with such orientation being a matter of preference or convenience.

Briefly referring to FIG. 15, it will be appreciated that by employing a drumhead tuning rim apparatus 20 according to aspects of the present invention as shown, the cable tension dial assembly 70 associated with, for example, the upper rim 30 may be operated so as to loosen the cable 90 sufficiently such that the looped regions hanging down from each housing assembly 40 may be disengaged from the respective lug assembly 60 around the shell 12. Here, it will be appreciated that with the cable tension dial assembly 70 associated with and installed on a rim housing assembly 40 and thus the rim 30, even the cable loop corresponding to the housing assembly 40 having the tensioner 70 may be disengaged from the adjacent lug assembly 60 so that, as shown, the rim 30 may be lifted upwardly and "straight off" and completely away from the shell 12 and drumhead 14, whereby the drumhead 14 may be inserted or removed from between the rim 30 and the shell 12, thus again facilitating simplified drumhead 14 replacement and tuning. Once more, the same procedure may be repeated for the lower rim 31 and associated drumhead as needed.

Turning next to FIGS. 16-21, there are shown perspective views of a still further alternative exemplary embodiment of a drumhead tuning rim apparatus 20 according to aspects of the present invention as installed on or in connection with a drum 10 so as to selectively enable replacement and/or tuning of a drumhead 14. Such apparatus 20 again generally comprises a rim 30 configured with, or more precisely here operably engageable with, spaced-apart low friction housing assemblies 140 about its perimeter and corresponding, spaced-apart low friction lug assemblies 160 installed about the perimeter of the drum shell 12, with a single cable 90 running alternately between the housing assemblies 140 and lug assemblies 160 and terminating at its opposite ends in a cable tension dial assembly 170 so as to allow, based on the operative cooperation of such components of the apparatus 20, securing and tuning of the drumhead 14 on the drum shell 12 generally as described herein. As a threshold matter, the illustrated low friction housing assemblies and lug assemblies 140, 160 and the cable tension dial assembly 170 are to be understood as analogous or the same, equivalent, or similar features, elements, or aspects, in accordance with one or more embodiments, as those comparable low friction housing assemblies and lug assemblies 40, 60 and cable tension dial assembly 70 of FIGS. 2-15, such numbering changed here in connection with FIGS. 16-21 simply as a matter of convenience relative to additional elements to be introduced and numbered logically in an appropriate element number range in connection with such alternative embodiment, whereby any such low friction housing assemblies and lug assemblies and cable tension dial assembly disclosed and claimed herein are to be so understood whether or not numbered identically across the various embodiments. Here, the tensioner 170 is installed on the drum shell 12 more analogous to the embodiments of FIGS. 2-9 versus being incorporated into a housing or lug assembly 40, 60 as in the embodiments of FIGS. 10-15. As with the prior exemplary embodiments of FIGS. 8-15, the invention is not limited to the relatively short snare-type drum shell 12, with any such hardware as the low friction housing assemblies 140, the low friction lug assemblies 160, and the cable tension dial assembly 170 again being formed so as to be removably engageable with the drum 10 or any components thereof such as the shell 12 or rim 30 so as to be replaceable or provided for aftermarket installation or may be permanently or integrally formed with or mounted on such drum 10 or drum components, in which case the rim 30, as here in the alternative exemplary embodiment, may be a purpose-built component incorporating features or aspects of the present invention.

Referring to the assembled and partially-exploded perspective views of FIGS. 16 and 17, respectively, it can first be seen that in the further alternative exemplary embodiment, the illustrated low friction housing assemblies 140 are here configured to be effectively mounted on the respective lug assemblies 160 rather than on the rim 30 directly, more about which is said below in connection with FIGS. 18 and 19, the rim 30 thereby being selectively removable in a "quick-change" fashion as by only loosening but not at all disengaging the cable 90 via the dial assembly 170 and then rotating the rim 30 relative to the shell 12 to selectively disengage the rim 30 from the housing assemblies 140 and thus allow for removal or replacement of the drumhead 14, as explained further below. Again here, each low friction housing assembly 140 is configured with a pair of opposite, circumferentially-spaced-apart grooved bearing wheels 142 as generally in the exemplary embodiments of FIGS. 10-15, though those skilled in the art will once again appreciate that any such low friction surfaces or arrangement now known or later developed may be substituted, both for the rim housing assemblies 140 and the lug assemblies 160, with a variety of combinations of such components in forming an exemplary drumhead tuning rim apparatus 20 according to aspects of the present invention being possible without departing from its spirit and scope. And as in the previous exemplary embodiments of FIGS. 10-15, each low friction lug assembly 160 generally comprises a grooved low friction lug bearing wheel or surface 162 about which each cable 90, 91 runs, with a channel or groove formed in the lug surface 162 for each of the upper and lower cables 90, 91 to run in, though rather than the respective lug bearing wheels or surfaces 162 being "stacked" or effectively sharing a common shaft or axis as in the exemplary embodiments of FIGS. 10-15, they are shown as spaced apart vertically, one bearing wheel or surface 162 for the upper cable 90 and thus the upper rim 30 and one for the lower cable 91 and thus the lower rim 31 more analogous to the embodiments of FIGS. 2-9, and more specifically that of FIG. 8 relative to a common lug assembly 60 having two such low friction lug bearing wheels or surfaces 62 incorporated therein for the upper and lower apparatuses 20 associated with the respective upper and lower rims 30, 31, though it will again be appreciated that with relatively taller drum formats or otherwise such upper and lower bearing wheels or surfaces 162 and thus the low friction lug assemblies 160 themselves may be separately formed and mounted on the shell 12 without departing from the spirit and scope of the invention, such that the exemplary single low friction lug assembly 160 servicing the upper and lower apparatuses 20 is to be understood as illustrative and non-limiting. Again, any such lug assembly 160 and related lug surfaces 162, whether rotatable as a wheel or bearing or configured as some other low friction surface for passage thereover or thereabout of the cable 90, 91, may be mounted on the drum shell 12 at any appropriate location and by any appropriate means now known or later developed according to aspects of the present invention. Moreover, it will be appreciated that any combination of such bearing features or surfaces is possible in various contexts, including but not limited to those illustrated herein. Again, while in this alternative exemplary embodiment the housing assemblies 140 and respective lug assemblies 160 are shown as being substantially aligned or offset vertically, such need not be the case, but instead the housing and lug assemblies 140, 160 may be staggered or otherwise offset horizontally, in whole or in part, as in other exemplary embodiments shown and described herein. Furthermore, as shown in the exemplary embodiments of FIGS. 10-15 and again here in connection with the alternative exemplary embodiment of FIGS. 16-21, the spacing of the respective housing bearing wheels or surfaces 142 may substantially correlate basically to the nominal diameter of the respective lug bearing wheel or surface 162, or more precisely to any groove or the like that the respective cable 90, 91 runs in, such that the segments of cable 90, 91 passing between respective housing and lug assemblies 140, 160 are substantially vertical and substantially parallel to one another so as to minimize sideload on the bearing wheels or surfaces 142, 162, though once again it will be appreciated that this is not necessarily the case, such as with reference to the other exemplary embodiments herein of FIGS. 2-9. There of course may be greater or fewer of any such components or assemblies, and any such resulting drumhead tuning rim apparatus 20 may be arranged or configured in a variety of other ways without departing from the spirit and scope of the invention. In any such arrangement, it will be appreciated that each lug assembly 160 would still be installed spaced about the drum shell 12 substantially between respective housing assemblies 140, whether or not aligned therewith, so as to allow for the respective cable 90, 91 to loop intermittently therebetween.

Figure 17:
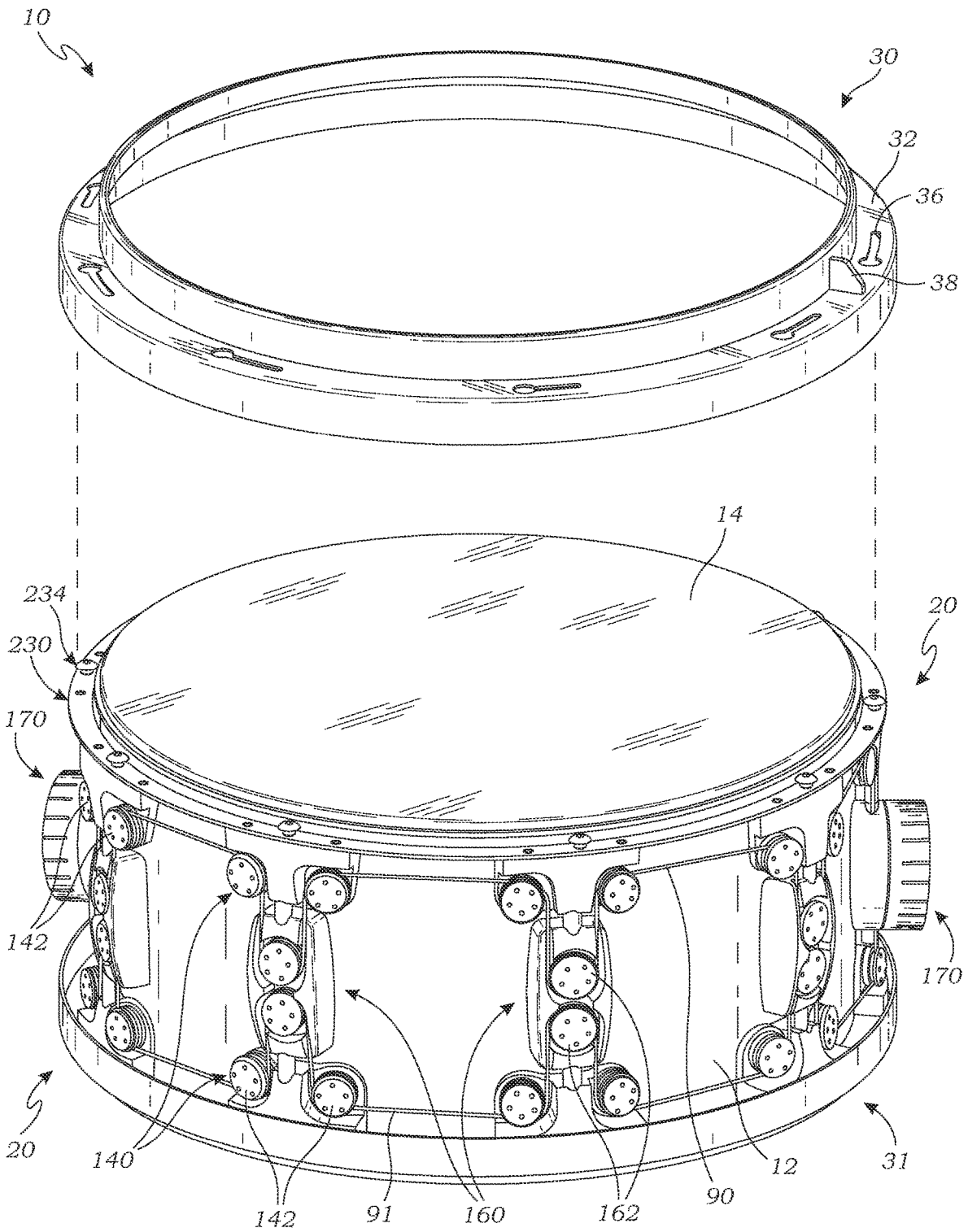
FIG. 17 is a partially-exploded perspective view thereof.
Figure 18:
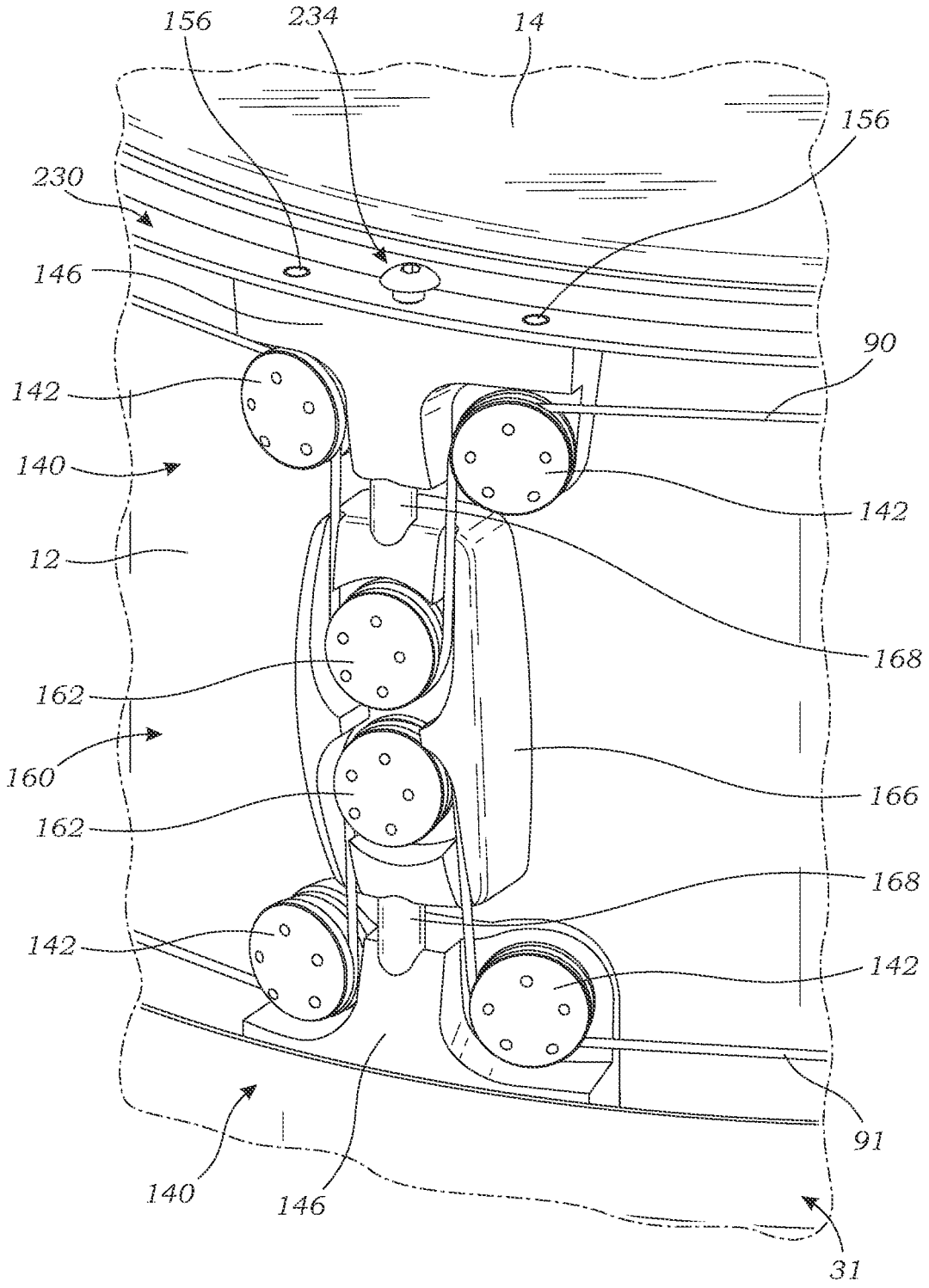
FIG. 18 is an enlarged partial perspective view thereof.
Figure 19:
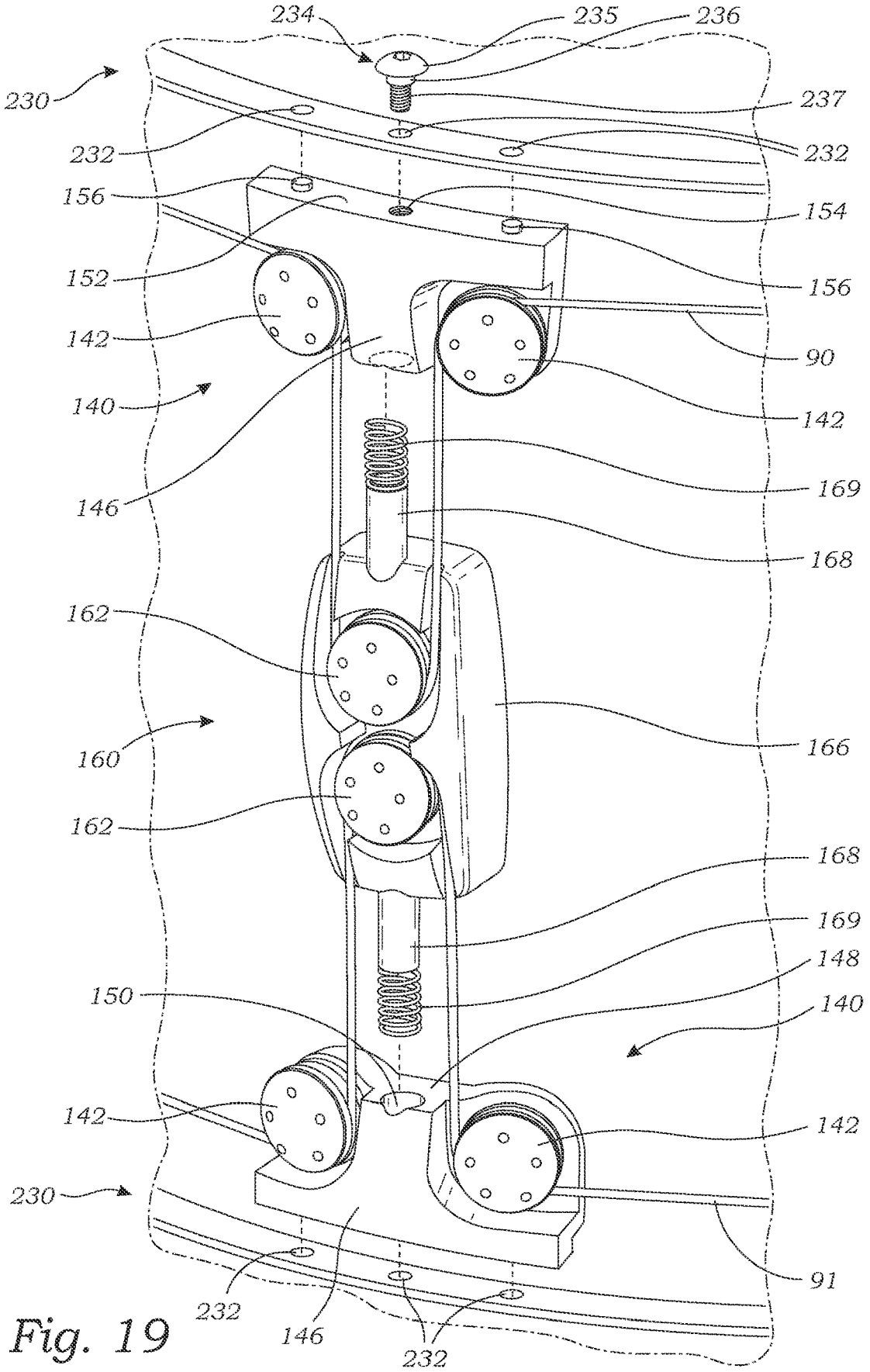
FIG. 19 is an enlarged partial partially-exploded perspective view thereof.

With continued reference particularly to the partially exploded perspective view of FIG. 17 illustrating the further alternative exemplary drumhead tuning rim apparatus 20 according to aspects of the present invention and now to the enlarged partial perspective views of FIGS. 18 and 19, it can be seen that the exemplary low friction lug assembly 160 generally comprises a lug body 166 in which is operably installed opposite or vertically spaced apart grooved bearing wheels 162 about which the respective upper and lower tension cables 90, 91 run. Further formed on the lug body 166 are oppositely extending lug body posts 168 on which the respective opposite low friction housing assemblies 140 are slidably received. Again, it will be appreciated that the lug body 166 may just as easily be formed as two separate components having a respective bearing wheel or surface 162 and post 168 each corresponding to the respective upper and lower assemblies 20 and be mounted on the drum shell 12 accordingly. Each low friction housing assembly 140 is shown as generally comprising a housing body 146 again in which is operably installed opposite or horizontally or circumferentially spaced apart grooved bearing wheels 142 about which the respective upper and lower tension cables 90, 91 run, it again being understood that such housing body 146 could also be formed as two separate components each having a respective bearing wheel or surface 142. In the exemplary embodiment, each housing body first surface 148 generally oriented toward the lug assembly 160 when assembled is formed having a housing body first hole 150 sized and configured for slidable receipt of the respective lug body post 168, on which basis it will be appreciated by those skilled in the art that the housing body 146 and thus the low friction housing assembly 140 may move or shift up or down relative to the respective lug body 166 and post 168 and thus the respective low friction lug assembly 160 during operation. As illustrated, a lug body spring 169 may be provided on or at the distal or free end of the respective lug body post 168 and so be positioned within the respective housing body first hole 150, or specifically between the housing body 146 and the lug body post 168, so as to effectively bias the low friction housing assembly 140 away from the respective low friction lug assembly 160. It will be further appreciated by those skilled in the art that counteracting any such biasing spring force or effect is the cable 90, 91 and any tension thereon, such that in operation as the cable 90, 91 is tightened so as to put increased tension on the rim 30, 31 and head 14 itself, the lug body springs 169 are effectively compressed, while if the cable 90, 91 is loosened by operation of the dial assembly 170, the respective springs 169 serve along with the head 14 to an extent to take any slack out of the cable 90, 91 and lift the rim 30, 31 and thus reduce tension on the drumhead 14. Accordingly, in one embodiment the respective cable 90, 91 serves to maintain the sliding assembly of the low friction housing assemblies 140 on the respective low friction lug assemblies 160, though it will be appreciated that any fastening or retention means now known or later developed for selectively assembling or capturing each housing assembly 140 on a lug assembly 160, and whether or not incorporating a post 168 and related hole 150 on or in either housing body 146, 166, may be employed according to aspects of the present invention without departing from its spirit and scope. By way of illustration and not limitation, the spring 169 may be made of wire steel having a nominal wire diameter of 0.63 mm, have a nominal or at rest length of 17 mm and a compressed or maximum load length of 6.2 mm, a nominal outside diameter of 6.93 mm, and a nominal spring rate of 0.26 lbs/mm. As best seen in FIG. 19, a second surface 152 of the housing body 146 of each low friction housing assembly 140 opposite the first surface 148 at or along which the housing assembly 140 effectively engages the respective lug assembly 160 is formed having a somewhat centered threaded housing body second hole 154 and two housing body posts 156 extending away from the housing body second surface 152 on opposite sides of the second hole 154. The subhoop 230 is then correspondingly formed with sets of three spaced-apart subhoop through-holes 232 thereabout, a central such through-hole 232 corresponding with the threaded housing body second hole 154 for receipt therethrough of a subhoop screw 234, more about which is said below, and opposite through-holes 232 flanking the central one and corresponding with and configured for removable receipt therein of the spaced-apart housing body posts 156 extending from the housing body second surface 152 toward the subhoop 230. By way of illustration and not limitation, the subhoop through-holes 232 may be nominally 5 mm in diameter at 25 mm center-to-center spacing; in a further exemplary embodiment, the central through-hole 232 for passage therethrough of the threaded portion 237 (FIG. 19) of the subhoop screw 234 is slightly larger than the other two adjacent through-holes—nominally 5.1 mm diameter versus nominally 4.5 mm diameter. The subhoop 230 may be formed of any appropriate material and by any appropriate manufacturing method now known or later developed, including but not limited to metal or plastic as through molding, casting, machining, stamping, or forming. By way of further illustration and not limitation, the subhoop 230 may be made of machined or cast steel or zinc. The subhoop 230 may also be formed with opposite slots (not shown) to accommodate snare wires (not shown) as might be positioned adjacent to either head 14. Those skilled in the art will appreciate that the number and arrangement of such positioning, attachment, or assembly features and materials and methods of fabrication of such components and assemblies are merely illustrative of features and aspects of the present invention and non-limiting.

Figure 16:
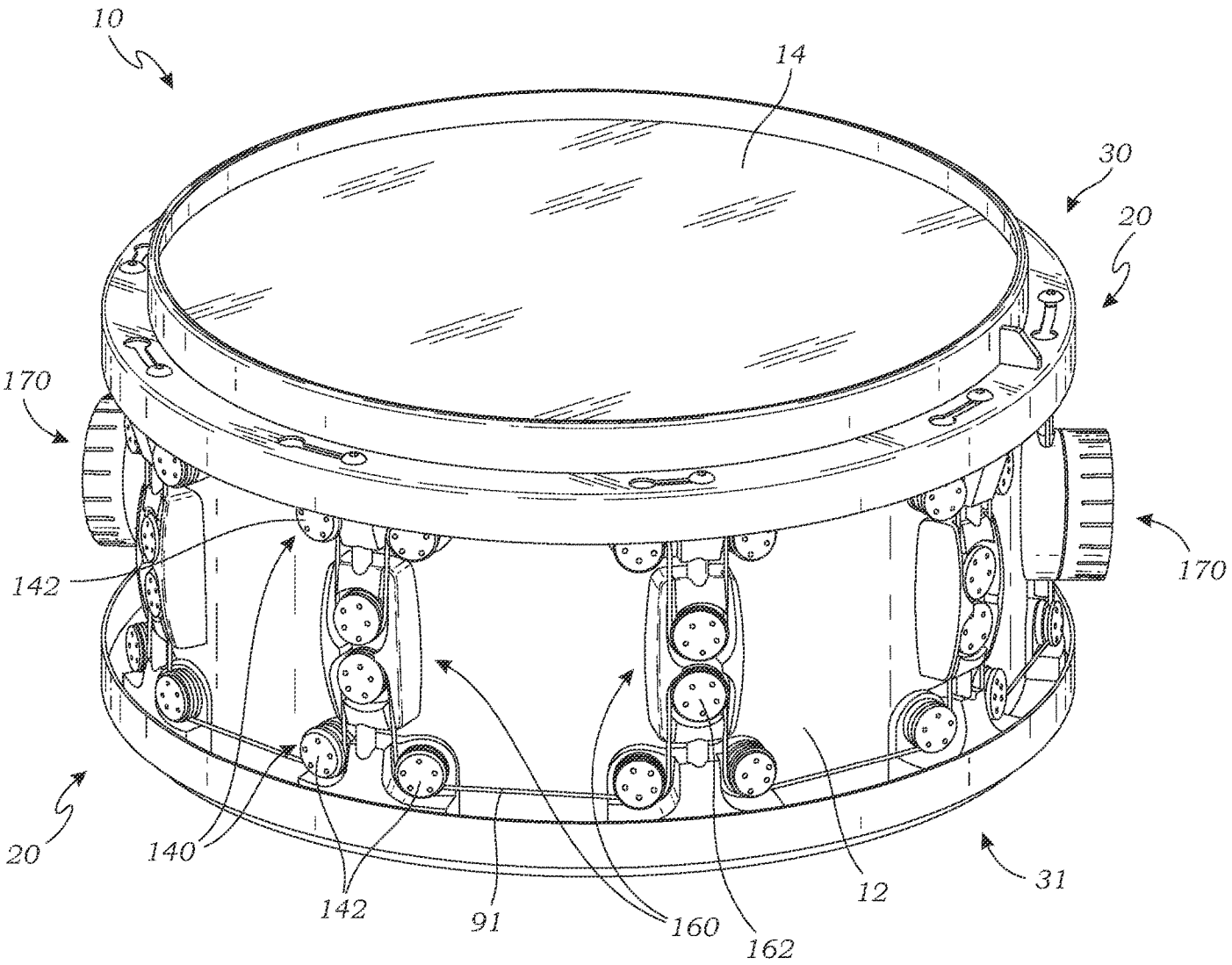
FIG. 16 is a perspective view of a still further alternative exemplary embodiment of the invention.

Referring still to FIGS. 16-19, in the alternative exemplary embodiment of a drumhead tuning rim apparatus 20 according to aspects of the present invention having the low friction housing assemblies 140 slidably mounted on the respective low friction lug assemblies 160 that are themselves mounted about the drum shell 12, a subhoop 230 for each apparatus 20 and corresponding to each rim 30, 31 is thus installed on the respective low friction housing assemblies 140 spaced about the shell 12 as by aligning the three subhoop through-holes 232 with the corresponding features formed on the second surface 152 of each housing body 146; more particularly, it will be appreciated that the engagement of the housing body posts 156 with the outer two subhoop through-holes 232 serves to assist with such assembly and the resulting alignment of the central subhoop through-hole 232 with the respective threaded housing body second hole 154. At that point a subhoop screw 234 can be threadably engaged with the housing body second hole 154 of each low friction housing assembly 140 about the shell 12 so as to thereby secure the subhoop 230 on the spaced-apart housing assemblies 140 as shown in FIG. 17. It will be appreciated that the subhoop 230 thus serves to stabilize the respective housing assemblies 140 laterally or circumferentially or add rigidity, both for purposes of sliding operation of the housing assemblies 140 relative to the respective lug assemblies 160 and of removable engagement of the "quick-change" rim 30, 31 effectively with the housing assemblies 140. However, those skilled in the art will appreciate that the same can be accomplished with a variety of hardware arrangements or configurations, employing components now known or later developed, and specifically with or without a subhoop 230, such that the exemplary embodiment is expressly to be understood as illustrative and non-limiting. Indeed, by way of further illustration and not limitation, the same or similar subhoop screw 234 could be threadably installed on each housing assembly 140 or housing body 146 without the subhoop 230, rendering the housing body posts 156 unnecessary as well, and thereby accomplish essentially the same functionality of removably receiving a quick-change rim 30, 31 as by selectively engaging the screws 234, again here without the subhoop 230, though as in the exemplary embodiment the subhoop 230 is preferred. As for the exemplary embodiment including the subhoop 230 and with particular reference to the enlarged partially-exploded perspective view of FIG. 19, each subhoop screw 234 is formed having a subhoop screw head 235, an intermediate subhoop screw shoulder 236, and an opposite subhoop screw threaded portion 237. First, the subhoop screw threaded portion 237 may be configured with appropriate thread diameter and pitch (or thread type or form) and length so as to threadably engage a correspondingly threaded housing body second hole 154 formed in the housing body 146. The intermediate subhoop screw shoulder 236 is not threaded and has a larger diameter than that of the subhoop screw threaded portion 237, such that the subhoop screw shoulder 236 seats against the subhoop 230 about the respective subhoop through-hole 232 as the threaded portion 237 passes through the same through-hole 232, thereby trapping the subhoop 230 against the housing body second surface 152, or between the subhoop screw shoulder 236 and the second surface 152, and securing the subhoop 230 on the respective low friction housing assembly 140. To that end, it will be appreciated that preferably the subhoop screw threaded portion 237 should be of such a length relative to the housing body second hole 154 that the subhoop screw shoulder 236 seats against the subhoop 230, or secures the subhoop 230 against the housing body second surface 152, before the subhoop screw threaded portion 237 bottoms in the housing body second hole 154. It will be further appreciated with reference to FIGS. 18 and 19 that the subhoop screw head 235 has a still larger outside diameter than that of the subhoop screw shoulder 236, such that when selectively and temporarily engaging the "quick-change" rim 30, 31 with the apparatus 20, and particularly with the assembly of the subhoop 230 and spaced apart low friction housing assemblies 140, and more particularly with the subhoop screws 234 that mount the subhoop 230 on such housing assemblies 140, each subhoop screw head 235 is configured so as to be able to pass through the relatively larger somewhat circular region of a respective keyway 36 formed in the flange 32 of the rim 30, 31 but not the relatively smaller slotted region of the keyway 36 that only the subhoop screw shoulder 236 can pass through. As such, it will be appreciated by those skilled in the art that the rim 30, 31 can be engaged with a drum 10 equipped with a drumhead tuning rim apparatus 20 according to aspects of the present invention by simply selectively positioning the rim 30, 31 over the respective subhoop 230 and related screws 234 such that the screw heads 235 pass through the respective rim keyways 36 until the rim flange 32 is substantially adjacent to the subhoop 230, at which point the rim 30, 31 can simply be rotated or shifted relative to the subhoop 230, in the illustrated embodiment clockwise as looking down on the top head 14, so as to slide the subhoop screw heads 235 over the rim flange 32 as the subhoop screw shoulders 236 pass through the respective slots of the keyways 36 until bottoming or otherwise, thereby selectively securing the rim 30, 31 on the drum 10 quickly and easily without loosening or removing any screws and thus facilitating rapid head changes, as shown in FIG. 16. With the "quick-change" rim 30, 31 so engaged with the apparatus 20, it will be appreciated that the respective low friction housing assemblies 140, the subhoop 230 installed thereon, and the rim 30, 31 removably engaged with the subhoop 140 and housing assemblies 140 as described, all such components then move in unison relative to the lug assemblies 160 and drum shell 12 as tension in the respective cable 90, 91 is shifted up or down by operation of the associated cable tension dial assembly 170, thereby tuning the associated head 14 "up" or "down" as in other exemplary embodiments herein. Notably, as with conventional drum hoops or rims, the rims 30, 31 are sized so as to effectively have a nominal inside diameter that is smaller than the nominal diameter of the intended drumhead 14 and a nominal outside diameter as at the radial perimeter or outer edge of the flange 32 that is larger than the diameter of the drumhead 14, or its hoop 16 (FIG. 4) more specifically, so as to thereby retain the drumhead 14 on the drum 10 or trap the drumhead 14 between the rim 30, 31 and drum shell 12. And to facilitate removal of the drumhead 14 once only the rim 30, 31 has been removed, it will be appreciated that the nominal inside diameter of the subhoop 230 would be greater than the nominal outside diameter of the particular drumhead 14 as shown in FIG. 17, though that would not necessarily be the case or required depending on a number of geometric considerations, particularly relating to the elevation of the subhoop 230 relative to the drum shell 12 and/or the drumhead 14, or other factors, such that, for example, the subhoop 230 could in part nest or be positioned beneath the drumhead perimeter hoop 16 as effectively also shown in FIG. 17—so long as only the rim 30, 31 and not the subhoop 230 makes contact with the perimeter of the drumhead 14 so as to trap or retain the drumhead 14 relative to the drum shell 12, such functionality is achieved. By way of illustration and not limitation, and in the context of a typical snare drum with nominal head size of fourteen inches (or about 35.5 cm) but with an actual hoop diameter of approximately 37 cm, the outside diameter of the rim 30, 31 is approximately 40.5 cm and the inside diameter is approximately 35.5 cm corresponding to the nominal shell and head size and so as to engage the drum head hoop about the rim's inside edge, while for the subhoop 230 the nominal outside diameter is approximately 40 cm and the nominal inside diameter is approximately 37.5 cm, though again a virtually infinite variety of configurations and sizes are possible depending on the drum 10 itself, and specifically the drum shell 12, and other factors. In any case, to remove the rim 30, 31 it would simply be rotated in the opposite direction, or counter-clockwise in this example, so as to again align the subhoop screw heads 235 with the larger circular portion of each rim keyway 36 and thereby allow the rim 30, 31 to be lifted off of the drum 10. As shown, a grip 38 may be provided on the rim 30, 31 to facilitate grasping and rotating the rim 30, 31 during use. Those skilled in the art will appreciate that the length or depth of the subhoop screw shoulder 236 may substantially approximate the thickness of the rim flange 32 for a net or near-net fit between the parts and secure and smooth engagement. Relatedly, it will be appreciated, with particular reference to FIG. 18, that the length or height of the housing body posts 156 are such that they enter but do not pass completely through the subhoop through-holes 232 and so do not stick up above the subhoop 230 when assembled on the low friction housing assemblies 140, further contributing to the smooth engagement of the "quick-change" rim 30, 31 with the respective tuning systems 20, and subhoops 230 specifically. However, it is to again be expressly understood that other configurations and arrangements of any such components and assemblies are possible according to aspects of the present invention without departing from its spirit and scope such that the exemplary embodiments are once more illustrative and non-limiting. By way of illustration and not limitation, the subhoop screw 234 may be nominally 16-17 mm long with the subhoop screw head 235 being approximately 2-3 mm thick and 11.5 mm in diameter, the subhoop screw shoulder 236 being approximately 4 mm long and 6.3 mm in diameter and the subhoop screw threaded portion 237 being approximately 10 mm long and 4 mm in diameter with an 8-32 male or external thread, and the rim keyway 36 may be nominally 12 mm in diameter at its larger circular opening and nominally 7 mm wide along its smaller slotted opening, the keyway 36 being approximately 18-19 mm long, center-to-center from end to end, and so the rim flange 32 may then have a nominal thickness of approximately 4 mm corresponding to the 4 mm screw shoulder height. Fundamentally, it will be appreciated by those skilled in the art that the novel combination of a drumhead tuning rim apparatus 20 according to aspects of the present invention with a "quick-change" rim 30, 31 as enabled by the effective assembly of the low friction housing assemblies 140 on the shell-mounted low friction lug assemblies 160 rather than on the rim 30, 31 itself enables removal or replacement of a drumhead 14 by simply loosening the tension in the associated cable 90, 91 by selective operation of the associated dial assembly 170 so as to then "twist off" the rim 30, 31 and enable free access to the drumhead 14, with the steps just repeated in reverse to install a drumhead 14 just as easily, which can again then be tightened and tuned simply by tightening the associated cable 90, 91 again via the associated cable tension dial assembly 170, all without having to loosen or remove any screws or even or at all disengage but only selectively loosen or reduce the tension in the respective cable 90, 91 again through operation of the easy-to-use dial assembly 170, more about which is said below in connection with FIGS. 20 and 21. Once more, those skilled in the art will thus appreciate that there is herein disclosed and new and novel system by which single-point drum tuning is achieved for uniform applied tension to a drumhead 14 about its perimeter or surface while still enabling quick and convenient removal of the rim 30, 31 while the balance of the drumhead tuning apparatus 20 remains in place or operably installed on the drum 10.

Figure 20:
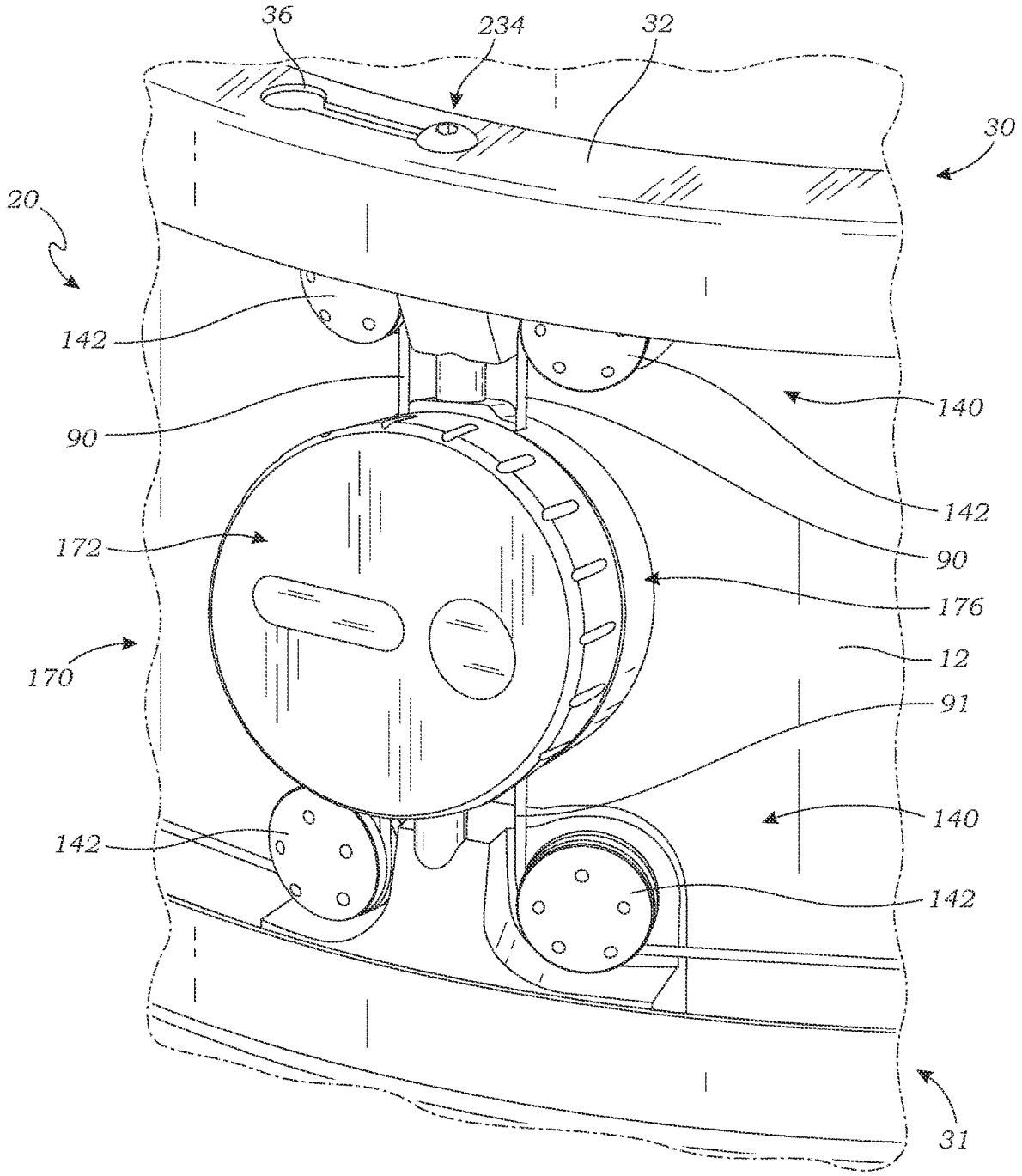
FIG. 20 is a further enlarged partial perspective view thereof.
Figure 21:
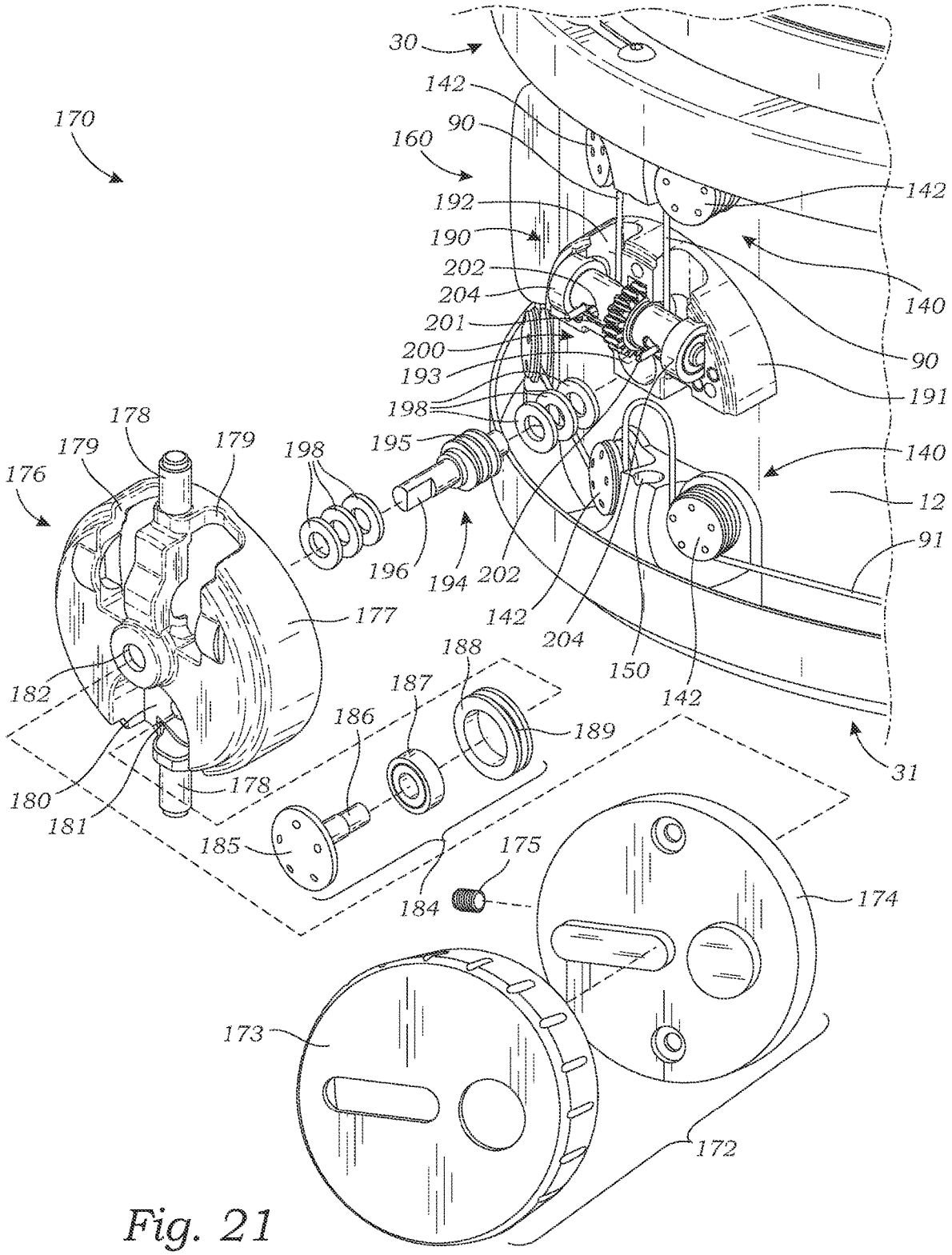
FIG. 21 is an enlarged partial partially-exploded perspective view thereof.

Turning next to FIGS. 20 and 21, there are shown assembled and exploded perspective views of a further exemplary cable tension dial assembly 170 as employed in the alternative exemplary drumhead tuning rim apparatus 20 according to aspects of the present invention as shown in FIGS. 16-19, the dial assembly 170 generally comprising a dial 172 and a dial body 176. As a threshold matter, it will be appreciated that while a particular configuration of the dial assembly 170 is shown and described, other such assemblies as included in alternative exemplary embodiments hereof or otherwise may also be employed. As shown in FIG. 20, the cable tension dial assembly 170 is generally installed at an intermediate location on the drum shell 12 with both the upper and lower cables 90, 91 feeding into it. In the exemplary embodiment involving or illustrating a relatively shorter snare drum 10 (FIG. 16), such arrangement of the dial assembly 170 accommodating or receiving both cables 90, 91 is primarily due to spatial constraints, as will be further appreciated from the below more detailed description in connection with the exploded view of FIG. 21. Here as a threshold matter, though, it is noted as also set forth elsewhere herein, and irrespective of spatial considerations, that any such dial assembly 170 may be configured to operate or selectively tighten or loosen only a single cable 90, 91 and thus tune only one head 14 or to operate or selectively tighten or loosen both cables 90, 91 and thus tune both the upper and lower heads 14, whether or not simultaneously. Where each dial assembly 170 engages only a single cable 90, 91 and thus tunes a single head 14, it will be further appreciated, again particularly with a relatively shorter snare drum 10, that the two cable tension dial assemblies 170 may be located in a staggered or spaced apart manner or basically in the exemplary embodiment shown on opposite sides of the drum shell 12 as illustrated in FIG. 16, one operably engaging the upper tension cable 90 and thus the upper rim 30 and so tuning the upper head 14 and one operably engaging the lower tension cable 91 and thus the lower rim 31 and so tuning the lower head 14. Once more, a variety of other such arrangements are possible according to aspects of the present invention without departing from its spirit and scope.

Referring more particularly now to the exploded perspective view of the cable tension dial assembly 170 of FIG. 21, such assembly 170 may again be incorporated at a particular lug position or installed in conjunction with a particular lug assembly 160 or may be independent of any lug or lug position. As a threshold matter, it will be appreciated that the illustrated dial assembly 170 is arranged so as to operate in conjunction with the upper cable 90 and thus to selectively put tension on the upper rim 30 and related upper drumhead 14, though a similar arrangement could again be employed in connection with the lower cable 91 and rim 31 by the dial assembly 170 essentially just being "flipped." Either way, the exemplary dial assembly 170 generally comprises a dial body 176 mounted directly or indirectly onto the drum shell 12, more about which is said below, and a dial 172 operably mounted on the dial body 176, the body 176 housing in operable relationship a take-up shaft 200 and a drive shaft 194 engaged via gearing. Generally, then, in the alternative exemplary embodiment, and somewhat analogous to other dial assembly shaft and gear arrangements disclosed herein, the dial assembly 170 comprises a substantially horizontal drive shaft 194 oriented so as to extend substantially radially outwardly relative to the drum shell 12 and configured having a worm gear 195 or the like for engagement with a worm wheel or engagement gear 201 formed on the take-up shaft 200, which is also oriented substantially horizontally but substantially perpendicular to the drive shaft 194. It is the drive shaft 194, and specifically its distal coupler 196, with which the dial 172 engages for manual operation of the drive shaft 194 and thus the overall dial assembly 170, though as will be appreciated by those skilled in the art a key K (FIG. 8) or other such device may interact with or facilitate rotation of the drive shaft 194 to selectively control the dial assembly 170 and thus the tension on the cable 90, which may also even be motorized or electro-mechanically driven. Opposite ends of the drive shaft 194 proximal of the coupler 196, here shown along the shaft 194 proximal and distal of the worm gear 195, may be rotationally supported via one or more thrust bearings 198 or the like. The mating take-up shaft 200 may also be rotationally supported within the dial body 176 or may be completely supported internally and, regardless, as also shown, its opposite free ends may be installed in opposite shaft bearings 204 contained within the dial body 176 or overall dial assembly 170, though as in other embodiments, the take-up shaft 200 may also extend beyond the dial body 176. In a bit more detail related to the components of the cable tension dial assembly 170 as shown in FIG. 21 particularly as relating to housing or supporting the internal gearing, in the exemplary embodiment, there is further provided a dial base 190 having formed therein a dial base recess 192 for at least partial support or retention of the take-up shaft 200—as shown, such dial base recess 192 may in fact be contoured or multifaceted so as to accommodate or provide clearance for both the intermediate take-up shaft engagement gear 201 and the shaft bearings 204 at opposite ends of the take-up shaft 200, as well as clearance for the cable 90 itself that is engaged with the take-up shaft 200, more about which is said below. The dial base 190 may be further formed with a dial base receiver hole 193 for receipt and support of at least one end of the drive shaft 194 and its one or more associated thrust bearings 198 and so positioned offset from the dial base recess 192 so as to properly position and space the drive shaft 194 and the take-up shaft 200 relative to one another and thus to facilitate proper or effective engagement of the drive shaft worm gear 195 with the take-up shaft worm wheel 201. By way of illustration and not limitation, the drive shaft 194 may have a nominal length of approximately 30 mm and a nominal diameter of approximately 6 mm, with a step on both sides of the worm gear 195 having a nominal diameter of approximately 8 mm so as to provide shoulders against which the respective thrust bearings 198 may seat, and with the worm gear 195 itself having a nominal outside diameter of approximately 12 mm and configured with a right-hand thread having a pressure angle of fourteen-and-a-half degrees (14.5°), the thrust bearings 198 coincidentally also having a nominal outside diameter of approximately 12 mm, while the take-up shaft 200 may have a nominal length of approximately 42 mm, including an approximately 32 mm central portion having a nominal diameter of approximately 10 mm and two opposite stepped-down end portions approximately 5 mm each in length and 5 mm in diameter for receipt of the opposite shaft bearings 204 that each have a nominal outside diameter of approximately 14 mm, with the worm wheel or engagement gear 201 located substantially centrally along the central portion of the take-up shaft 200 and having a nominal outside diameter of approximately 17 mm, here with eighteen (18) teeth each again having a pressure angle of fourteen-and-a-half degrees (14.5°) for mating, positive engagement with the drive shaft worm gear 198 when both shafts 194, 200 are operably installed within the dial assembly 170 as indicated. In the exemplary embodiment, both the drive shaft 194 and the take-up shaft 200, and particularly their respective gears 195, 201, may be formed from stainless steel, though it will be appreciated by those skilled in the art that all such components may be formed from any suitable material and method of manufacture, whether in one operation or involving one or more secondary operations, and whether now known or later developed.

With continued reference to FIG. 21, the dial base 190 may be further formed having a perimeter wall 191 that substantially conforms to a perimeter skirt 177 of the dial body 176 so that the parts may nest together in forming the dial assembly 170, in the exemplary embodiment, specifically, the dial base 190 effectively nesting within the dial body 176 so that it is the dial body 176 that is visible in the assembled view of FIG. 20, though it will be appreciated that such is not necessarily the case. Accordingly, with the drive shaft 194 and take-up shaft 200 operably arranged as described herein they may be retained in such operable arrangement by effectively installing the dial body 176 and the dial base 190 together so as to thereby trap the operable moving parts therein, such assembly being accomplished via any assembly or fastening components or techniques now known or later developed, including but not limited to screwing, bonding, welding, over-molding, press-fitting, or snapping. Accordingly, it will be appreciated that such sub-assembly of the dial body 176 and dial base 190 and related internal gearing and other components may be completed before such sub-assembly is then installed on the drum shell 12, as for example via fasteners such as screws from the inside of and passing through appropriate holes in the shell 12 so as to engage corresponding threaded holes in the dial base 190, and thus prior to any engagement of one or both tension cables 90, 91 or even the dial 172 with the dial assembly 170. As shown, the exemplary dial body 176 may be formed having a central dial body through-hole 182 for receipt therethrough of the distal end of the drive shaft 194, or the coupler 196 specifically, for exposure thereof and access thereto outside of the assembly of the dial body 176 and the dial base 190 for the purpose of then engaging the dial 172 or other such feature with the drive shaft 194, whether permanently or removably. Indeed, as also shown, the dial 172 may comprise a dial face 173 installed over a dial insert 174, with such assembly being retained on the coupler 196 of the drive shaft 194 via a set screw 175, though again other means of assembly now known or later developed are also possible. Notably, in the exemplary embodiment, by simply removing the one set screw 175 the dial 172 may thereby be removed from the drive shaft 194 and the balance of the dial assembly 170, thereby exposing the to-that-point concealed features of the dial body 176. Particularly, the dial body 176 is shown as having opposite dial body cut-outs 179 through which it will be appreciated one would see and have access to the take-up shaft 200. As such, even with the sub-assembly of the dial body 176 and dial base 190 intact and installed on the drum shell 12, and again with just the dial 172 itself removed, an operator can then take the free ends of the upper tension cable 90 and selectively feed them down through the dial body cut-outs 179 and corresponding dial base recess 192 and then engage such free ends with the take-up shaft 200 on opposite sides of the worm wheel 201 so as to facilitate winding the cable 90 about the take-up shaft 200 as such shaft 200 is caused to rotate. That is, as shown here and in other exemplary embodiments, on opposite sides of the take-up shaft engagement gear 201 there may be formed in the drive shaft 200 holes 202 configured for receipt therein of the free ends of the tensioning cable 90 as it starts and ends at the dial assembly 170. With the upper cable 90 in this example thus operably engaged with the take-up shaft 200, the dial 172 may simply be replaced on the drive shaft 194 adjacent to the dial body 176 as shown in FIG. 20, rendering the cable tension dial assembly 170 ready for use. In this way, it will generally be appreciated by those skilled in the art that with the ends of the cable 90 attached or secured to the shaft 200 in any appropriate manner now known or later developed and the rest of the cable 90 passing alternately through the housing and lug assemblies 140, 160 of the drumhead tuning rim apparatus 20 about the drum shell 12 as herein described, rotation of the take-up shaft 200 as caused by rotation of the drive shaft 194, and specifically rotation of the engaged dial 172, will selectively tighten or loosen the cable 90 or selectively increase or decrease tension in the cable 90 and thus raise or lower the overall pitch of the drumhead 14 as explained herein. Specifically, in the exemplary embodiment of FIGS. 16-21, and with reference to the upper drumhead 14 and related upper rim 30 and assembly 20, it will be appreciated that one end of the cable 90 is wrapped on one exposed end of the take-up shaft 200, for example, here, the left end as the tensioner 170 is viewed in FIG. 21, and the cable 90 then passes up and through the adjacent housing assembly 140, and particularly around the bearing wheel or surface 142 on the left, runs substantially along the underside of the upper rim 30 to the next housing assembly 140 to the left, thus passing around the bearing wheel or surface 142 on the right of that assembly 140 and then down to the next lug assembly 160 and around and back up and around the bearing wheel or surface 142 on the left side of the same housing assembly 140, and so on until the cable 90 comes "full circle" back to the housing assembly 140 adjacent to the cable tension dial assembly 170, around the bearing wheel or surface 142 on the right of such housing 140, at which point the opposite free end of the cable 90 then passes out of the housing 140 and back down to the tensioner 170 so as to be wrapped on the other exposed end of the take-up shaft 200, here the right end as the tensioner 170 is viewed. Accordingly, in this further exemplary arrangement, the tension cable 90 again passes intermittently around the perimeter of the drum 10 as by here going to and from or in and out of a rim housing assembly 140 for each corresponding lug assembly 160 until terminating at both ends in the cable tension dial assembly 170 associated with the upper apparatus 20. Those skilled in the art will appreciate that such arrangement, like the other embodiments shown and described herein, results in substantially equivalent vertical forces on each point around the rim 30 so as to substantially uniformly tighten and tune the corresponding drumhead 14. Once more, it will be appreciated that a variety of other such arrangements are possible according to aspects of the present invention without departing from its spirit and scope, such that the present embodiment is to be understood as illustrative and non-limiting. Particularly, other configurations and installations of the cable tension dial assembly 170 are possible. Relatedly, it will be appreciated once more by those skilled in the art that virtually any assembly technique for securing the one or more cable tension dial assemblies 170 on the drum shell 12, whether permanent or selectively removable or now known or later developed, and whether directly or as installed or mounted in conjunction with a lug assembly 160, may be employed in the present invention without departing from its spirit and scope, including but not limited to screws, bolts, cross-pins, rivets, adhesives, snaps, slotted engagement, spot or tack welding, or crimping. It will be further appreciated that the dial 172, and the dial face 173 specifically, as well as the dial body 176 may take any shape, size, or form as desirable in operably containing the take-up shaft 200 with gear 201 and the worm gear-style drive shaft 194 and in providing, in the case of the dial 172, an ergonomically effective grasping surface in operating the dial assembly 170. By way of illustration and not limitation, in the exemplary embodiment the overall outside diameter of both the dial 172 and the dial body 176 is approximately 65 mm. It will be further appreciated that a similar cable tension dial assembly 170, or any other such tensioner according to aspects of the present invention, may further be positioned on the drum 10 so as to operably control tension in the lower cable 91.

With still further reference to FIG. 21, and with particular reference to the lower cable 91 that in the exemplary embodiment is not operably engaged with or driven by the illustrated dial assembly 170 that operates the upper apparatus 20 and rim 30 via the upper cable 90, it can be seen that the dial body 176 is here further formed having a dial body bearing wheel 184 or idler pulley over which the lower cable 91 may operably loop analogous to the lower grooved bearing wheel 162 in each low friction lug assembly 160 about the drum shell 12, here in the location of the dial assembly 170 such dial body bearing wheel 184 effectively taking the place of a lug grooved bearing wheel 162 at that one lug position. Once again, it will be appreciated by those skilled in the art that while such a bearing wheel 184 is shown as incorporated within the dial assembly 170, that is not necessarily the case, such as optionally having the dial assembly 170 at an intermediate location or having a taller drum shell 12 such that the dial assembly 170 can be shifted up or down for the upper or lower cable 90, 91 operable engagement, leaving room opposite the dial assembly 170 and somewhat vertically aligned therewith for a separate low friction lug assembly 160 to be installed on the shell 12 for servicing the cable 90, 91 not driven by the respective dial assembly 170, there as potentially having only one grooved bearing wheel 162 rather than two. Staying with the exemplary embodiment wherein the bearing wheel 184 is incorporated into the dial assembly 170, the dial body 176 may thus be further configured having a dial body recess 180 formed beneath and offset from the cut-outs 179 and the through-hole 182, the recess 180 itself being formed with a somewhat central recess hole 181. Accordingly and advantageously, it will again be appreciated that the dial body bearing wheel 184 and the looped portion of the lower cable 91 thereabout are easily accessed by only removing the dial 172 as above-described, thereby exposing the previously-concealed portion of the dial body 176 and such internal features, such as for inspection or to install a new cable 90, 91. Furthermore, the illustrative dial body bearing wheel 184 is shown as an assembly of three parts essentially: a wheel body 185 having a wheel shaft 186 extending distally therefrom; a wheel bearing 187 press-fit or otherwise installed on the wheel shaft 186; and a wheel rim 188 installed on the perimeter of the wheel bearing 187. In this manner, it will be appreciated that in holding the wheel body 185 and shaft 186 fixed, such as by installing the distal free end of the wheel shaft 186 in the dial body recess hole 181, the wheel rim 188 may relatively smoothly or frictionlessly rotate about the shaft 186 via the intermediate wheel bearing 187, and as having sufficient clearance between the rim 188 and the dial body recess 180. In the exemplary embodiment, the dial body bearing wheel 184 has a nominal outside diameter of approximately 21 mm, which is effectively the outer or perimeter edge diameter of both the wheel body 185 and the wheel rim 188. The dial body wheel bearing 187 has a nominal outside diameter of approximately 16 mm, corresponding to an approximately 16 mm inside diameter of the wheel rim 188 for seating on the bearing 187, and has a nominal inside diameter of approximately 5 mm, corresponding to an approximately 5 mm outside diameter of the wheel shaft 186 for accommodating the bearing 187, in an exemplary embodiment all such engagement between the wheel shaft 186 and wheel rim 188 on the intermediate wheel bearing 187 being a press- or interference fit, though it will be appreciated that other assembly techniques now known or later developed may be employed. As also shown, the wheel rim 188 may be formed having a perimeter circumferential wheel rim groove 189 for retention of the cable 91 passing thereover, which groove may be on the order of approximately 1-3 mm deep, depending on a number of factors including the cable diameter. More generally, though not shown or described in such detail, it will be appreciated that effectively the very same dial body bearing wheel 184 as disclosed herein in connection with the exemplary dial assembly 170 of FIG. 21 may also be employed as the housing assembly grooved bearing wheel 142 or the lug assembly grooved bearing wheel 162, or any such variation or combination thereof, and whether scaled up or down or otherwise modified for particular applications, according to aspects of the present invention without departing from its spirit and scope. In any case, by way of further illustration and not limitation, the wheel bearing 187 may be a ball-type bearing for radial loading with the components such as the inner and outer races or bushings and ball bearings themselves made of any suitable material now known or later developed, including but not limited to metal such as stainless steel or brass and plastic such as Delrin®, and may be sealed or shielded as assembled and so also be self- or internally-lubricated as with grease or other appropriate lubricating or friction-reducing material, those skilled in the art appreciating that any such bearing construction or assembly now known or later developed may be employed in an apparatus 20 according to aspects of the present invention without departing from its spirit and scope. And with continued reference to FIG. 21, it will be appreciated based on the foregoing that cables 90, 91 are not positioned within the dial assembly 170 until after the dial body 176 is first assembled onto the dial base 190 and such sub-assembly installed on the shell 12 as herein described, notwithstanding the representation of the free ends of the upper cable 90 already engaging the take-up shaft 200 and the looped portion of the lower cable 91 positioned between the lower housing bearing wheels 142 even though the dial body 176 and associated bearing wheel 184 are shown as exploded rather than yet assembled. Similarly, and staying with the exemplary embodiment as illustrated, it will be appreciated that the dial body 176 is further formed with oppositely extending dial body posts 178 analogous to the lug body posts 168 (FIGS. 18 and 19) and for the same purpose of slidably engaging and supporting the associated low friction housing assemblies 140 as herein described, which again assumes that the dial assembly 170 is proximate such housing assemblies 140 as would be the case in the illustrated snare drum 10 embodiment of FIGS. 16-21, it again being appreciated that in other drum configurations, such as relatively taller toms or the like, the dial assembly 170 may not itself engage any low friction housing assembly 140 and so would not be formed with any such dial body posts 168, instead with separate low friction lug assemblies 160 provided accordingly for that purpose consistent with the exemplary features and aspects of the present invention as herein disclosed. Further, with continued reference to FIG. 21, once more, various fasteners, such as to mount the dial base 190 onto the drum shell 12, are not shown for simplicity and may take any appropriate form now known or later developed. Relatedly for simplicity, FIG. 21 does not include optional springs that may be mounted on the dial body posts 178 analogous to the springs 169 on the lug body posts 168 (FIG. 19). And though not shown, all parts mounted to the shell 12, such as the low friction lug assemblies 140 and the cable tension dial assemblies 170, may incorporate rubber gaskets or washers or other such features between such components and related fasteners and the drum shell 12 to facilitate sound or vibration dampening or isolation of such mechanical components from the drum shell 12. Fundamentally, those skilled in the art will appreciate that a wide variety of such components and related assemblies are possible according to aspects of the present invention, such that the various exemplary embodiments are expressly to be understood as illustrative and non-limiting.

Figure 22:
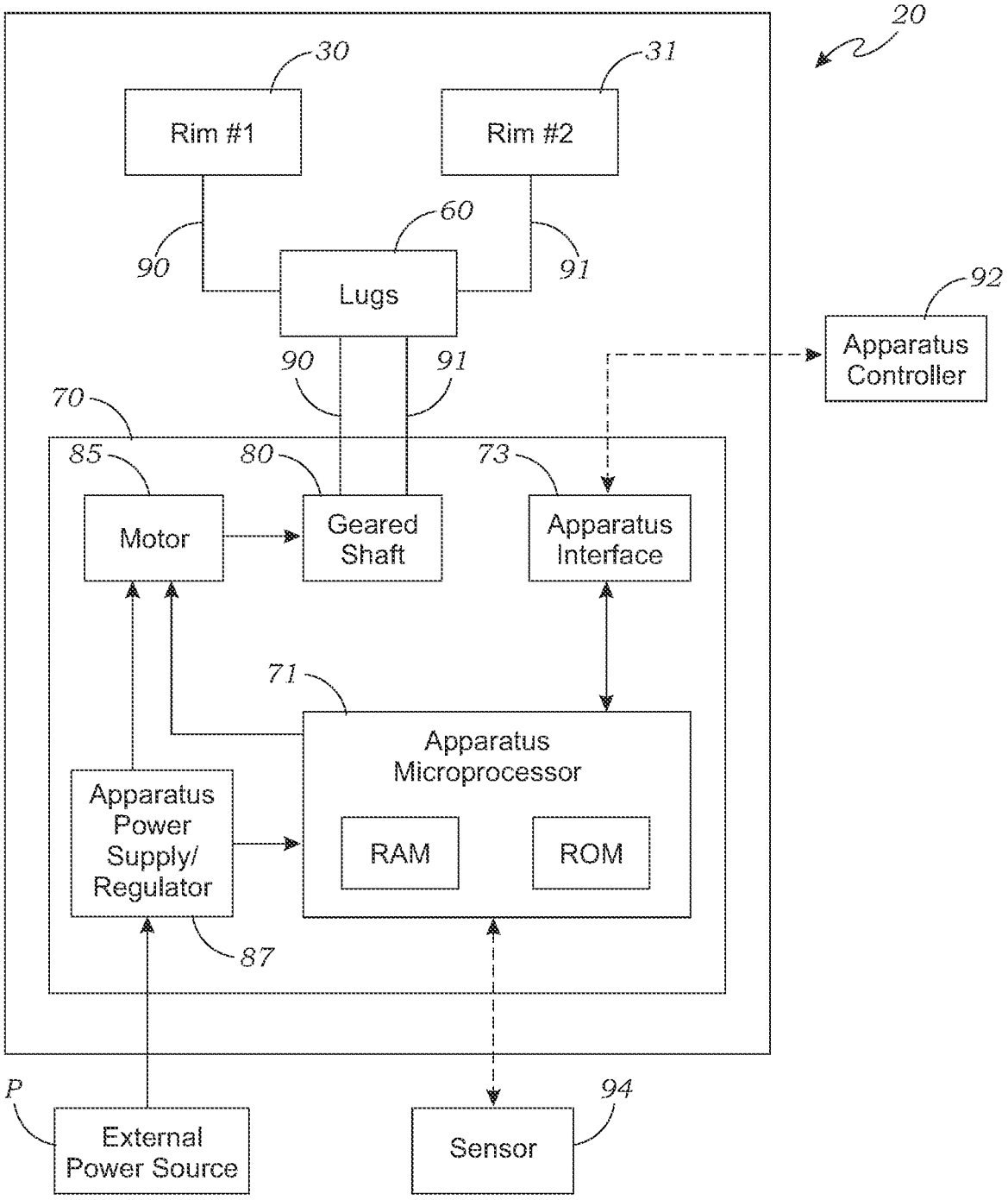
FIG. 22 is a block diagram schematic representation of a still further alternative embodiment of the invention.
Figure 23:
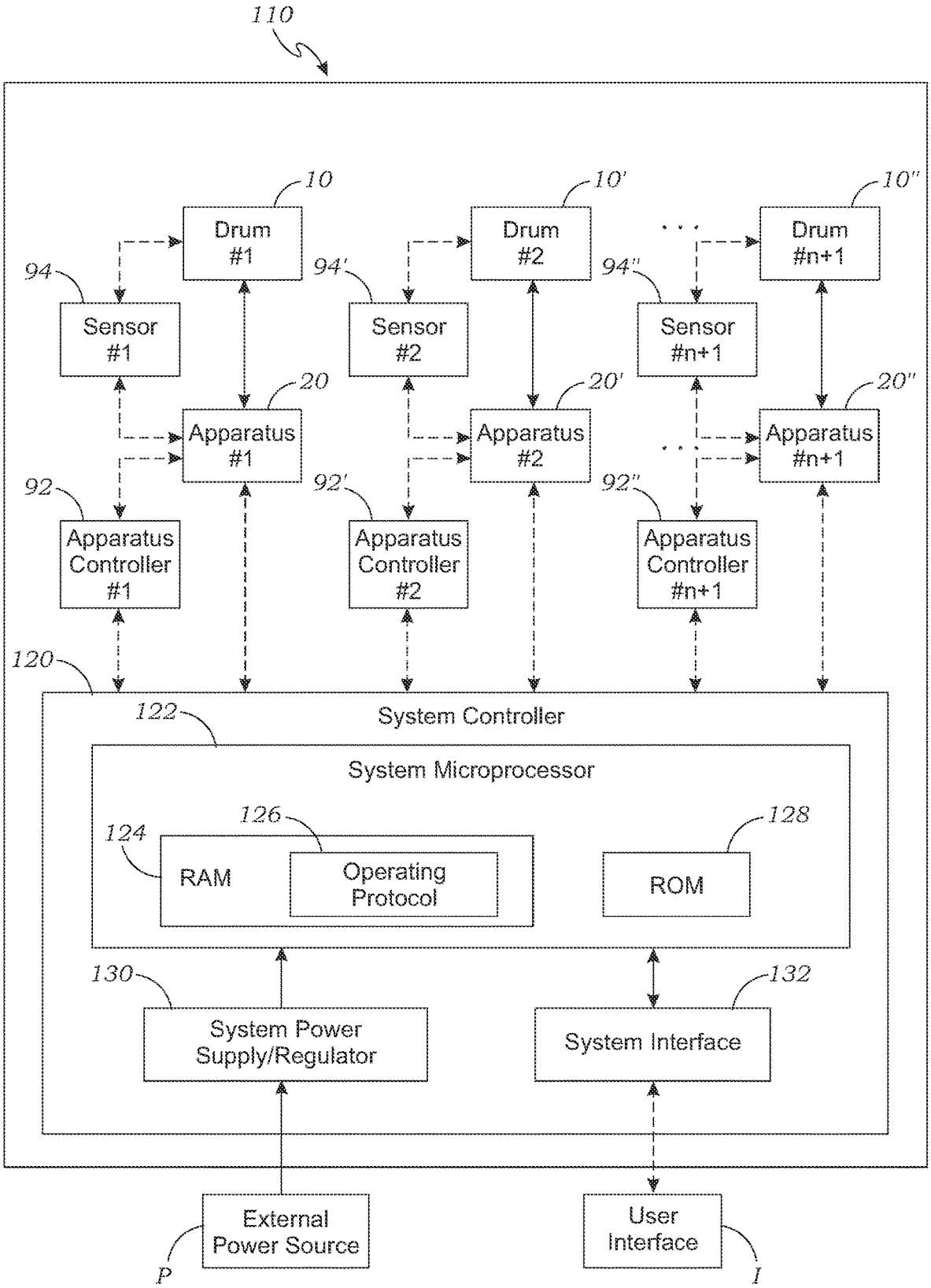
FIG. 23 is a block diagram schematic representation of a still further alternative embodiment of the invention.

Referring next to FIGS. 22 and 23, there are shown schematic block diagrams essentially depicting the new and novel idea of controlling the tuning of an acoustic drum or drum kit electronically (or electro-mechanically), as by having a motor 85 drive the geared shaft 80 of a drum head tuning rim apparatus 20 according to aspects of the present invention in order to tune each drum "up" or "down," with a microprocessor 71 allowing for control through a wired or wireless connection between the apparatus interface 73 and an external controller 92, more about which is said below. It will be appreciated as a threshold matter based on the foregoing exemplary embodiments that any such motor 85 may be configured to drive the take-up shaft 80 of any tensioner 70 directly, or the motor 85 may instead drive the drive shaft 89 that is operably engaged with the take-up shaft 80, so as to thus drive the take-up shaft 80 indirectly. Those skilled in the art will appreciate that such a system and method thus enables a conventional drum or drum kit to be tuned in an efficient or even automated manner as by electronic or electro-mechanical control yet with the full, rich, traditional sound and playability of an acoustic drum or drum kit. The resulting system is effectively and advantageously an acoustic-electric hybrid system that can be employed to create or enable an acoustic drum that is even self-tuning and/or self-adjusting. Applications of such a system could include but are not limited to eliminating the need for a drummer to tune his own drum set, allowing the drum set to tune itself and continually maintain tuning through a self-adjusting system, to allow a drummer to customize his tuning preferences and to easily and accurately duplicate those preferences, to allow an acoustic drum set to interact with technology in a way that makes it possible to have preset tuning options saved into an electronic interface (similar to how an electric guitar pedal works) and to access those options with the click of a button. A drummer could potentially adjust the tuning of his entire drum set instantaneously during live play, either between songs or during different sections of a song, for example during a key change. Such a system and method would thus be extremely beneficial for recording studio purposes as well, where rather than spending time and money re-tuning a drum set between songs, or bringing in a separate drum set, an artist could instead access his or her preset tuning options, instantaneously and automatically re-tuning the entire drum set between each song in the recording session. Relatedly, further applications of the present technology could also include a link, via Bluetooth® or any other wireless technology or protocol now known or later developed, between the acoustic drum set and an app on a smart phone, computer, or other technology for the purpose of uploading, downloading, and sharing tuning options as well as saving personal tuning settings and adjusting the drum set on the fly or even from a distance away. Those skilled in the art will appreciate that a variety of system configurations are possible within the spirit and scope of the invention, which will be further appreciated from the following discussion relating to FIGS. 22 and 23 in more detail.

With continued reference first to FIG. 22, there is again shown a schematic block diagram depicting a system for controlling the tuning of an acoustic drum electronically or electro-mechanically. Rather than manually turning the geared shaft 80 as through a dial 72 (FIGS. 6 and 7) or a drum key K (FIG. 8) that adjusts the tension in the cables 90, 91 to the respective upper and lower rims 30, 31 (labeled "Rim #1" and "Rim #2"), a motor 85 instead turns the shaft 80 under the control of a microprocessor 71. It is noted that while the shaft 80 is still described as "geared," it is not necessarily literally so, but instead may be "geared" in the sense that it is driven at various speeds and/or with various amounts of torque under the control of the motor 85 in the case of a "direct drive" arrangement, with the motor 85 coupled to the take-up shaft 80, the motor 85 then functionally providing all of the "gearing" for the shaft 80. It is further noted that while a single shaft 80 is shown in FIG. 22, the invention is not so limited, as will be appreciated from the foregoing discussion relating to alternative embodiments, and so might entail multiple gear shafts, each driven by the same motor 85 as by effectively a transmission that selective shifts the drive shaft of the motor 85 into engagement with one shaft or the other or neither. Or, there may be employed a separate motor 85 for each shaft 80 when a separate shaft 80 is to be provided for each cable/rim/head set. In any case, the one or more geared shafts 80 may be biased to a locked or non-rotatable position when not being driven, whether still engaged with the motor drive shaft or not, such that whatever setting the shaft is turned to, and hence whatever tension is in a particular cable and whatever resulting tuning of the associated head has been selected, it will remain until a different selection is made and the particular shaft 80 is again driven by the motor 85. Again, here, there are shown a first cable 90 operably engaged with both the geared shaft 80 and the central bearing lugs 60 and the first or upper rim 30 and a second cable 91 also operably engaged with both the geared shaft 80 and the bearing lugs 60 and then the second or lower rim 31. As such, it will be appreciated that the exemplary setup illustrated schematically in FIG. 22 is effectively a representation of the alternative embodiment of FIGS. 8 and 9 wherein a central, shared set of grooved bearing lugs 60 and a single cable tension dial assembly 70 are employed in the drum tuning rim apparatus 20, though again those skilled in the art will appreciate that a variety of alternative arrangements of the hardware and thus of the electronic control and resulting system beyond that illustrated in FIG. 22 are possible, such that it will be appreciated that the schematic is merely illustrative of aspects of the invention and non-limiting. It is further noted that while the upper and lower or first and second rims 30, 31, are shown in FIG. 22 as being part of the drum tuning rim apparatus 20, it will be appreciated that the rims may be standard rims or otherwise separate from the apparatus 20, as when the housing assemblies 40 are removably engaged with each rim. The microprocessor 71 is shown as having RAM and ROM memory and is generally configured with the appropriate circuitry and firmware to enable communication and control in a manner generally now known or later developed in the art. At the very least, the apparatus microprocessor 71 would include in its ROM memory software or firmware configured to enable the operation of the processor and the overall apparatus, whereas the RAM memory would include all other data obtained by or sent to the processor 71, such as feedback data from the motor 85 or an external sensor 94 as might measure tension in a cable 90 or stress or pitch of the drumhead 14 or data such as control commands relayed through the apparatus interface 73. The apparatus interface 73 itself may be in wired or wireless communication with an apparatus controller 92. In one exemplary embodiment, as mentioned above, the apparatus controller 92 may be software running on a computing device such as a smartphone, tablet device, computer, or other such device now known or later developed and configured to communicate with the processor 71 through the interface 73, again via a wired or wireless connection. Instead or in addition, the apparatus 20 may be configured with a controller 92 directly on the apparatus, such as a control panel, selection buttons, touchpad, touchscreen interface, or other such input means for user control of the apparatus 20. Finally, the cable tension dial assembly 70 may be equipped with an on-board apparatus power supply/regulator 87 for taking power from an external power source P such as an A/C source, and thereby operably powering the microprocessor 71, the motor 85, and any other components of the system, directly or indirectly. As will be appreciated, the connection to the external power source P may be constant, as by plugging the apparatus 20 into such a power source (e.g., an outlet), or may be temporary, as by plugging the apparatus 20 in just long enough to charge the on-board power supply/regulator 87 (e.g., a rechargeable battery). It will be appreciated that any means of powering the system now known or later developed is possible in the present invention without departing from its spirit and scope, such that those power components shown and described are to be understood as merely illustrative and non-limiting. More generally, those skilled in the art will appreciate that aspects of such a system and method can be achieved by a variety of means that include but are not limited to the use of an electric motor 85, attached internally or externally to the cable tension dial assembly 70. Any such motor 85 would effectively be attached to the dial itself and would be capable of increasing or decreasing tension on the drumhead 14 by means of turning the dial one direction or the other. The motor 85 would be either self-monitoring and auto-adjusting as under the control of the microprocessor 71, or it would be manually adjusted, as by selectively operating a button, lever, switch, dial or knob, etc. remotely or directly on the unit. This motor 85 could be triggered by some form of sensor 94, either internal or external, such as being integral to the motor, the dial, or the drumhead, or externally mounted to the drum in any conceivable configuration. In one exemplary embodiment, the sensor 94 would be able to read and determine the overall tension of the drumhead 14 by reading the frequency of vibration that is produced when the head is struck, by reading the surface tension on the head when it is at rest, by acoustically identifying the tone, by sensing the tension of the cable on the dial, or by any other such means now known or later developed. By way of further example, the sensor 94 could be an audio sensor/microphone, a laser or infrared sensor, a pressure sensor, or any other sensor used to determine tone, surface tension, cable tension, etc., again, whether now known or later developed and however appropriate mounted on the drum or otherwise operably installed. Any such information obtained from any such sensor 94 would be relayed back to the motor 85 inside the dial assembly 70 as through the microprocessor 71, again via a wired or wireless connection as represented by the dashed line, and the motor 85 will adjust the head tension accordingly until the desired tension is attained on the drumhead 14, or until the drum produces the desired pitch and tone when struck. The motor 85, attached to the dial assembly 70 or otherwise integral to the apparatus 20 itself, may have a digital interface, whether a touch screen, a manually adjustable control, a simple "preset" button, or some other means by which a specific tension, tone, or frequency, as determined by the user and detected by the sensor 94, is saved into the system and repeated instantly with the "touch of a button." This "button" or "user interface" could be integral to the apparatus 20 itself, or it could be externally connected, for example, wirelessly connected to the apparatus 20 as or via a pedal (like a guitar pedal), a drum pad, a smart phone, tablet, computer, or some other external system or device through which the pre-saved settings can be accessed, any such user interface or input being collectively and generally represented as the apparatus controller 92 of FIG. 22. This way a drummer would have the means of instantly and accurately switching between preset tuning options on his or her acoustic drum or drum set without the need to manually tune or adjust the drum(s) in any way, more about which is said below concerning use of such a system. It is further noted in the context of electronic or electro-mechanical control of an acoustic drum or drum set according to aspects of the present invention that a further exemplary, non-limiting approach beyond the exemplary apparatuses 20 shown and described herein would be include a drum hoop that is magnetically attached to the drum rim. Through the use of an electromagnetic current, the strength of the magnetism between the two hoops could be adjusted to produce varying tension in the drumhead. The use of an electronic and/or manually adjustable interface to control the electromagnetic current could produce the same level of control and automatic-tuning capabilities as mentioned above. Another conceivable exemplary method for producing the same results would be to use a type of skin material in the drumhead itself that responds to electromagnetic current, such that depending on the voltage that is applied to the drum skin itself, the drumhead would respond with different levels of rigidity and vibrate at different frequencies accordingly. As such, those skilled in the art will appreciate that modifications to the hardware components of the system and related methods of use are also possible according to aspects of the present invention in order to render the resulting system operable in particular contexts or alternative configurations without departing from the spirit and scope of the present invention. More generally, any mechanical, electronic, electro-mechanical, electro-magnetic, materials, or other such method of selectively adjusting tension in a cable or a drumhead itself, whether now known or later developed, may be employed in an apparatus or system according to aspects of the present invention without departing from its spirit and scope.

Turning to FIG. 23, also in schematic block diagram format, there is depicted the idea of a system 110 whereby electro-mechanical control of each drum 10, 10', 10" in a kit is tuned via a central system controller 120, generally in keeping with the other aspects of the present invention as set forth herein. Each drum 10, 10', 10", numbered 1 to n+1, signifying essentially any number of drums, is operably configured or paired with its respective drum tuning rim apparatus 20, 20', 20", mechanically or otherwise, and its related sensor 94, 94', 94", again connected wired or wirelessly. Similarly, each drum tuning rim apparatus 20, 20', 20" is wired or wirelessly connected to its respective apparatus controller 92, 92', 92" as above-described in connection with FIG. 22, with each such drum tuning rim apparatus 20, 20', 20" and/or apparatus controller 92, 92', 92", in turn being wired or wirelessly connected to the system controller 120. In that regard, it will be appreciated by those skilled in the art that in certain contexts and configurations the central system controller 92 may interface with and directly control each drum tuning rim apparatus 20, 20', 20", may interface with and directly control each apparatus controller 92, 92', 92", or both. In other contexts of exemplary systems according to aspects of the present invention, there may not even be individual apparatus controllers 92, 92', 92", the central system controller 120 being the means by which all control is accomplished. In any such embodiment, the system controller 120, like any individual apparatus controller 92, may be a dedicated hardware device incorporated into or otherwise operably installed within the system 110 or may be a computing device such as a smartphone, tablet, or computer running software configured to enable the interface between the system controller 120 and one or more of the drum tuning rim apparatuses 20, 20', 20" and/or apparatus controllers 92, 92', 92". Optionally, then, any external user interface I through which a user may interact with the system controller 120 through the system interface 132 may also be a computing device, as might be the case where the system controller 120 is a dedicated device as a control panel or touchscreen interface, which may thus be operated directly on site or remotely via a secondary or external user interface I. With continued reference to FIG. 23, the system controller 120 is shown as comprising a system microprocessor 122 that again includes a RAM memory 124 and a ROM memory 128. The RAM memory 124 stores any particular operating protocol 126 selectively loaded in the processor 122 for operating the drum tuning rim system 110, such as different versions having different degrees of functionality and options (e.g., beginner versus professional systems with various programming capabilities, number of preset or stored tuning configurations possible, etc.). And as above for the individual apparatus controller 92, the RAM memory 124 may also store data sent to or received by the processor 122 both from the individual apparatuses 20, 20', 20" and/or apparatus controllers 92, 92', 92" and the related sensors 94, 94', 94" and from any user interface I selections as transmitted to the processor 122 through the system interface 132, whereby the processor 122 and hence the system controller 120 responds accordingly, at least in part, pursuant to the operating protocol 126 stored in RAM memory 124 of the processor 122. In alternative embodiments the operating protocol 126 may be stored in the ROM memory 128 of the processor 122, as when any such protocol is part of the firmware or basic operational software that is to be pre-installed and permanently reside in the processor 122. Again, a system interface 132 is incorporated in the system 110 and in communication with the processor 122, which system interface 132 itself is in wired or wireless communication with a user interface I as above-described. Finally, analogous to the individual drum tuning rim apparatus 20 of FIG. 22 and the power requirements of the dial assembly 70 of the apparatus 20, the system controller 120 may also be equipped with a system power supply/regulator 130 that is itself selectively connected to an external power source P in any manner now known or later developed for powering the controller 120 and potentially any of the other components of the system 110. It will thus generally be understood and appreciated that aspects of the present invention are further directed to a drum tuning system 110 made up of a number (n+1) of drum tuning apparatuses 20 associated with an equal number of drums 10, optionally further including separate apparatus controllers 92 and sensors 94 for each drum and drum apparatus pair. Whatever the format or configuration of the overall system 110 and the related system and/or apparatus level controllers, it will be appreciated that in order to enable a drummer to customize his or her tunings for a variety of sounds and applications, the system preferably has a manually adjustable option, whether any such user interface is again accomplished via the system controller 120 or the individual apparatus controllers 92, 92', 92" and whether through dedicated hardware or the use or incorporation of a computing device running appropriate software; in some embodiments the individual apparatus controllers 92, 92', 92" are simply incorporated within the overall system controller 120 or the various controllers are one and the same. Accordingly, the drummer would adjust each drum manually to the desired setting, then have the ability to save that setting, whether for the individual drum and/or for the entire drum set. By going through the presets, the drummer would be able to adjust one drum individually and independently of the others (snare drum or kick drum, for example) or adjust the entire drum set in unison. For example, a drummer could have his set tuned to a low end, rock style tuning for one song, then click a button or make a selection on his preset device (user interface) and change the tuning of the entire set to a brighter, jazzier tuning for the next song in the set. The total adjustment would take seconds. Combining the herein described technology with wireless technology such as Bluetooth® or other wireless protocol now known or later developed allows for the use of smart phone or computer applications that would advantageously communicate with the drum tuning rim system 110 according to aspects of the present invention. Any such software applications according to and consistent with aspects of the present invention could be used to create, save, and transfer drum tuning styles and settings between drummers and to upload them to the physical drum set by transferring the data wirelessly between the application and the physical tuning technology on the drum set. Drummers could search specific tuning settings for their specific drum set size and specifications as posted by other users, including professional drummers, and instantly duplicate that tuning on their own drum set. For example, if a drummer desired to play a specific song by a specific artist, he or she could look up specific tunings that other drummers have used for that song, depending on the particular type and dimensions of the drum set that they are using. They could then upload those settings to their set and save them in their preset mode. They could do this for each song in the set, quickly and easily selecting or toggling between tunings for each song that they play. Thus, the system and method according to aspects of the present invention allows for customization and convenience similar to an electric drum set but with the full-bodied projection, warmth, and playability of an acoustic drum set, thereby in essence having the "best of both worlds." It will again be appreciated by those skilled in the art that other embodiments and variations according to aspects of the present invention are possible without departing from its spirit and scope.

Aspects of the present specification may also be described as follows:

1. A drumhead tuning rim system for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

2. The system of embodiment 1 wherein the drumhead tuning rim apparatus further comprises a plurality of low friction housing assemblies configured to be installed spaced along the rim of the drum, a plurality of low friction lug assemblies configured to be installed spaced about the drum shell substantially between the respective housing assemblies, and a tensioning cable configured for alternately passing between and about respective housing and lug assemblies substantially about the perimeter of the drum shell and for operably engaging the cable tension dial assembly at opposite ends.

3. The system of embodiment 2 wherein a single row of lug assemblies are positioned about the drum shell, a single cable tension dial assembly is operably installed on the drum shell, and first and second tensioning cables are both operably engaged with the single cable tension dial assembly and with respective first and second rims each having respective housing assemblies installed thereon, whereby the single cable tension dial assembly is capable of adjusting the overall pitch of two drumheads.

4. The system of embodiment 2 or embodiment 3 wherein each lug assembly is formed having opposing grooves in which the respective first and second tensioning cables run.

5. The system of any of embodiments 2-4 wherein the housing assemblies comprise low friction bearing surfaces on which the tensioning cable runs.

6. The system of any of embodiments 2-4 wherein the housing assemblies comprise rotatable housing grooved bearing wheels on which the tensioning cable runs.

7. The system of any of embodiments 1-6 wherein the apparatus controller is selected from the group consisting of a dial and a key.

8. The system of any of embodiments 1-7 wherein the cable tension dial assembly further comprises a cable tension dial body installed on the drum shell, a shaft operable within the cable tension dial body and configured for engagement with the tensioning cable, and a dial selectively installed on the shaft for operation thereof, whereby rotation of the shaft as through operation of the dial effectively increases or decreases tension in the tensioning cable and thus raises or lowers the overall pitch of the drumhead.

9. The system of any of embodiments 1-7 wherein the cable tension dial assembly further comprises a cable tension dial body installed on the drum shell, a shaft operable within the cable tension dial body and configured for engagement with the tensioning cable, the shaft being formed with an outwardly protruding dial lug accessible through an opening formed in the dial body, and the key selectively engageable with the shaft via the dial lug for operation thereof, whereby rotation of the shaft as through operation of the key effectively increases or decreases tension in the tensioning cable and thus raises or lowers the overall pitch of the drumhead.

10. The system of any of embodiments 1-7 wherein the cable tension dial assembly further comprises a shaft and a tensioning cable operably engaging the shaft at opposite ends and mechanically coupled to the rim of the drum.

11. The system of embodiment 10 wherein the shaft is driven by a motor operably installed within the cable tension dial assembly.

12. The system of embodiment 11 further comprising an apparatus microprocessor operably engaged with the motor so as to selectively control operation thereof and thus of the shaft and tuning of the drumhead.

13. The system of embodiment 12 wherein the cable tension dial assembly further comprises an apparatus interface for selectively providing an operable interface between the apparatus microprocessor and the apparatus controller.

14. The system of any of embodiments 11-13 wherein the apparatus controller is selected from the group consisting of a control panel, a selection button, a touchpad, a touchscreen interface, a lever, a switch, a knob, a smartphone, a tablet device, and a computer.

15. The system of any of embodiments 12-14 wherein there is a wired connection between the apparatus controller and the apparatus microprocessor through the apparatus interface.

16. The system of any of embodiments 12-14 wherein there is a wireless connection between the apparatus controller and the apparatus microprocessor through the apparatus interface.

17. The system of any of embodiments 12-16 further comprising a sensor operably installed relative to the drum and operably engaged with the apparatus microprocessor so as to provide feedback to the cable tension dial assembly for adjustment of the pitch of the drumhead as desired.

18. The system of any of embodiments 1-17 further comprising a plurality of drumhead tuning rim apparatuses configured for operable engagement with a corresponding plurality of drums, a plurality of apparatus controllers operably interfacing with the plurality of drumhead tuning rim apparatuses, and a system controller having a system microprocessor operably engaged with the plurality of drumhead tuning rim apparatuses for selective control of one or more of the plurality of drumhead tuning rim apparatuses and thus selective tuning of one or more drums.

19. The system of embodiment 18 wherein the system controller directly controls the plurality of drumhead tuning rim apparatuses, such that the plurality of apparatus controllers are effectively incorporated within the system controller.

20. The system of embodiment 18 or embodiment 19 wherein the system microprocessor comprises a RAM memory storing an operating protocol.

21. The system of any of embodiments 18-20 wherein the system controller is selected from the group consisting of a control panel, a selection button, a touchpad, a touchscreen interface, a lever, a switch, a knob, a smartphone, a tablet device, and a computer.

22. The system of any of embodiments 18-21 further comprising a system interface for selective interaction with the system controller.

23. The system of any of embodiments 18-22 further comprising a plurality of sensors operably installed relative to the plurality of drums and operably engaged with the system microprocessor so as to provide feedback to the plurality of drumhead tuning rim apparatuses for adjustment of the pitch of the respective drums as desired.

24. A drumhead tuning rim system for securing and tuning a drumhead on a drum shell of a drum, comprising a drumhead tuning rim apparatus comprising a cable tension dial assembly operably engaging a rim of the drum so as to increase or decrease tension on the rim, the rim being configured for seating over the drumhead on the drum shell, the cable tension dial assembly comprising a shaft driven by a motor and mechanically engaged with the rim through a tensioning cable, and an apparatus controller operably interfacing with the drumhead tuning rim apparatus so as to selectively control the cable tension dial assembly and thereby adjust the overall pitch of the drumhead as by adjusting the tension on the rim, the apparatus controller being selected from the group consisting of a control panel, a selection button, a touchpad, a touchscreen interface, a lever, a switch, a knob, a smartphone, a tablet device, and a computer.

25. A method of securing and tuning a drumhead on a drum shell of a drum, comprising the steps of positioning the drumhead on the drum shell, positioning a rim over the drumhead, the rim being configured with a plurality of housing assemblies installed thereabout, looping a tensioning cable passing around the housing assemblies underneath corresponding lug assemblies installed about the drum shell substantially between the respective housing assemblies, and tightening the tensioning cable until the desired overall pitch of the drumhead is achieved.

26. The method of embodiment 25 wherein the step of tightening the tensioning cable comprises selectively turning a dial of a cable tension dial assembly operably engaging the rim of the drum through the tensioning cable.

27. The method of embodiment 25 wherein the step of tightening the tensioning cable comprises engaging a key with a cable tension dial assembly operably engaging the rim of the drum through the tensioning cable, and selectively turning the key.

28. The method of embodiment 25 wherein the step of tightening the tensioning cable comprises selectively operating a motor operably engaged with a cable tension dial assembly operably engaging the rim of the drum through the tensioning cable.

29. The method of embodiment 28 wherein the step of selectively operating the motor comprises interacting with the motor through one of a control panel, a selection button, a touchpad, a touchscreen interface, a lever, a switch, a knob, a smartphone, a tablet device, and a computer.

30. The method of any of embodiments 25-29 wherein multiple drums are to be tuned, comprising the further steps of positioning a plurality of drumheads on a plurality of drum shells, positioning a plurality of rims over the respective drumheads, the rims each being configured with a plurality of housing assemblies installed thereabout, on each drum looping a tensioning cable passing around the housing assemblies underneath corresponding lug assemblies installed about the respective drum shells substantially between the respective housing assemblies, and selectively operating a system controller to selectively tighten one or more of the tensioning cables until the desired overall pitch of one or more of the drumheads is achieved.

31. A drumhead tuning rim system comprising at least one drumhead tuning rim apparatus for securing and tuning a drumhead on a drum shell of a drum, the drumhead tuning rim apparatus comprising a plurality of low friction housing assemblies configured to be shiftably mounted on the drum shell, a plurality of low friction lug assemblies configured to be installed spaced about the drum shell, a rim configured for seating over the drumhead on the drum shell and for selectively removably engaging the low friction housing assemblies so as to secure the rim on the drum shell over the drumhead, a cable tension dial assembly configured for operably engaging the rim so as to increase or decrease tension on the rim and thus the drumhead, and a tensioning cable configured for alternately passing about the low friction housing and lug assemblies substantially about the drum shell and for operably engaging the cable tension dial assembly at at least one end so as to selectively raise or lower the overall pitch of the drumhead, whereby operating the cable tension dial assembly to tighten the tensioning cable shifts the low friction housing assemblies toward the low friction lug assemblies and thereby pulls the rim toward the drum shell so as to increase tension on the drumhead, and operating the cable tension dial assembly to loosen the tensioning cable allows the low friction housing assemblies to shift away from the low friction lug assemblies and thereby the rim to shift away from the drum shell so as to decrease tension on the drumhead, further such operation of the cable tension dial assembly allowing the rim to be sufficiently unloaded so as to be selectively disengaged from the low friction housing assemblies and removed from the drum to facilitate removing and replacing the drumhead without any disassembly of the low friction housing assemblies, the low friction lug assemblies, the cable tension dial assembly, and the interconnected tensioning cable.

32. The system of embodiment 31 wherein the cable tension dial assembly comprises a rotatably installed take-up shaft configured for operable engagement with the at least one end of the tensioning cable.

33. The system of embodiment 32 wherein the take-up shaft is formed having an engagement gear, and a drive shaft is formed having a worm gear and is rotatably installed within the cable tension dial assembly such that the worm gear operably engages the engagement gear.

34. The system of embodiment 33 wherein both the engagement gear and the worm gear have a pressure angle of approximately 14.5°.

35. The system of embodiment 33 or embodiment 34 wherein the engagement gear is intermediate along the take-up shaft, and opposite ends of the take-up shaft are configured for operable engagement with opposite ends of the tensioning cable.

36. The system of any of embodiments 33-35 wherein the drive shaft is configured having a coupler for removable engagement of an apparatus controller in selectively operating the cable tension dial assembly.

37. The system of embodiment 36 wherein the apparatus controller is selected from the group consisting of a dial and a key.

38. The system of any of embodiments 33-36 wherein the drive shaft is motor driven.

39. The system of any of embodiments 33-38 wherein the drive shaft is supported by one or more thrust bearings.

40. The system of any of embodiments 32-39 wherein the take-up shaft is supported by one or more shaft bearings.

41. The system of any of embodiments 31-40 wherein the low friction lug assemblies comprise one of rotatable lug grooved bearing wheels and low friction sliding surfaces on which the tensioning cable runs.

42. The system of embodiment 41 wherein the low friction lug assemblies each comprise two vertically offset lug grooved bearing wheels.

43. The system of any of embodiments 31-42 wherein the low friction housing assemblies comprise one of rotatable housing grooved bearing wheels and low friction sliding surfaces on which the tensioning cable runs.

44. The system of embodiment 43 wherein the low friction housing assemblies each comprise two circumferentially offset housing grooved bearing wheels.

45. The system of any of embodiments 31-44 wherein the low friction lug assemblies each comprise a lug body having a lug body post, and the low friction housing assemblies each comprise a housing body having a housing body first hole configured to slidably receive the lug body post, whereby the low friction housing assemblies are shiftably mounted on the drum shell as by being slidably mounted on the respective low friction lug assemblies.

46. The system of embodiment 45 wherein a lug body spring is installed on the lug body post and configured to be received within the housing body first hole, whereby the lug body spring biases each low friction housing assembly away from the respective low friction lug assembly.

47. The system of embodiment 45 or embodiment 46 wherein each housing body comprises a housing body first surface in which the housing body first hole is formed and a further housing body second surface, and a means for removably engaging each low friction housing assembly with the rim is formed on the housing body second surface.

48. The system of embodiment 47 wherein the removable engagement means is a subhoop screw installed in a threaded housing body second hole formed in the housing body second surface.

49. The system of embodiment 48 wherein the subhoop screw comprises a subhoop screw shoulder having a length that substantially corresponds to the thickness of a flange of the rim with which the subhoop screw engages in selectively removably engaging the rim on the low friction housing assemblies.

50. The system of embodiment 49 wherein the flange of the rim is formed having spaced-apart keyways corresponding to the locations of the low friction housing assemblies for selective engagement with the respective subhoop screws.

51. The system of embodiment 49 or embodiment 50 wherein the flange of the rim is formed having at least one grip.

52. The system of any of embodiments 48-51 wherein an annular subhoop is installed on the low friction housing assemblies so as to be substantially adjacent to the housing body second surface.

53. The system of embodiment 52 wherein the subhoop is formed having spaced-apart subhoop through-holes, and the subhoop screw is formed having a subhoop screw threaded portion sized to pass through the subhoop through-hole and threadably engage the adjacent housing body second hole, and further having a subhoop screw shoulder proximal of the subhoop screw threaded portion and sized to not pass through the subhoop through-hole and thereby shoulder against the subhoop opposite the housing body second surface, and still further having a subhoop screw head proximal of the subhoop screw shoulder and sized to selectively seat opposite the subhoop about a respective keyway formed in a flange of the rim, whereby upon selective removable engagement of the rim on the low friction housing assemblies the flange is secured against the subhoop for stability of the rim on the low friction housing assemblies.

54. The system of embodiment 53 wherein the subhoop through-holes are formed in groups of three about the subhoop, a central such through-hole being configured for receipt of the subhoop screw, and housing body posts are formed so as to extend from the housing body second surface offset to each side of the housing body second hole, the housing body posts configured to extend within the subhoop through-holes on opposite sides of the central subhoop through-hole for location and further stabilization of the subhoop relative to the low friction housing assemblies.

55. The system of any of embodiments 31-54 wherein the cable tension dial assembly comprises a dial body and a nested dial base, a drive shaft of the cable tension dial assembly being operably housed by the dial body and the dial base such that a coupler of the drive shaft extends through a dial body through-hole for access thereto.

56. The system of embodiment 55 wherein the dial body is formed having at least one dial body cut-out for access to a take-up shaft installed within the cable tension dial assembly in operable engagement with the drive shaft and the tensioning cable engaged with the take-up shaft without having to disassemble the dial body from the dial base.

57. The system of embodiment 56 wherein the cable tension dial assembly comprises a dial removably installed on the drive shaft coupler, whereby selective removal of the dial provides access to the at least one dial body cut-out.

58. The system of embodiment 57 wherein the dial comprises a dial face and a dial insert.

59. The system of any of embodiments 55-58 wherein the dial body is further formed having a dial body post extending from the dial body and configured for slidable receipt of the respective low friction housing assembly.

60. The system of any of embodiments 55-59 wherein the dial body is formed having a dial body recess with a dial body recess hole therein, and a dial body bearing wheel is installed within the dial body recess for receipt thereover of a second tensioning cable.

61. The system of any of embodiments 31-60 comprising one or more grooved bearing wheels for operable receipt thereover of the tensioning cable.

62. The system of embodiment 61 wherein each grooved bearing wheel comprises a wheel body having a wheel shaft extending therefrom, a wheel bearing installed on the wheel shaft, and a wheel rim installed on the wheel bearing.

63. The system of embodiment 62 wherein the wheel bearing has a nominal inside diameter of approximately 5 mm and a nominal outside diameter of approximately 16 mm.

64. The system of embodiment 62 or embodiment 63 wherein the wheel rim is formed with a circumferential wheel rim groove for receipt therein of the tensioning cable.

65. The system of any of embodiments 31-64 wherein a single row of low friction lug assemblies are positioned about the drum shell, and first and second tensioning cables are operably engaged with the low friction lug assemblies and with respective first and second rims, whereby the single row of low friction lug assemblies are employed in respective first and second drumhead tuning rim apparatuses so as to adjust the overall pitch of two drumheads positioned on the drum shell of the drum.

66. The system of embodiment 65 wherein a first cable tension dial assembly operably engages the first tensioning cable so as to selectively adjust tension on the first rim, and a second cable tension dial assembly operably engages the second tensioning cable so as to selectively adjust tension on the second rim.

67. The system of any of embodiments 31-66 wherein the tensioning cable is aramid fiber braided rope.

68. The system of any of embodiments 31-67 wherein the tensioning cable is in the range of approximately 1.3 to 2.3 mm in diameter.

69. A drum comprising a drum shell, at least one drumhead tuning rim apparatus for securing and tuning a drumhead on the drum shell, the drumhead tuning rim apparatus comprising a plurality of low friction housing assemblies shiftably mounted on the drum shell, a plurality of low friction lug assemblies installed spaced about the drum shell, a rim seated over the drumhead on the drum shell as by selectively removably engaging the low friction housing assemblies, a cable tension dial assembly operably engaging the rim so as to increase or decrease tension on the rim and thus the drumhead, and a tensioning cable alternately passing about the low friction housing and lug assemblies substantially about the drum shell and operably engaging the cable tension dial assembly at at least one end so as to selectively raise or lower the overall pitch of the drumhead, whereby operating the cable tension dial assembly to tighten the tensioning cable shifts the low friction housing assemblies toward the low friction lug assemblies and thereby pulls the rim toward the drum shell so as to increase tension on the drumhead, and operating the cable tension dial assembly to loosen the tensioning cable allows the low friction housing assemblies to shift away from the low friction lug assemblies and thereby the rim to shift away from the drum shell so as to decrease tension on the drumhead, further such operation of the cable tension dial assembly allowing the rim to be sufficiently unloaded so as to be selectively disengaged from the low friction housing assemblies and removed from the drum to facilitate removing and replacing the drumhead without any disassembly of the low friction housing assemblies, the low friction lug assemblies, the cable tension dial assembly, and the interconnected tensioning cable.

70. A drumhead tuning rim system for securing and independently tuning opposed first and second drumheads on a drum shell of a drum, comprising a first drumhead tuning rim apparatus associated with a first rim configured for seating over the first drumhead on the drum shell, the first drumhead tuning rim apparatus comprising a first tensioning cable mechanically coupled to a first cable tension dial assembly and a plurality of first low friction housing assemblies selectively removably engaged with the first rim and selectively shiftable on the drum shell, a second drumhead tuning rim apparatus associated with a second rim configured for seating over the second drumhead on the drum shell, the second drumhead tuning rim apparatus comprising a second tensioning cable mechanically coupled to a second cable tension dial assembly and a plurality of second low friction housing assemblies selectively removably engaged with the second rim and selectively shiftable on the drum shell, and a plurality of low friction lug assemblies configured to be installed spaced about the drum shell for selective engagement with the first and second tensioning cables, whereby operating the first or second cable tension dial assembly to tighten the respective first or second tensioning cables shifts the respective first or second low friction housing assemblies toward the low friction lug assemblies and thereby pulls the respective first or second rim toward the drum shell so as to increase tension on the respective first or second drumhead, and operating the first or second cable tension dial assembly to loosen the respective first or second tensioning cable allows the respective first or second low friction housing assemblies to shift away from the low friction lug assemblies and thereby the respective first or second rim to shift away from the drum shell so as to decrease tension on the respective first or second drumhead, further such operation of the first or second cable tension dial assembly allowing the respective first or second rim to be sufficiently unloaded so as to be selectively disengaged from the respective first or second low friction housing assemblies and removed from the drum to facilitate removing and replacing the respective first or second drumhead without any disassembly of the first or second low friction housing assemblies, the low friction lug assemblies, the first or second cable tension dial assembly, and the interconnected first or second tensioning cable.

71. A method for securing and tuning a drumhead on a drum shell of a drum, the method comprising positioning the drumhead on the drum shell, positioning a rim over the drumhead, removably engaging the rim with low friction housing assemblies shiftably mounted on the drum shell so as to secure the rim on the drum shell over the drumhead, the low friction housing assemblies being operably engaged with low friction lug assemblies installed spaced about the drum shell and with a cable tension dial assembly through a tensioning cable alternately passing about the low friction housing and lug assemblies and operably engaging the cable tension dial assembly, selectively operating the cable tension dial assembly to tighten the tensioning cable and shift the low friction housing assemblies toward the low friction lug assemblies and thereby pull the rim toward the drum shell so as to increase tension on the drumhead, and selectively operating the cable tension dial assembly to loosen the tensioning cable and allow the low friction housing assemblies to shift away from the low friction lug assemblies and thereby the rim to shift away from the drum shell so as to decrease tension on the drumhead, further such operation of the cable tension dial assembly allowing the rim to be sufficiently unloaded so as to be selectively disengaged from the low friction housing assemblies and removed from the drum to facilitate removing and replacing the drumhead without any disassembly of the low friction housing assemblies, the low friction lug assemblies, the cable tension dial assembly, and the interconnected tensioning cable.

72. The method of embodiment 71 wherein the steps of selectively operating the cable tension dial assembly comprises selectively turning a dial of the cable tension dial assembly.

73. The method of embodiment 71 or embodiment 72 wherein selectively disengaging the rim from the low friction housing assemblies comprises rotating the rim relative to the drum shell so as to selectively align keyways formed in the rim with removable engagement means formed on the low friction housing assemblies.

74. The method of any of embodiments 71-73 further comprising operably engaging the tensioning cable with a take-up shaft of the cable tension dial assembly.

75. The method of embodiment 74 further comprising removing a dial from the cable tension dial assembly so as to access the take-up shaft.

76. The method of any of embodiments 71-75 further comprising operably engaging an opposite second tensioning cable with a dial body bearing wheel of the cable tension dial assembly.

77. The method of embodiment 76 further comprising removing a dial from the cable tension dial assembly so as to access the dial body bearing wheel.

78. The method of any of embodiments 71-77 wherein multiple drums are to be tuned, comprising the further steps of positioning a plurality of drumheads on a plurality of drum shells, positioning a plurality of rims over the respective drumheads, removably engaging the rims with low friction housing assemblies shiftably mounted on each drum shell so as to secure each rim on the respective drum shell over the respective drumhead, the low friction housing assemblies being operably engaged with low friction lug assemblies installed spaced about the drum shells and with cable tension dial assemblies through tensioning cables alternately passing about the low friction housing and lug assemblies and operably engaging the cable tension dial assemblies, and selectively operating a system controller to selectively tighten one or more of the tensioning cables until the desired overall pitch of one or more of the drumheads is achieved.

79. A kit comprising a drumhead tuning rim apparatus as defined in any one of embodiments 1-24 and 31-70.

80. The kit of embodiment 79 further comprising instructional material.

81. The kit of embodiment 80 wherein the instructional material provides instructions on how to perform the method as defined in any one of embodiments 25-30 and 71-80.

82. Use of a drumhead tuning rim apparatus as defined in any one of embodiments 1-24 and 31-70 to mount and tune a drumhead.

83. The use of embodiment 82 wherein the use comprises a method as defined in any one of embodiments 25-30 and 71-78.

To summarize, regarding the exemplary embodiments of the present invention as shown and described herein, it will be appreciated that a drumhead tuning rim system and method is disclosed and configured for drumhead mounting and tuning to replace the standard six, eight, or twelve lug and tension rod system that is currently used on most traditional drum kit snares, toms, and bass drums. Because the principles of the invention may be practiced in a number of configurations beyond those shown and described, it is to be understood that the invention is not in any way limited by the exemplary embodiments, but is generally directed to a drumhead tuning rim system and method and is able to take numerous forms to do so without departing from the spirit and scope of the invention. Furthermore, the various features of each of the above-described embodiments may be combined in any logical manner and are intended to be included within the scope of the present invention.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the terms "about," "approximately," or "roughly" mean that the characteristic, item, quantity, parameter, property, or term so qualified encompasses a range of plus or minus ten percent above and below the value of the stated characteristic, item, quantity, parameter, property, or term or other such tolerance suitable to the application. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible.

Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using "consisting of" or "consisting essentially of" language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The methods as described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A drumhead tuning rim system comprising at least one drumhead tuning rim apparatus for securing and tuning a drumhead on a drum shell of a drum, the drumhead tuning rim apparatus comprising:

a plurality of low friction lug assemblies configured to be installed spaced about the drum shell, each low friction lug assembly comprising a lug body having a lug body post;

a plurality of low friction housing assemblies configured to be shiftably mounted on the drum shell, each low friction housing assembly comprising a housing body having a housing body first hole configured to slidably receive the lug body post, whereby the low friction housing assemblies are shiftably mounted on the drum shell as by being slidably mounted on the respective low friction lug assemblies; and a rim configured for seating over the drumhead on the drum shell and for selectively removably engaging the low friction housing assemblies so as to secure the rim on the drum shell over the drumhead, whereby in use shifting the low friction housing assemblies toward the low friction lug assemblies pulls the rim toward the drum shell so as to increase tension on the drumhead, and shifting the low friction housing assemblies away from the low friction lug assemblies thereby shifts the rim away from the drum shell so as to decrease tension on the drumhead, further such shifting of the low friction housing assemblies away from the low friction lug assemblies allowing the rim to be sufficiently unloaded so as to be selectively disengaged from the low friction housing assemblies and removed from the drum to facilitate removing and replacing the drumhead without any disassembly of the low friction housing assemblies and the low friction lug assemblies.

2. The system of claim 1 wherein the low friction lug assemblies comprise one of rotatable lug grooved bearing wheels and low friction sliding surfaces.

3. The system of claim 2 wherein the low friction lug assemblies each comprise two vertically offset lug grooved bearing wheels.

4. The system of claim 1 wherein the low friction housing assemblies comprise one of rotatable housing grooved bearing wheels and low friction sliding surfaces.

5. The system of claim 4 wherein the low friction housing assemblies each comprise two circumferentially offset housing grooved bearing wheels.

6. The system of claim 1 wherein a lug body spring is installed on the lug body post and configured to be received within the housing body first hole, whereby the lug body spring biases each low friction housing assembly away from the respective low friction lug assembly.

7. The system of claim 1 wherein each housing body comprises a housing body first surface in which the housing body first hole is formed and a further housing body second surface, and a means for removably engaging each low friction housing assembly with the rim is formed on the housing body second surface.

8. The system of claim 7 wherein the removable engagement means is a subhoop screw installed in a threaded housing body second hole formed in the housing body second surface.

9. The system of claim 8 wherein the subhoop screw comprises a subhoop screw shoulder having a length that substantially corresponds to the thickness of a flange of the rim with which the subhoop screw engages in selectively removably engaging the rim on the low friction housing assemblies.

10. The system of claim 9 wherein the flange of the rim is formed having spaced-apart keyways corresponding to the locations of the low friction housing assemblies for selective engagement with the respective subhoop screws.

11. The system of claim 8 wherein an annular subhoop is installed on the low friction housing assemblies so as to be substantially adjacent to the housing body second surface.

12. The system of claim 11 wherein the subhoop is formed having spaced-apart subhoop through-holes, and the subhoop screw is formed having a subhoop screw threaded portion sized to pass through the subhoop through-hole and threadably engage the adjacent housing body second hole, the subhoop screw further having a subhoop screw shoulder proximal of the subhoop screw threaded portion and sized to not pass through the subhoop through-hole and thereby shoulder against the subhoop opposite the housing body second surface, and the subhoop screw further having a subhoop screw head proximal of the subhoop screw shoulder and sized to selectively seat opposite the subhoop about a respective keyway formed in a flange of the rim, whereby upon selective removable engagement of the rim on the low friction housing assemblies the flange is secured against the subhoop for stability of the rim on the low friction housing assemblies.

13. The system of claim 12 wherein the subhoop through-holes are formed in groups of three about the subhoop, a central through-hole being configured for receipt of the subhoop screw, and further wherein housing body posts are formed so as to extend from the housing body second surface offset to each side of the housing body second hole, the housing body posts configured to extend within the subhoop through-holes on opposite sides of the central through-hole for location and further stabilization of the subhoop relative to the low friction housing assemblies.

14. The system of claim 1 further comprising an annular subhoop configured to be installed on the low friction housing assemblies so as to be substantially adjacent to the rim when the rim is selectively removably engaged with the low friction housing assemblies, whereby upon selective removable engagement of the rim on the low friction housing assemblies the rim is secured against the subhoop for stability of the rim on the low friction housing assemblies.

15. The system of claim 14 wherein spaced-apart subhoop screws extend from the subhoop corresponding to the locations of the low friction housing assemblies for selective engagement with corresponding spaced-apart keyways formed in a flange of the rim.

16. The system of claim 15 wherein each subhoop screw comprises a subhoop screw shoulder having a length that substantially corresponds to the thickness of the flange of the rim.

17. A drumhead tuning rim system comprising at least one drumhead tuning rim apparatus for securing and tuning a drumhead on a drum shell of a drum, the drumhead tuning rim apparatus comprising:

a plurality of low friction lug assemblies configured to be installed spaced about the drum shell;

a plurality of low friction housing assemblies configured to be shiftably mounted on the drum shell;

an annular subhoop configured to be installed on the low friction housing assemblies spanning the drum shell; and a rim configured for seating over the drumhead on the drum shell and for selectively removably engaging the low friction housing assemblies so as to secure the rim on the drum shell over the drumhead, whereby in use upon selective removable engagement of the rim on the low friction housing assemblies the rim is secured against the subhoop for stability of the rim on the low friction housing assemblies, shifting the low friction housing assemblies toward the low friction lug assemblies pulls the rim toward the drum shell so as to increase tension on the drumhead, and shifting the low friction housing assemblies away from the low friction lug assemblies thereby shifts the rim away from the drum shell so as to decrease tension on the drumhead, further such shifting of the low friction housing assemblies away from the low friction lug assemblies allowing the rim to be sufficiently unloaded so as to be selectively disengaged from the low friction housing assemblies and removed from the drum to facilitate removing and replacing the drumhead without any disassembly of the low friction housing assemblies, the low friction lug assemblies, and the subhoop.

18. The system of claim 17 wherein spaced-apart subhoop screws extend from the subhoop corresponding to the locations of the low friction housing assemblies for selective engagement with corresponding spaced-apart keyways formed in a flange of the rim.

19. The system of claim 18 wherein each subhoop screw comprises a subhoop screw shoulder having a length that substantially corresponds to the thickness of the flange of the rim.

20. A method for securing and tuning a drumhead on a drum shell of a drum, the method comprising:

positioning the drumhead on the drum shell;

positioning a rim over the drumhead;

removably engaging the rim with low friction housing assemblies shiftably mounted on the drum shell so as to secure the rim on the drum shell over the drumhead, the low friction housing assemblies being operably engaged with low friction lug assemblies installed spaced about the drum shell;

selectively slidably shifting the low friction housing assemblies toward the low friction lug assemblies to thereby pull the rim toward the drum shell so as to increase tension on the drumhead; and selectively slidably shifting the low friction housing assemblies away from the low friction lug assemblies to thereby shift the rim away from the drum shell so as to decrease tension on the drumhead, further such shifting of the low friction housing assemblies away from the low friction lug assemblies allowing the rim to be sufficiently unloaded so as to be selectively disengaged from the low friction housing assemblies and removed from the drum to facilitate removing and replacing the drumhead without any disassembly of the low friction housing assemblies and the low friction lug assemblies.

* * * * *